US006209367B1

(12) United States Patent
Hyatt, Jr. et al.

(10) Patent No.: US 6,209,367 B1
(45) Date of Patent: Apr. 3, 2001

(54) ELECTRONIC CAM ASSEMBLY

(76) Inventors: Richard G. Hyatt, Jr., 2720 Timber Rd., Shawsville, VA (US) 24162; Douglas E. Trent, 6514 Crescent Blvd., SW. Roanoke, VA (US) 24014

( * ) Notice: Subject to any disclaimer, the term of this patent is extended or adjusted under 35 U.S.C. 154(b) by 0 days.

(21) Appl. No.: 09/092,080

(22) Filed: Jun. 5, 1998

Related U.S. Application Data

(60) Provisional application No. 60/050,941, filed on Jun. 6, 1997.

(51) Int. Cl.[7] ..... E05B 49/00

(52) U.S. Cl. ..... 70/278.2; 70/379 R; 70/278.1; 70/278.3

(58) Field of Search ..... 70/379 R, 380, 70/278.1, 278.2, 278.3, 278.6, 408, 277, 256, 279.1, 283, 283.1, 413, 169, 58, 168, 167, 166, 165, 164, 163

(56) References Cited

U.S. PATENT DOCUMENTS

| | | | | |
|---|---|---|---|---|
| 1,695,518 | | 12/1928 | Watson | 70/277 |
| 3,336,770 | | 8/1967 | Parsons | 70/141 |
| 3,539,991 | | 11/1970 | Irazoqui | 340/825.31 |
| 3,748,878 | | 7/1973 | Balzano et al. | 70/218 |
| 4,496,948 | * | 1/1985 | Ishizuka | 340/825.13 |
| 4,514,001 | | 4/1985 | Garcia | 292/341.16 |
| 4,603,564 | | 8/1986 | Kleinhany et al. | 70/277 |
| 4,744,021 | * | 5/1988 | Kristy | 364/141 |
| 4,745,784 | | 5/1988 | Gartner | 70/277 |
| 4,761,976 | | 8/1988 | Kleinhany | 70/277 |
| 4,807,455 | | 2/1989 | Mauer | 70/277 |
| 4,909,053 | | 3/1990 | Zipf, III et al. | 70/283 |
| 4,984,441 | | 1/1991 | Mauer | 70/277 |
| 5,094,093 | | 3/1992 | Ben-Asher | 70/278 |
| 5,140,317 | | 8/1992 | Hyatt, Jr. et al. | 340/825.31 |
| 5,228,730 | | 7/1993 | Gokcebay et al. | 292/144 |
| 5,367,295 | | 11/1994 | Gokcebay et al. | 340/825.31 |
| 5,423,198 | | 6/1995 | DiVito et al. | 70/278 |
| 5,479,799 | * | 1/1996 | Kilman et al. | 70/231 |
| 5,495,733 | | 3/1996 | Yen et al. | 70/279 |
| 5,540,068 | | 7/1996 | Gartner et al. | 70/277 |
| 5,541,581 | | 7/1996 | Trent | 340/825.31 |
| 5,542,272 | | 8/1996 | Heinemann | 70/278 |
| 5,745,044 | | 4/1998 | Hyatt, Jr. et al. | 340/825.31 |
| 5,773,803 | * | 6/1998 | Fukuta | 235/375 |
| 5,845,523 | | 12/1998 | Butterweck et al. | 70/278 |

* cited by examiner

*Primary Examiner*—Lynne H. Browne
*Assistant Examiner*—John B. Walsh
(74) *Attorney, Agent, or Firm*—Robert E. Bushnell, Esq.

(57) ABSTRACT

A cam assembly may be constructed with lock cylinder perforated by a centrally positioned keyway, and having an exposed circumferential surface surrounding the keyway rotatably fitted within a centrally positioned keyhole of a housing, and rotated within the centrally positioned keyhole in response to rotational force applied by a key conformingly corresponding to the lock cylinder through an arc. A cam is positioned within the housing to rotate with the lock cylinder as the key conformingly corresponding to the lock manually applies a rotational force to the lock cylinder rotates through the arc, while a member attached to the cam and eccentrically positioned relative to the keyway, drives the bolt between extended and retracted positions as the lock cylinder rotates through the arc. An electronic circuit containing a memory and a microprocessor, is mounted upon and supported by the cam to rotate with the cam through the arc. The electronic circuit operationally responds to digital data carried by the key that is in electronic conformance to data stored within the memory, by electrically energizing a release mechanism that is spaced-apart from the axis of rotation of the cylinder plug, to move between a deployed position preventing rotation of the cam relative to the housing, and a released position accommodating the rotation of the cam relative to the housing.

43 Claims, 61 Drawing Sheets

ELECTRONIC CAM ASSEMBLY

CLAIM FOR PRIORITY

This application makes reference to, incorporates the same herein, and claims all right accruing from my earlier filing of a provisional patent application entitled *Electronic Cain Assembly* filed in the United States Patent & Trademark Office on of Jun. 6, 1997 and there assigned Ser. No. 60/050,941.

BACKGROUND OF THE INVENTION

1. Field of the Invention

The present invention relates to access control, and, more particularly, to manually operated, electronically keyed locks suitable for retrofitting existing appliances.

2. Description of the Related Art

Current designs for maintaining security of containers such as bank safe deposit boxes require attended access and, all too frequently, dual keys, to allow access to the various containers maintained. I have found that this has become increasingly expensive in terms of man hours consumed by the employees of the bank providing attendance to the customers of the bank.

SUMMARY OF THE INVENTION

It is therefore, an object of the present invention to provide an improved lock and process for restricting access to containers.

It is another object to provide a lock and process suitable for retrofitting containers previously secured by bitted and unbitted locks.

It is yet another object to provide a lock and process for securing containers against unauthorized entry.

It is still another object to provide a lock and process able to electronically control access to the interior of secured containers.

It is still yet another object to provide a lock and process for electronically monitoring access to secured containers.

It is a further object to provide an electronically key controlled process and a cam assembly that may be configured as a single integrated electromechanical unit operable with an electronically controlled key, mated with either the existing lock cylinders of containers or with new lock cylinders, and retroactively fitted to secure those containers.

It is a still further object to provide an electronically key controlled process and integrated electromechanical cam assembly that may either be installed as a retroactively fitted component part of an existing locking mechanism with a minimum of modifications of the locking mechanism, or alternatively, be incorporated into a complete locking mechanism.

It is still yet a further object to provide an electronically key controlled process and integrated electromechanical cam assembly that may be retroactively installed as a component part of locking mechanisms previously installed in lockable containers by using existing screw patterns and key holes of those containers.

It is an additional object to provide an electronically key controlled process and integrated electromechanical cam assembly able to be mated with either bitted lock cylinders or with unbitted lock cylinders.

These and other objects may be achieved with a process requiring both mechanical conformance and electronic conformance of a key to both a cylinder plug and to an electronic circuit carried by a cam driving a bolt between a locked position and an unlocked position. An embodiment may be constructed with a housing bearing a centrally positioned hole centered upon a first axis, a bolt supported by the housing and moving transversely relative to the first axis to protrude beyond the housing to an extended, and locked, position and to retract within the housing to a retracted, and unlocked, position, and a lock cylinder perforated by a centrally positioned keyway, having an exposed circumferential surface surrounding the keyway rotatably fitted within the centrally positioned hole, and rotating within the centrally positioned hole in response to rotational force applied by a key conformingly corresponding to the lock through an arc centered upon the first axis. A cam is positioned within the housing to rotate with the lock cylinder as the key conformingly corresponding to the lock manually applies a rotational force to the lock cylinder is manually rotated through the arc. A member eccentrically positioned relative to the first axis, extends between the cam and the bolt to drive the bolt between the extended and the retracted positions as the lock cylinder is rotated through the arc. An electronic circuit containing a memory and a microprocessor and mounted upon and supported by the cam to rotate with the cam through the arc, determines electronic conformance of the key and operationally responds to digital data carried by the key to electronically activate a release mechanism that is spaced-apart from the cylinder and eccentrically positioned away from the first axis. The circuit is functionally activated by the electronic circuit in response to mechanical and electronic conformance between the key and both the cylinder plug and the electronic circuit, to move between a deployed position preventing rotation of the cam relative to the housing, and a released position accommodating the rotation of the cam relative to the housing.

BRIEF DESCRIPTION OF THE DRAWINGS

A more complete appreciation of the invention, and man, of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 11A:
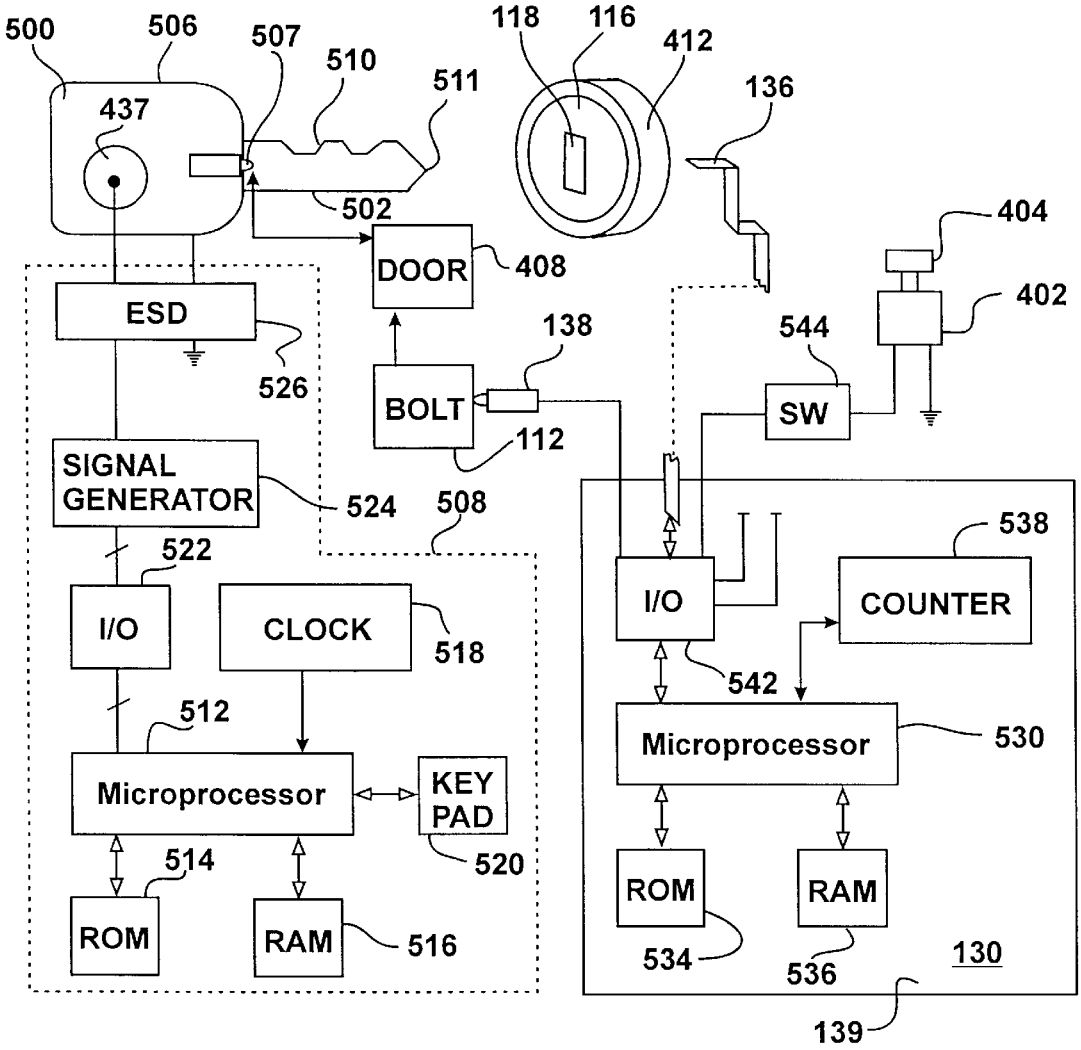
FIG. 11A is a block diagram schematic illustrating electrical circuits that may be incorporated into the practice of the present invention.
Figure 11B:
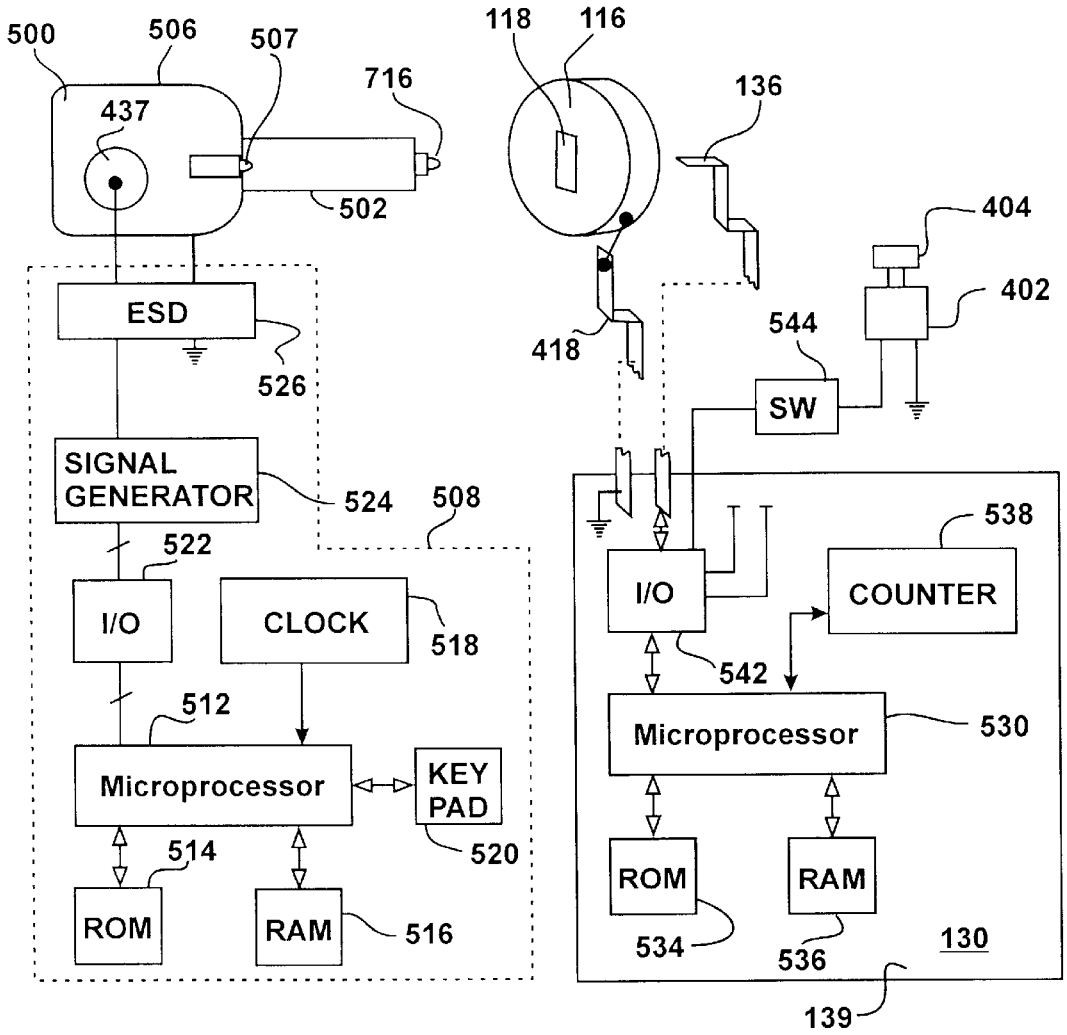
FIG. 11B is a block diagram schematic illustrating an alternative configuration of electrical circuits that may be incorporated into the practice of the present invention.

Turning now to the drawings, FIGS. 11A, 11B illustrate the salient features of a hypothetical, conventional parking meter lock 100. A metal cam plate 102 formed with a circular shape perforated by a D-shaped hole 104 engages a D-shaped extension of a locking cylinder plug 116. A conically shaped, concave depression 106 extends toward the cylinder plug 116, to enable D-shaped hole 104 to engage the extension. A pair of radially opposite helically spiral slots 108 equally distantly radially spaced-apart from D-shaped hole 104, perforate plate 102 to engage and direct the travel of connecting pins 110, thereby alternately withdrawing and projecting bolts 112 in opposite reciprocation in the opposite directions indicated by arrows A. Typically, a mechanically bitted key 50 is inserted into keyway 118 that axially perforates a cylinder plug 116 that is coaxially fitted inside the cylindrical shell 119 that surrounds plug 116. Shell 119 is fitted into a re-enforced door (not shown) such as the circular door of a municipal parking meter. Correct correspondence between the lands and peaks of the bits of key 50 and the tumblers (not shown) within plug 116 along a shear line enables a torque that is manually applied to the handle of key 50 to rotate plug 116 relative to shell 119, thereby drawing pins 110 from a radially outwardly position shown in FIG. 11A, to a radially inward position closer to the center of cam plate 102. Once bolts 112 have been withdrawn, the door into which lock assembly 100 has been fitted can be removed, or opened. Rotation of key 50 in the opposite direction causes extension of bolts 112, thereby locking the door.

Figure 2:
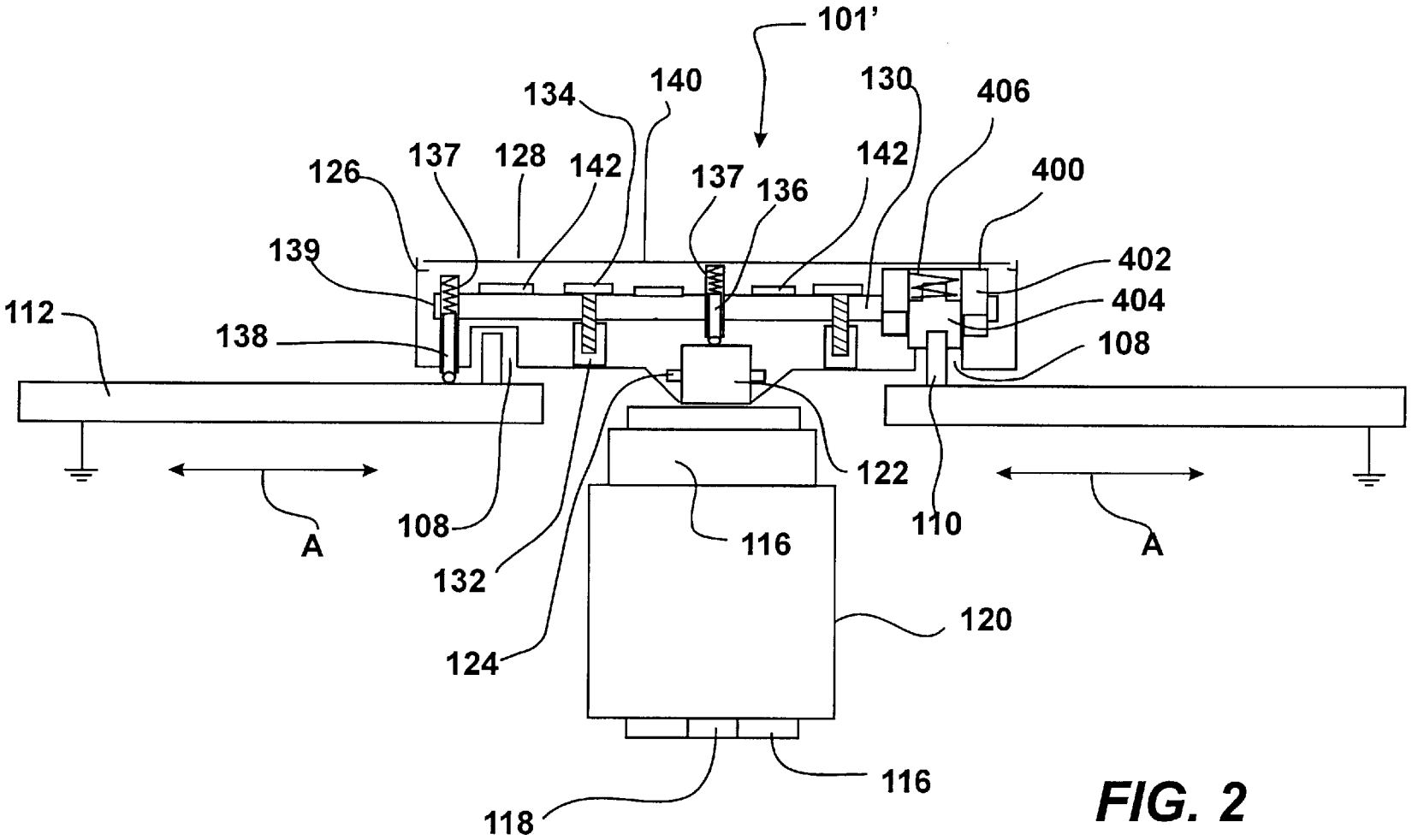
FIG. 2 shows a detailed side elevational view of one embodiment of the present invention designed for retrofitting a parking meter lock.

In the embodiment of the invention shown in FIG. 2, cylinder plug 116 is encased in a cylindrical shell 120 made of a non-electrically conductive material. This shell electrically insulates log plug 116 from the metal door into which lock assembly 101 has been installed. An extension 122 of cylinder plug 116 passes through D-shaped hole 104 in cam plate housing 126, and makes mechanical and electrical contact with a board mounted spring biased electrical contact pin 136. Compression spring 137 biases pin 136 toward the axial dimension of cylindrical plug 116, thereby assuring electrical contact between pin 138 and extension 122 as plug 116 rotates within shell 120. Electronic cam assembly 140 contains a second board mounted spring biased pin 138 forming mechanical and continuous electrical contact with at least one of the reciprocally sliding bolts 112.

Figure 1A:
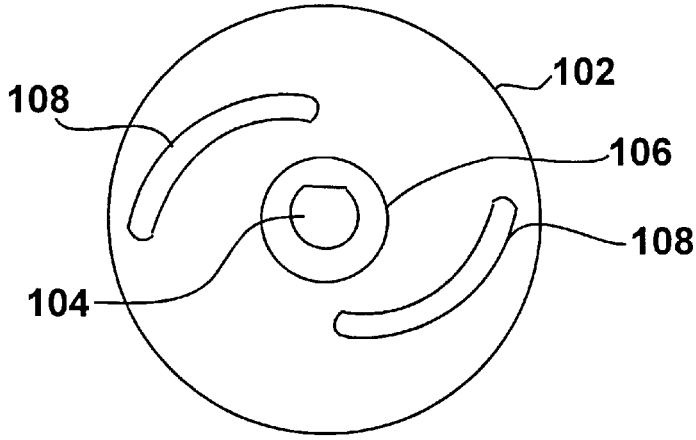
FIG. 1A shows a plan view of a contemporary arrangement for a parking meter lock.
Figure 1B:
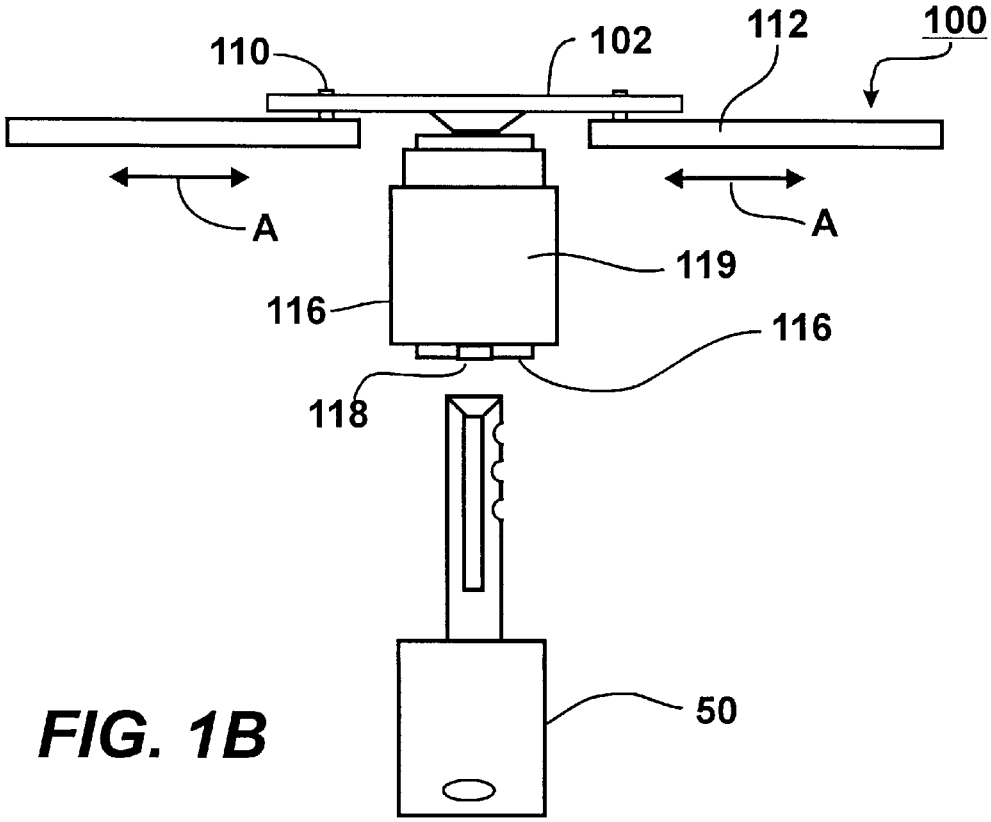
FIG. 1B shows a side view of a cam customarily used in a contemporary parking meter lock.

Cam plate 126 (having a base with a shape substantially identical to the top view of cam plate 102 shown in FIG. 1B), and cover 128 are preferably made of an electrically insulating material such as a plastic. Circuit board 130 supports a plurality of integrated circuits 142 and other electrical components, as well as electrical contacts 136, 138. Bosses 132, formed in a base of the cam plate housing 126, receive threaded fasteners 134 extending through circuit board 130, thereby securing circuit board 130 within cam plate housing 126.

Figure 3:
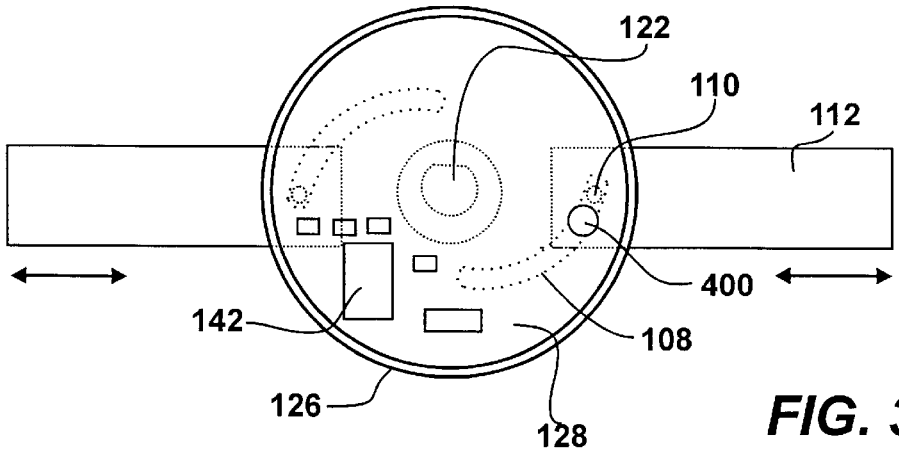
FIG. 3 shows a top detailed view of a cam which may be used in the embodiment of FIG. 2.
Figure 4:
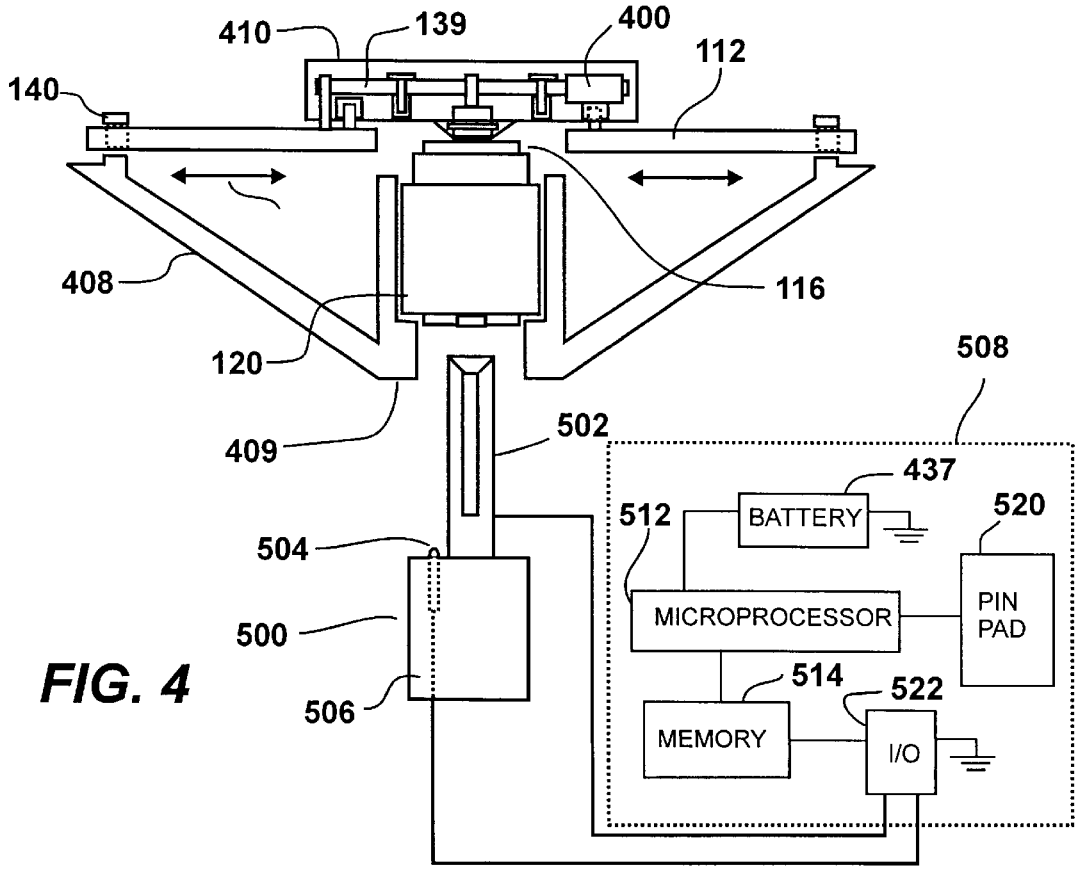
FIG. 4 shows a side elevational view of a contemporary parking meter fitted with an embodiment of the present invention.

Turning to FIGS. 3 and 4, in conjunction with FIG. 2, when a key 500 corresponding to the security features (i.e., correctly bitted teeth, if the key is in fact bitted), is inserted into keyway 118 so that the blade 502 of the key serves as an electrical contact for transmission of data and power to contact 136, while a spring loaded electrical contact 504 mounted on the other side of the head 506 of key 500 engages the circumferential exposed surface (often the exposed surface of a re-enforced insert) 409 of door 408, thereby completing the electrical circuit between the electronic control circuit 508 of key 500 and electronic circuit 130 mounted on circuit board 139 via contacts 136, 138. Assuming correct electrical conformity established through the power and data transferred between circuits 508 (including the supply of power to circuit 130 from circuit 508 via key 500 and cylinder plug 116), the logic and control components of circuit 130 will electrically activate solenoid release assembly 400 with the electrical current flowing through solenoid coil 402, thereby withdrawing solenoid armature 404 upwardly in the drawing shown in FIG. 2, and thus removing armature 404 from slot 108. This frees the length of slot 108, thereby enabling pins 110 to travel along the arcuate lengths of corresponding slots 108 as a manual torque applied to key 500 rotates plug 116 and cam assembly 140. In the normal locked position, shown in FIGS. 2 and 3, armature 404 obstructs one of the two slots 108, thus preventing cam 126 from rotating and drawing bolts 112 inwardly. Solenoid assembly 400 may be mounted upon and supported by circuit board 139. Cover 128 encases circuit 139 within the housing provided by the inner side of cam plate 126, while pins 110 protrude into grooves 108. Bolts 112 slide between guides 410 and the adjoining portion of door 408.

Figure 5:
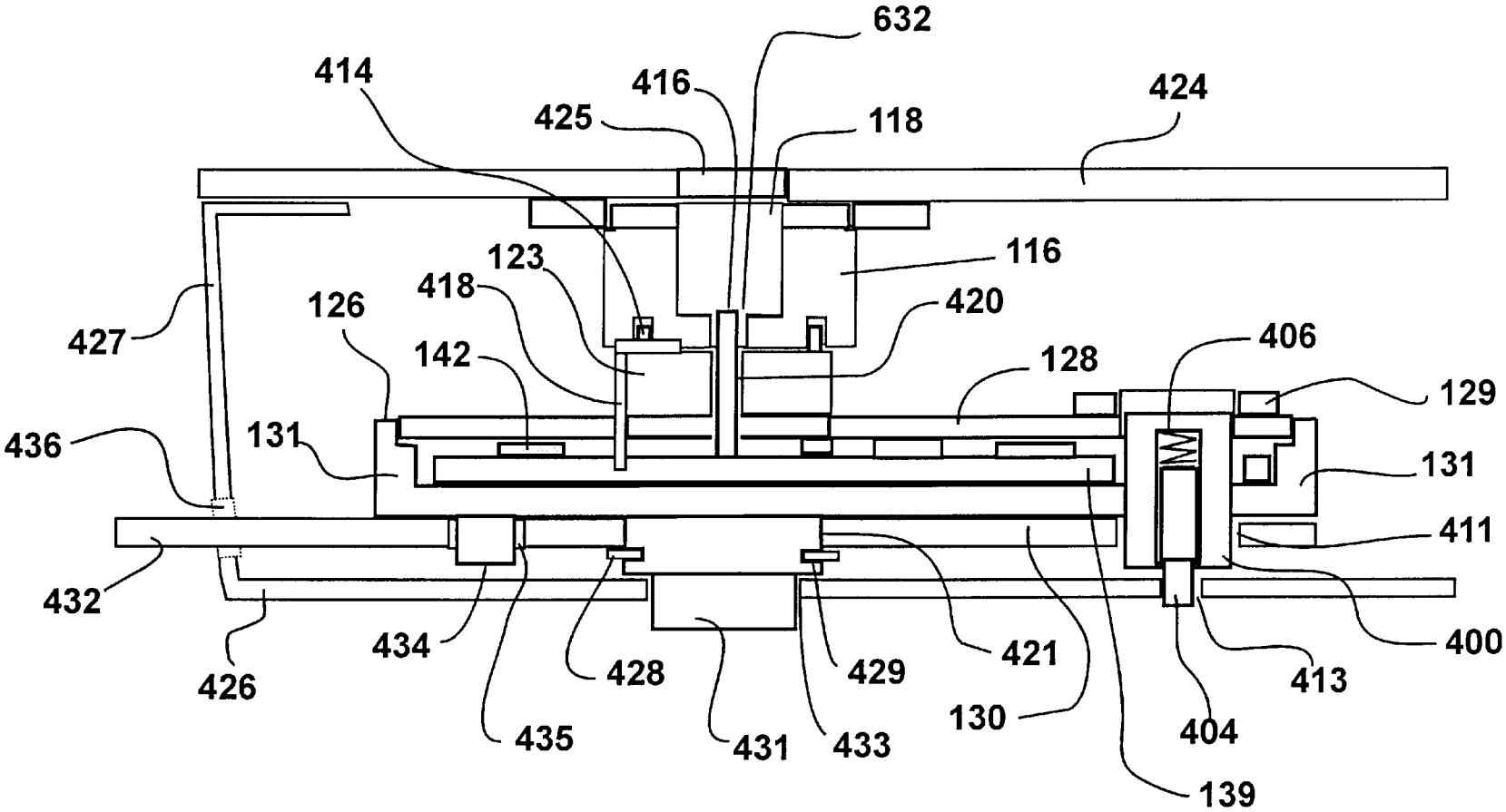
FIG. 5 shows a cut-away side view of another embodiment of the present invention suitable for use with metal office furniture.
Figure 6:
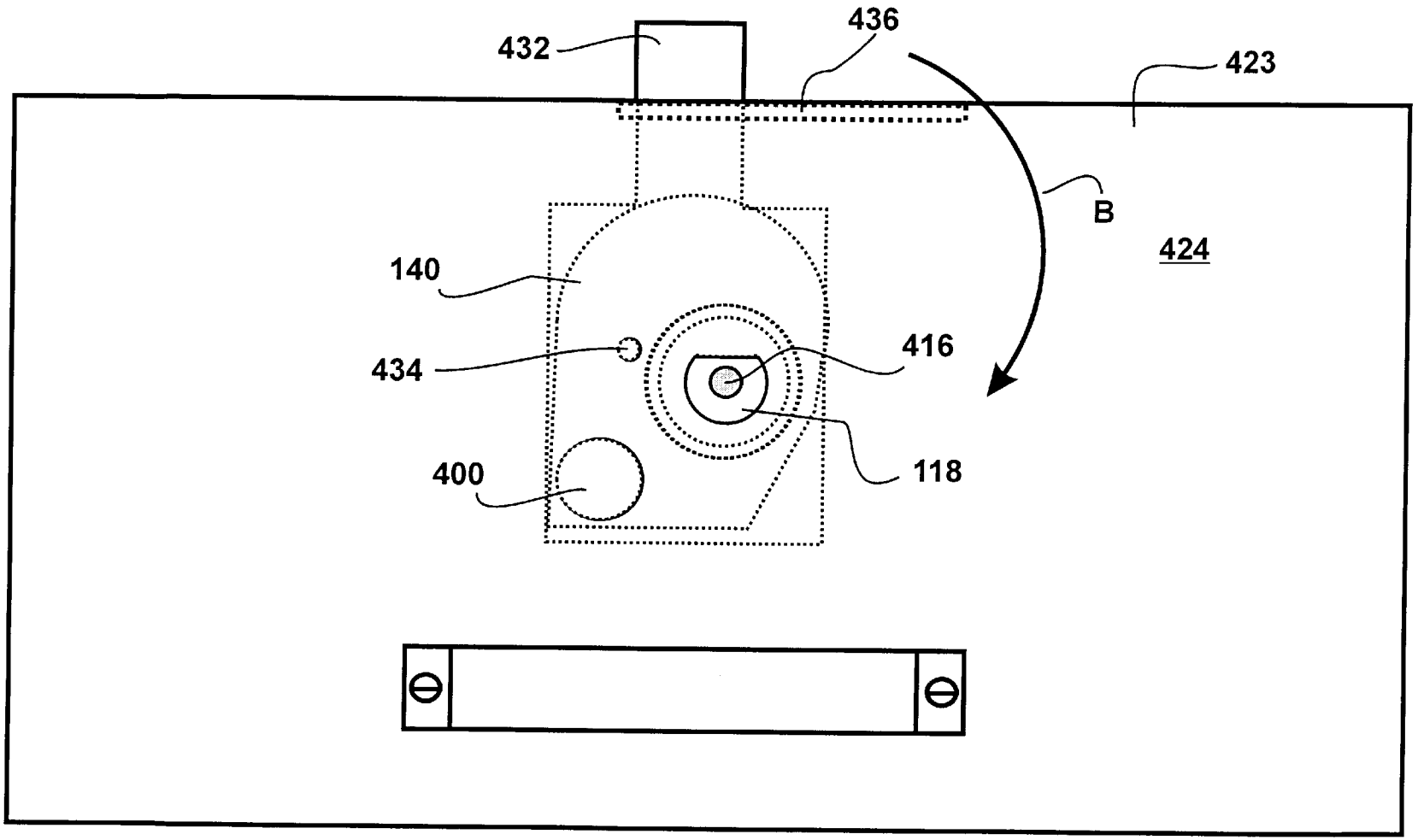
FIG. 6 shows a front elevational view of a drawer for office furniture fitted with the embodiment shown in FIG. 5.
Figure 9:
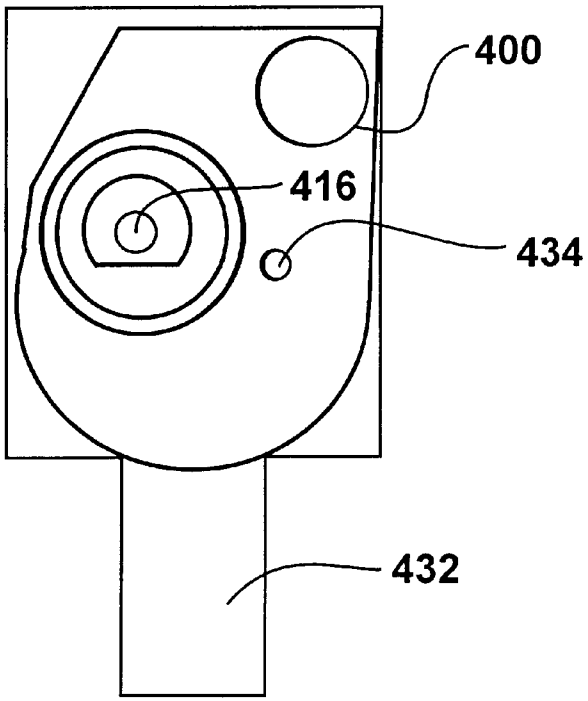
FIG. 9 shows an assembly of the conversion plate and electric cam incorporated into the embodiment of FIG. 5.
Figure 8:
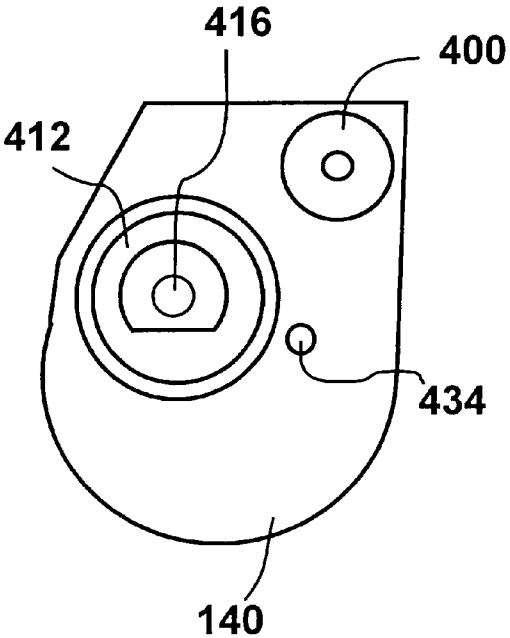
FIG. 8 shows an electronic cam incorporated into the embodiment of FIG. 5.
Figure 7:
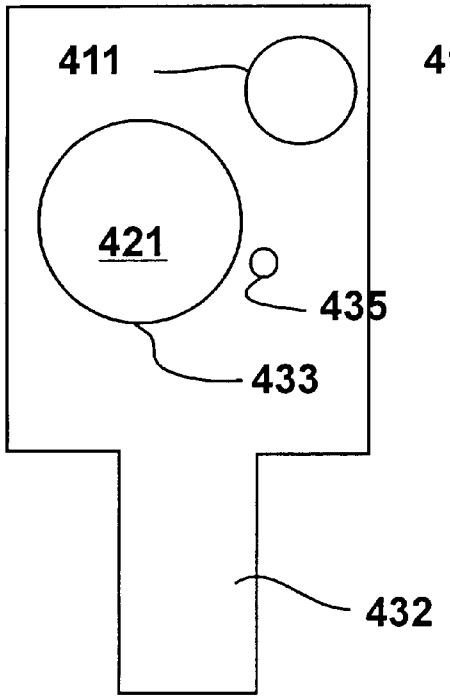
FIG. 7 shows a conversion plate incorporated into the embodiment of FIG. 5.
Figure 10:
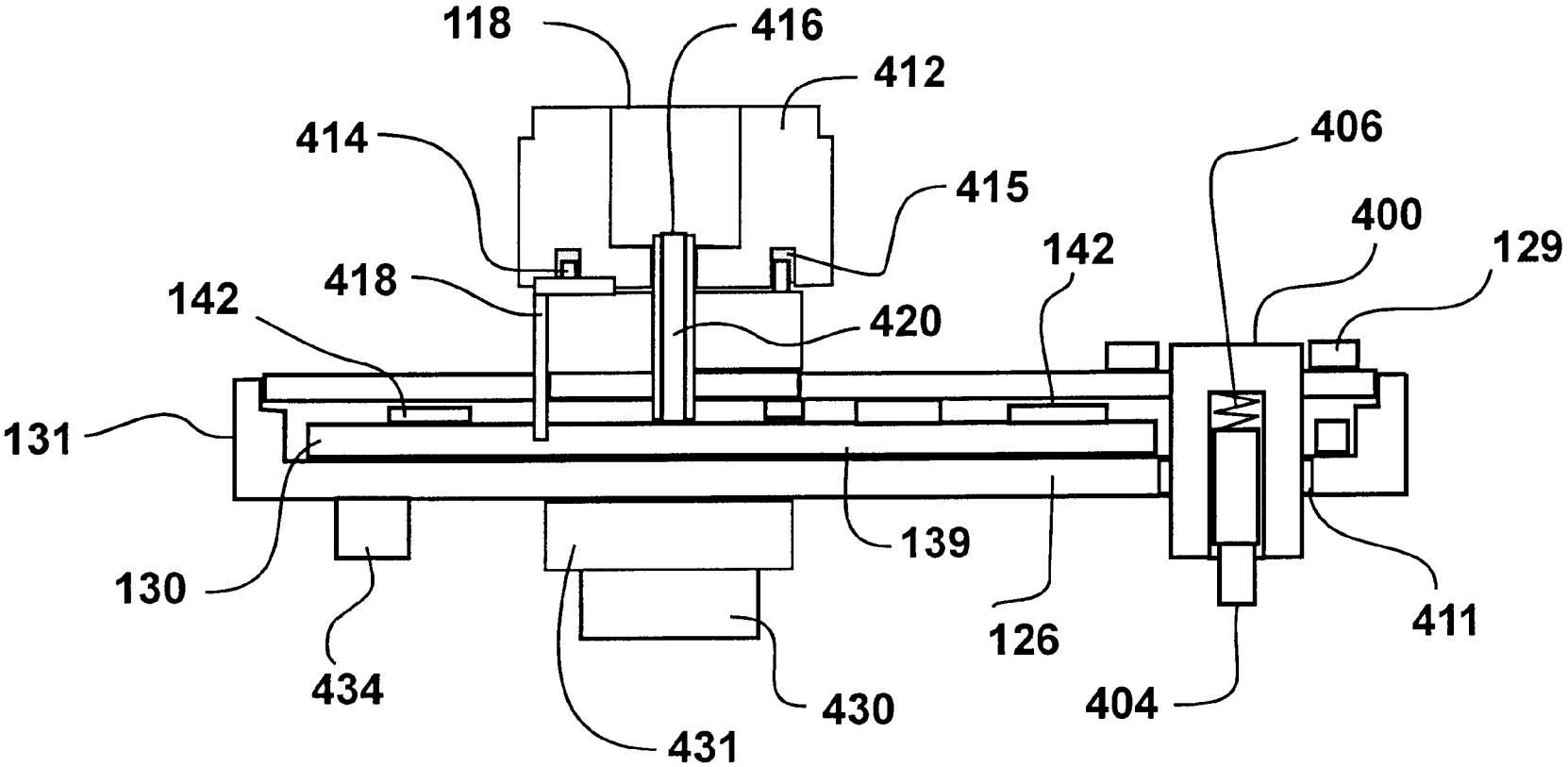
FIG. 10 shows a side elevational view of a cam assembly suitable for installation into the container illustrated by FIG. 5.

Turning now to FIG. 5, an alternative embodiment is illustrated with a cam plate and housing 126 preferably made of an electrically insulating material, installed between a cylinder plug 412 and the rear wall 426 of the door of the item of furniture. Plug 412 is mounted with washer 422, and is in contact with the front wall 424 of the door of the item of furniture, with keyway 118 aligned with hole 425 in front wall 424. A pair of shear pins 414 extend between an extension 123 of cam plate 126 and fit into conforming apertures 415 in the base of cylinder plug 412, thereby linking rotation of plug 412 with rotation of plate 126. A single hole 413 is formed within rear wall 426, in alignment with the armature 404 of solenoid 400. In its inactive, normally inoperative state as shown in FIG. 5, armature 404 rests within aperture 413 under the bias of spring 406.

A second hole 433 is formed in rear wall 426, in substantial coaxial alignment with keyway 118, to accommodate pivot post 430 of cam spacer post 431, which serves to support cam plate 126 upon post 430, thereby fastening the entire assembly against the rear wall 426. A Truarc® ring 428 holds post 431, together with plate 126, against cam plate extension 432. Drive pin 434 protrudes from the underside of cam plate 126 opposite circuit board 139, and is received by a conforming aperture 435 within extension plate 432.

Turning now to FIGS. 6 through 10 in conjunction with FIG. 5, extension plate 432 protrudes beyond a slot 436 cut into the flange 427 extending between front wall 424 and rear wall 426. When a hand held key conforming in shape to the interior of keyway 118 is fully inserted into keyway 118, the blade of the key makes electrical contact with contact wiper 416 mounted upon circuit board 139 while an electrically separate contact pin spaced radially apart from the blade of the key makes electrical contact with the adjoining exposed surface of front wall 424 and, via electrical conduction through plug 412, with contact wiper 418 also mounted upon circuit board 139. Upon determination of electrical and logical compatibility of the key with circuit 130 mounted upon circuit board 139, solenoid 400 is electrically charged to withdraw armature 404 from aperture 413, thereby releasing cam plate 126 and plug 412 to rotate under the torque manually applied to the key, thereby enabling post 430 to rotate within aperture 433, thus allowing drive pin 434 to rotate about the axis of post 430 and thereby drawing extension plate 432 in a direction of arrow B shown in FIG. 6, through slot 436, thereby allowing door assembly 423 to be opened.

Turning now to FIG. 11A, block diagrams illustrate electronic circuit 130 for the cam assembly and electronic circuit 508 for the corresponding electronic key assembly 500 mechanically and electrically conforming to cylinder plug 116 and its electronic circuit 130. Circuit 508 is constructed within the head 506 of key 500 or, alternatively, into a portable housing electrically coupled to key 500. As shown in FIG. 11A, a replaceable battery (e.g., a 3.3 volt button battery) may be removably encased in the head 506 of key 500, with the positive plurality coupled in common to one side of electronic signal filter 526 and the bitted blade 502 of the key. In this embodiment, blade 502 is mechanically cut with teeth 510 and channels 511 conforming to keyway 18. Blade 502 is positively charged by battery 437, and makes electrical contact with, and provides transmission of both power and data to circuit 130) via flexible contact wiper 136 mounted upon circuit board 139, which is, in turn, coupled to input/output stage 542. A local ground return between circuit 130 and circuit 508 is provided via flexible spring loaded electrical contact 138 making electrical contact with bolt 112 which, in turn, makes electrical contact with the electrically conducting door 408 of the container; a spring loaded pin 507 extending from the head 506 of key 500 rides upon and makes electrical contact with door 408.

Circuit 508 may be constructed with a microprocessor 512 driven according to a programs stored in read only memory 514, using data transient in random access memory 516. A clock 518 provides synchronization to microprocessor 512, while input/output stage 522 services as a buffer enabling microprocessor 512 to drive signal generator 524. Circuit 508 is electrically powered by battery 437.

When key 500 has been fully inserted into keyway 118, blade 502 makes electrical contact with spring biased data and power contact 136, while the radially spaced-apart spring bias contact 504 serves as a ground return making electrical contact with the surrounding region 409 of door 408 and, through bolt 112, electrical contact 138 and input/output stage 542. Within logic and control circuit 130 of the cam assembly, microprocessor 530 operates according to a program stored within read only memory 534 using data written into and read from random access memory 536. Counter 538 is coupled to microprocessor 530. Communication between the logic circuit 130 and contacts 136, 138 are conducted through input/output stage 542. A switch 544 is driven by input/output stage 542 under control of microprocessor 530 upon a determination by microprocessor 530 that key 500 holds a digital signature that electronically conforms to data stored within the circuit borne by circuit board 139, to provide electrical current through solenoid coil 402 and thereby retract armature 404 or, alternatively, if the solenoid is constructed as a stepping motor, to energize coil 402 and thereby rotate armature 404.

The circuit illustrated in FIG. 11A is particularly suitable for retrofitting secured containers a such as existing standalone, municipal curbside parking meters.

Turning now to FIG. 11B, key assembly 500 has a blade 502 without bits or channels, bearing a centrally positioned electrical data and power contact 716 coupled to the positive polar type of battery 437. Contact 716 is electrically insulated from the exterior surface of blade 502. Blade 502 serves as the negative ground return via electrical contact 418 while contact 716, serves as the power and data connector when fully inserted into keyway 118, to make electrical contact with flexible spring contact 416. Flexible, spring type electrical contact wipers 416, 418 maybe surface mounted upon circuit board 139, in positions to make electrical contact respectively with contact 716 via keyway 118 and the electrically conducting cylinder plug 412. Solenoid winding 402 is either surface mounted on, or supported by, circuit board 139.

Figure 11C:
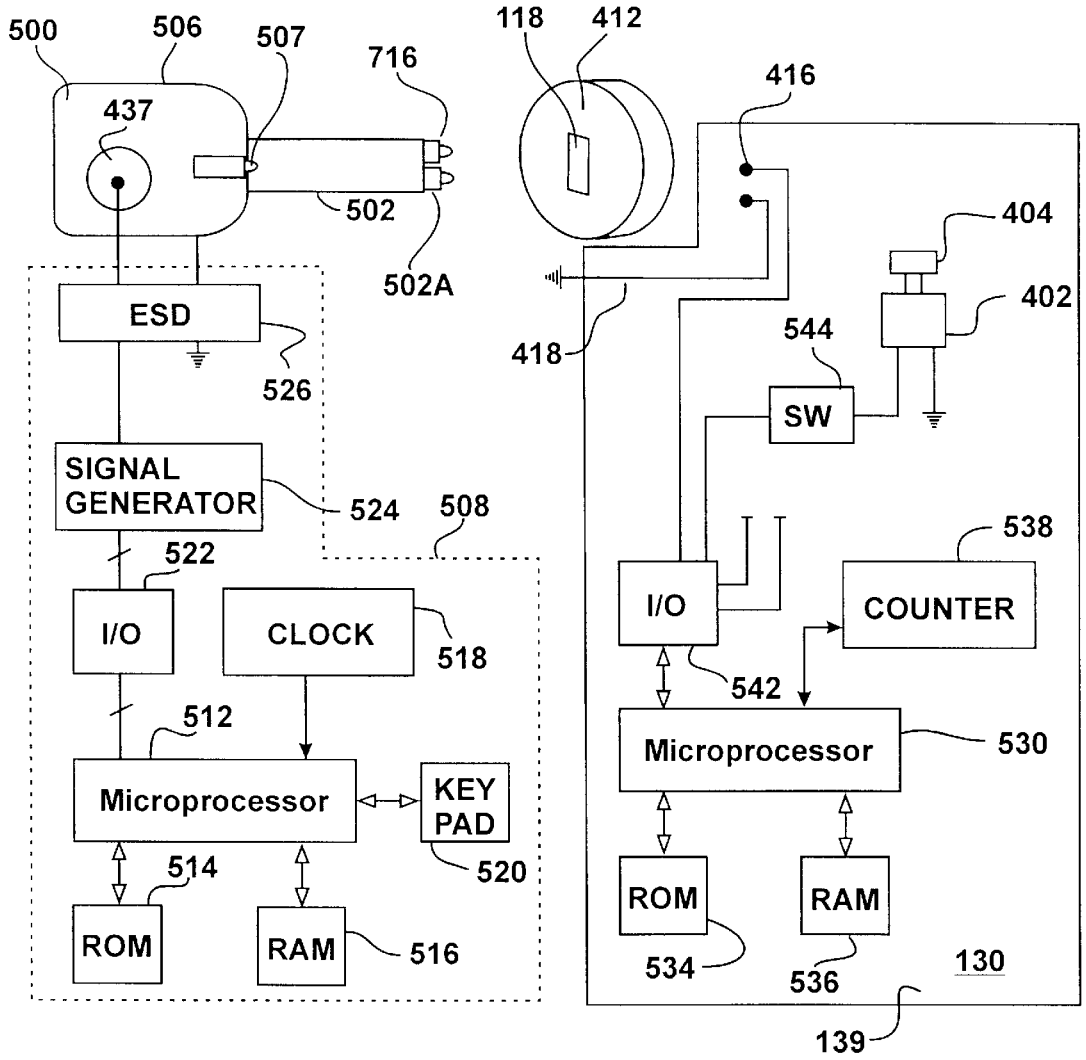
FIG. 11C is a block diagram schematic illustrating another alternative configuration of electrical circuits that may be incorporated into the practice of the present invention with a plurality of contacts accessible through the keyway.

As illustrated by FIG. 11C, the electronic circuit for the cam assembly may be equipped with its own local power supply in the form, for example, of a replaceable battery (not shown) installed on and wholly borne by circuit board 139 to provide a constant voltage to circuit components such as microprocessor 530, memories 534, 546, counter 535, and input/output stage 542, and to provide a source of electrical power for energizing coil 402 of the solenoid via switch 544. In this configuration the cylinder plug is not required to serve as a ground electrical path for the connection between the key and lock circuit 139. Use of an earth ground would be incidental. Leads 416, 418 are plated copper conductors formed on the circuit board 119, with lead 418 serving as a local ground terminal. On key circuit 508, pin terminal 502A serves as a ground conductor; terminal 502A may be a spring loaded pin or a flexible connection, positioned to make electrical contact with lead 418 when the blade, or shank 502, of key 500 is conformingly inserted into the aperture of keyway 118. A spring loaded ball bearing may be inserted within keyway 118 to mate with a corresponding dimple in shank 502, and serve as a key retainer when key 500 rotates keyway 118 out of its rest position. Terminal 502A may be connected without electrical insulation to shank 502, thereby connecting circuit 508 via shank 502. Pin terminal 716 serves that same function as shown in the embodiment illustrated by FIG. 11B, and is electrically insulated from shank 502 in order to conduct data signals and provide a positive potential to circuit 139 via lead 416.

Figure 11D:
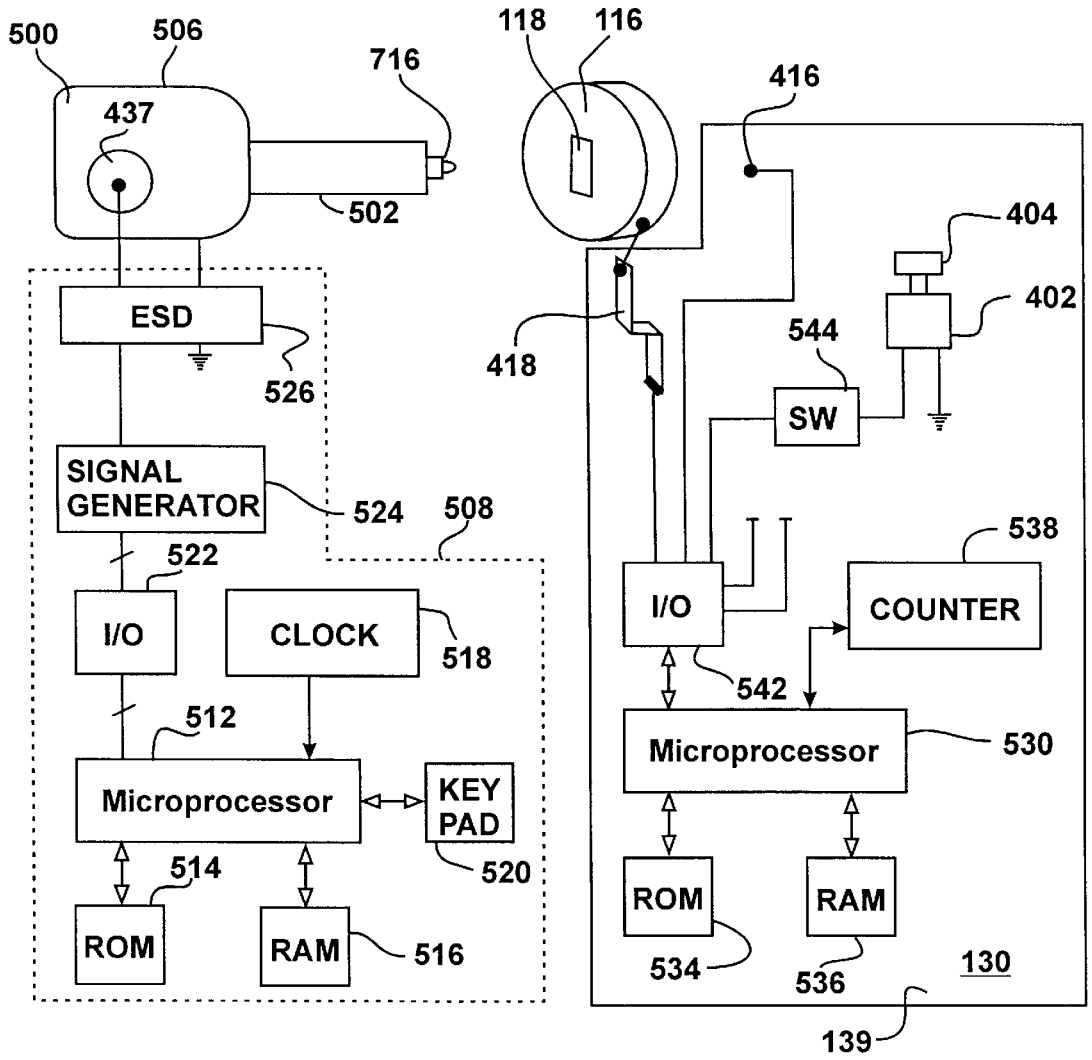
FIG. 11D is a block diagram schematic illustrating another alternative configuration of the electrical circuits that may be incorporated into the practice of the present invention with a single contact accessible through the keyway.

FIG. 11D illustrates an alternative embodiment with the cylinder plug 412 serving as an electrical ground path for electrical connection between key circuit 508 and lock circuit 139. Lead 416 is a copper lead plated upon circuit board 139, and is directly accessed by terminal 716 via keyway 118 to electrically conduct, for example, a positive potential and data signals. The key blade, or shank 502 serves as the ground terminal for key circuit 508. Terminal 716 is electrically insulated by shank 502 serves to electrically conduct a position potential and data signals in the same function as in the embodiment illustrated by FIG. 11B.

Figure 11E:
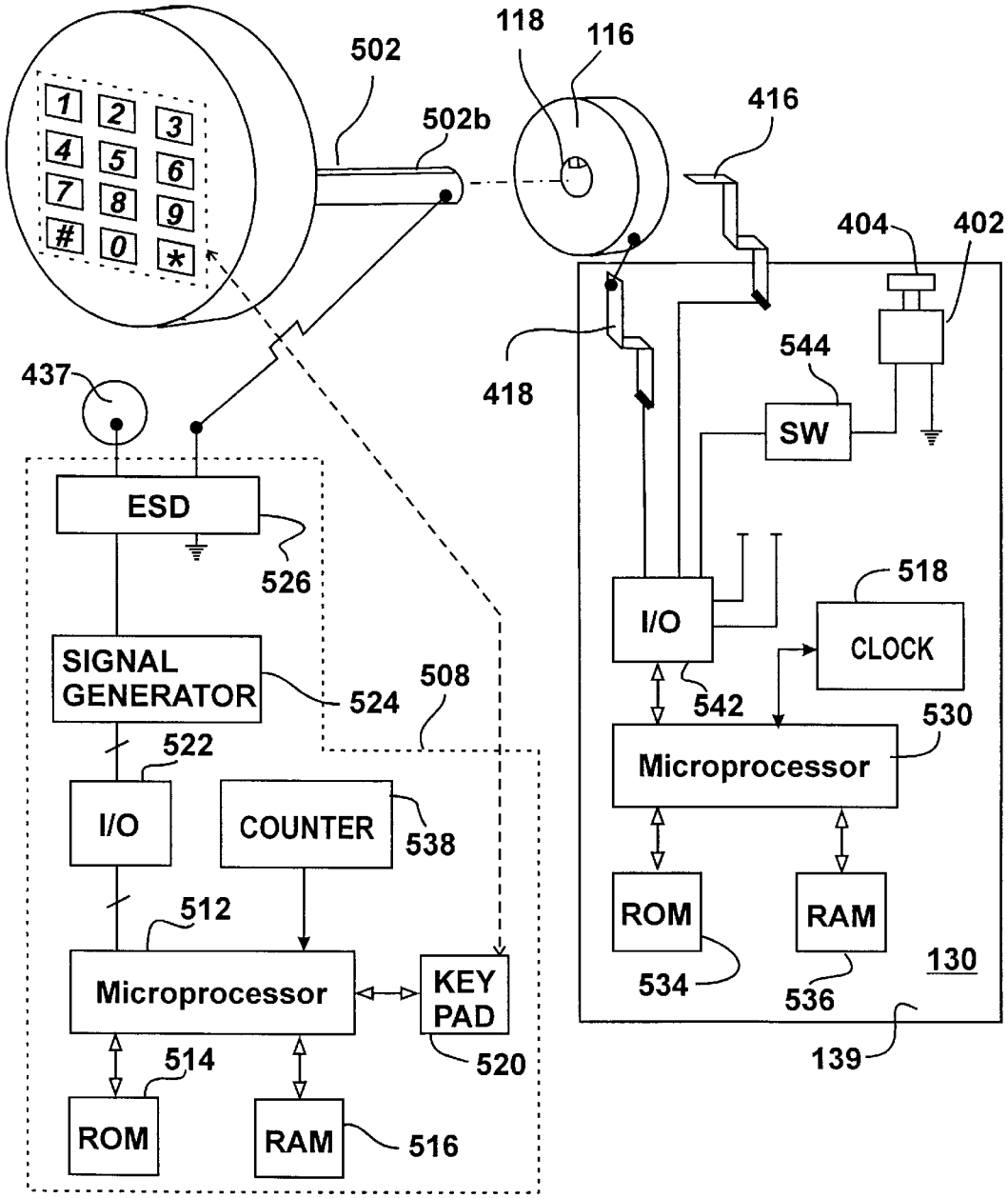
FIG. 11E is a block diagram schematic illustrating another alternative configuration of the electrical circuits that may be incorporated into the practice of the present invention using a drive spindle.
Figure 11F:
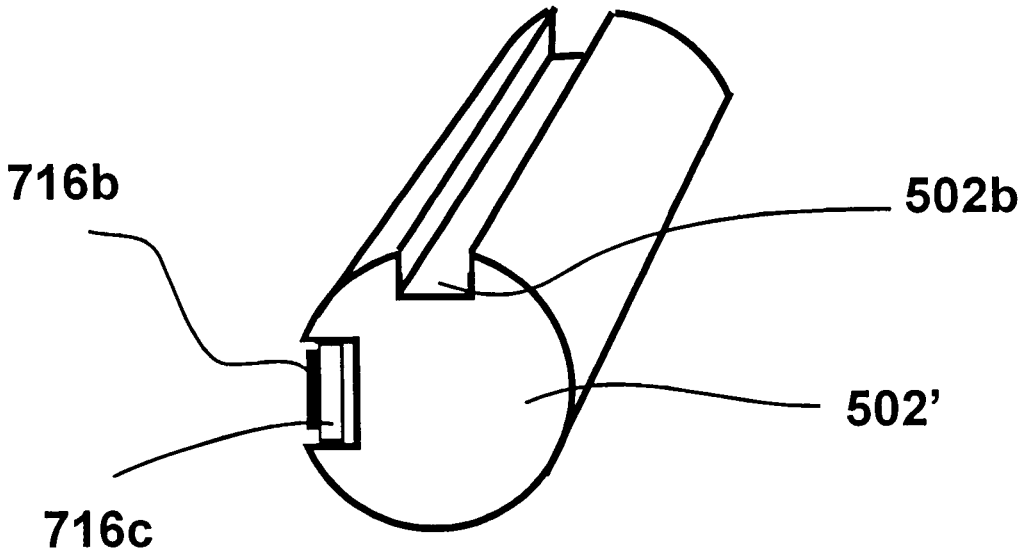
FIG. 11F is a perspective view of a drive spindle for the embodiment illustrated by FIG. 11E.

FIG. 11E illustrates an alternative embodiment bearing a keypad 520 that is exposed to manual activation by a user. A drive spindle 502', rather than a key blade, is sued to apply torque to the electronic cam that bears and encases circuit 139. Once the drive spindle 502' has been electrically connected with the electronic cam circuit 139 via keyway 118', the spindle 502' may be left within keyway 118' and removed only for service and such maintenance as replacement of battery 437. Accordingly, with the exception of replacement of battery 437, lock circuit 139 would be continuously powered by battery 437 borne by key circuit 508. In this embodiment, lock circuit 139 could be equipped with merely a clock 528, while key circuit 508 contains a counter 538. As illustrated by FIG. 11F, drive spindle 502' may be constructed with an engagement keyslot 502*b* extending either partially, or wholly, the length of shank 502', to engage a corresponding detent within keyway 118. Spindle 502' may itself serve as an electrical conductor such as the ground return, that engages electrical lead 418 of lock circuit 139, while a second electrical conductor 716*b* extends the length of spindle 502' and is electrically insulated from the body of spindle 502' by insulation 716*c*. Conductor 716*b* may be constructed as either a circuit board with a tin, copper or gold plated trace, or an electrically conducting trace itself deposited directly upon insulation 716*c*. Conductor 716*b* could be set, after encased in electrical insulation, into a metallic spindle or encased in an electrically conductive plastic spindle may, for example, of carbon filled polymer.

Figure 12:
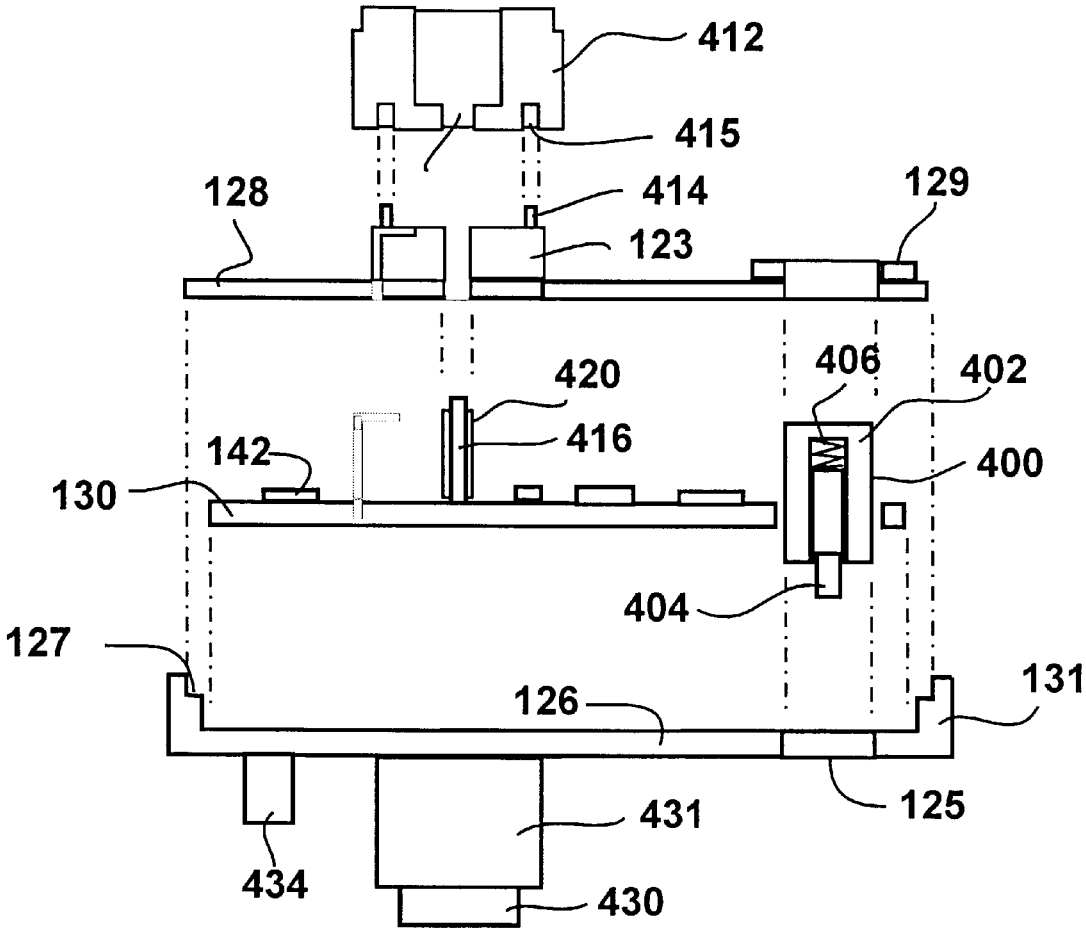
FIG. 12 is an exploded view illustrating details of the embodiment of FIG. 10.

When assembling the electronic cam, electrically conductive cylinder plug 412 bearing apertures 415, is positioned to receive within the apertures 415, corresponding shear lock pins 414 extending outwardly from cover 128 for the housing formed by cam plate 126. The solenoid release assembly 400 is mounted on circuit board 139, and circuit board 139 is in turn inserted within the circumferential walls 131 of cam plate 126, with surface mounted flexible spring electrical contact 416 centrally positioned to extend through cam plate extension 123 and into the vacant portion of keyway 118 in order to make electrical contact with the power and data conductor of the corresponding key. Contact 416 is surrounded by an electrical insulator 420 to prevent contact 116 from making electrical contact with either extension 123 or with electrically conducting plug 412. Cam spacing post 431 and pivot post 430 are concentrically positioned and coaxially aligned with keyway 118, to protrude from plate 126 toward the bolt (not shown in FIG. 12), while drive pin 434 extends axially in the same direction toward a corresponding aperture in the bolt.

Figure 13:
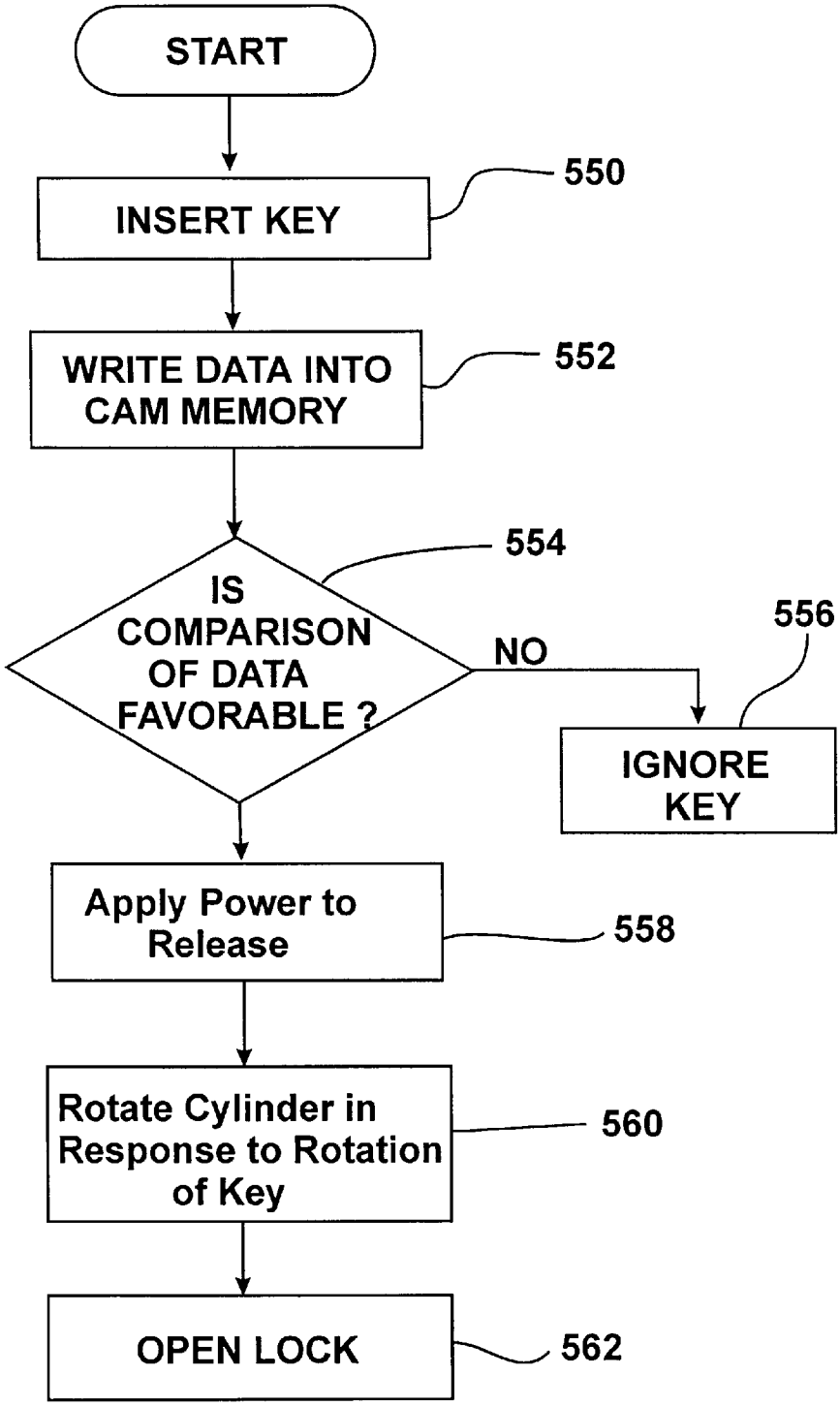
FIG. 13 is flow chart illustrating the principles of operation of the present invention.

In an operation, the key is inserted into the keyway as shown in step 550 of FIG. 13. Power is supplied from battery 437 via contact 136 to cam circuit 130, and data is written via contact 136 into memory 536. A comparison is then made by microprocessor 530 and if the data carried by the key is not electronically conforming to data held by circuit 130, in step 550 circuit 130 ignores the presence of the key. Alternatively, if the key is found by circuit 130 in step 554 to be electronically conforming, in step 558 circuit 130 applies power to switch 544 and solenoid (or motor) 400 to release cylinder 116 to the rotational torque manually applied by the key to the lock, thus enabling in step 560 rotation of the cylinder in response to the manual torque, and thereby resulting in opening of the lock in step 562.

Figure 14:
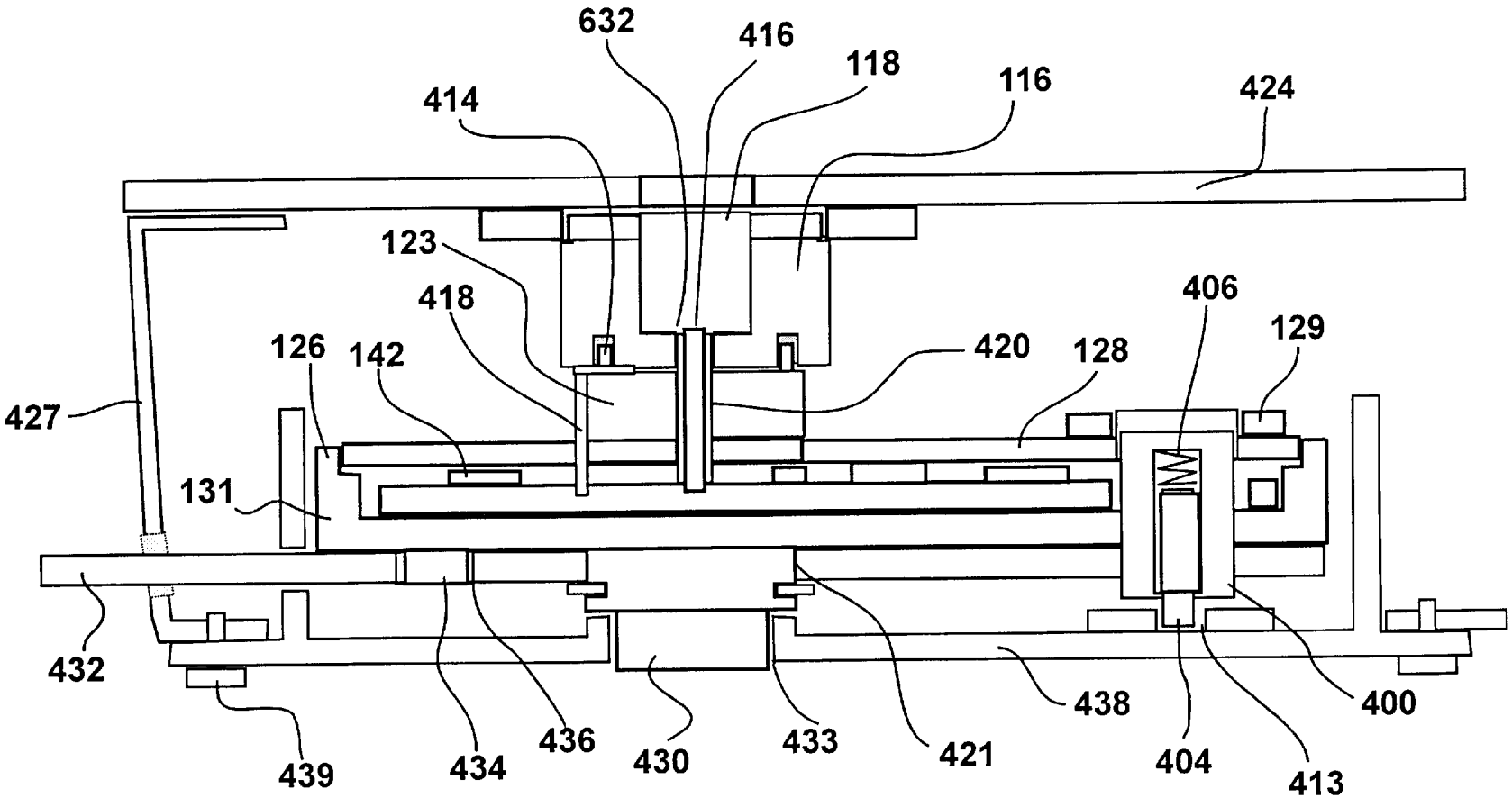
FIG. 14 is a front elevational view of a drawer fitted with an embodiment of the lock shown in FIG. 10.

In FIG. 14, a drawer of an item of furniture is fitted with a lock constructed according to the principles of the present invention, with a carrier housing 438 serving as the rear wall, attached to flange 427 via threaded fasteners 439. This allows for a modular improvement using an embodiment of the present invention as a separate item installed within the furniture.

Figure 15:
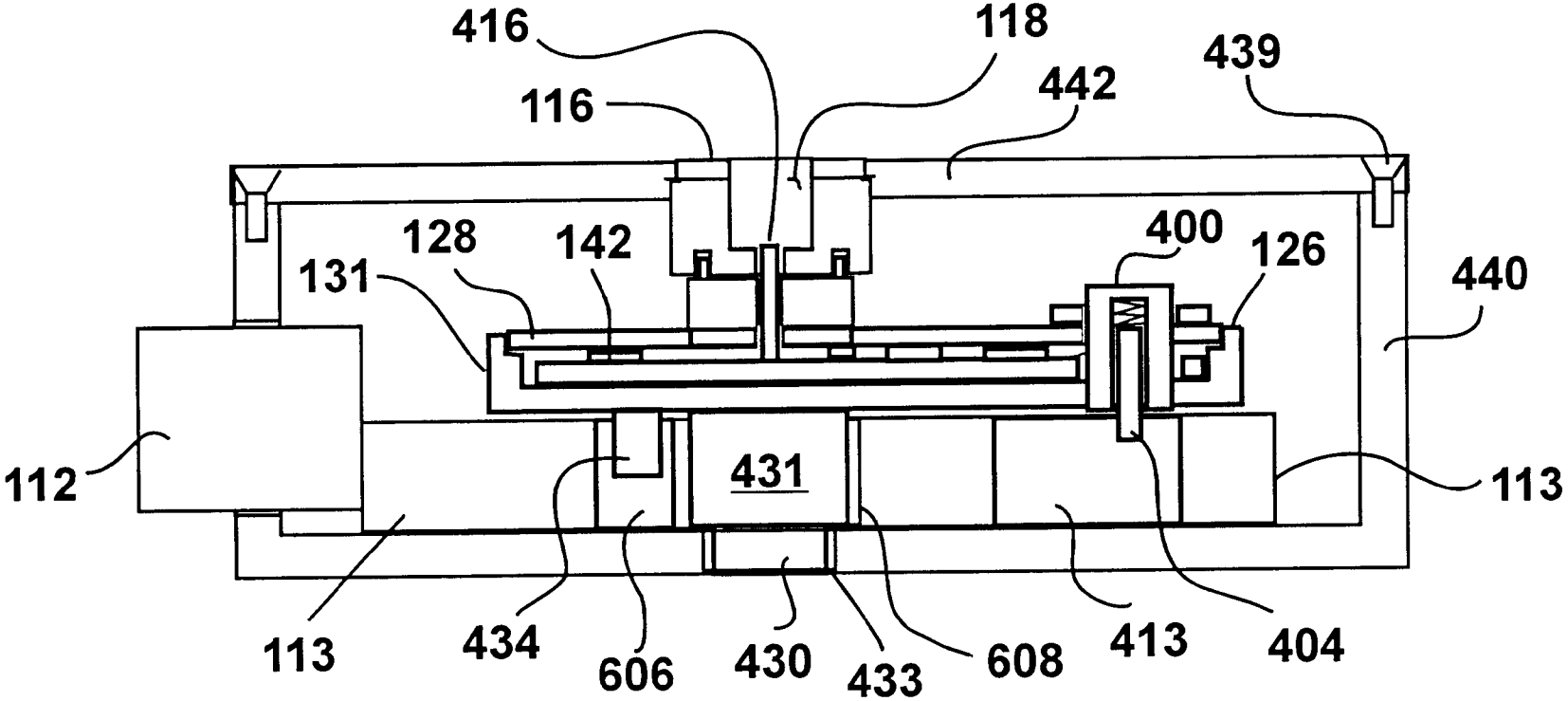
FIG. 15 is a cross-sectional view taken along sectional line XV–XV' in FIG. 17, showing a fourth embodiment of the present invention equipped with a vault.

Turning now to FIG. 15, an alternative embodiment of the present invention is shown with a construction particularly suitable for installation in a safety deposit box door within a bank vault. An aperture 433 in the rear wall of housing 440 for a lock, accommodates insertion and operational rotation of pivot post 430. The shank 113 of bolt 112 lies upon the inside surface of housing 440. Aperture 608 in shank 113 accommodates spacer 431 while aperture 606 accommodates drive pin 34 to force shank 113 to slide against the interior surface of housing 440.

Figure 17:
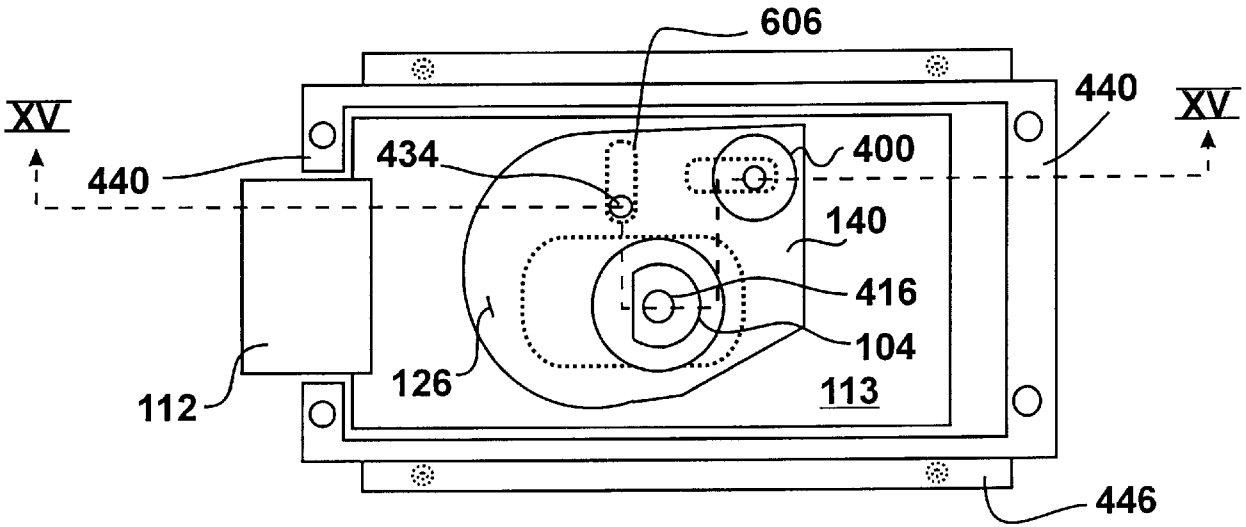
FIG. 17 is a plan view showing the assembly of the embodiment illustrated in FIG. 15.
Figure 16:
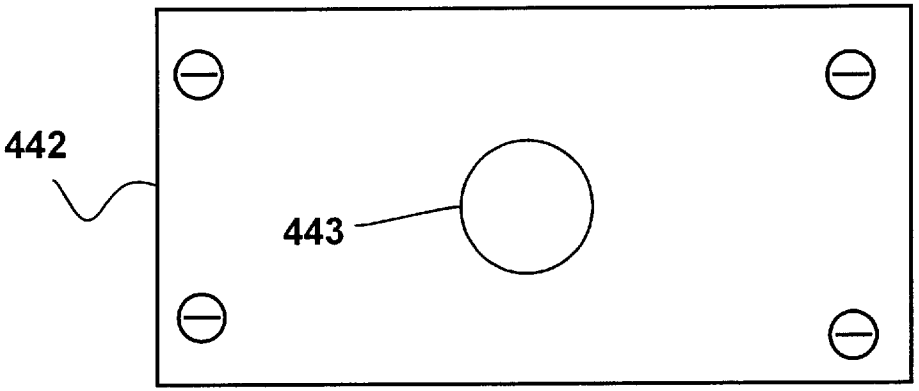
FIG. 16 shows a cover that may be attached to the embodiment of FIG. 15.
Figure 18:
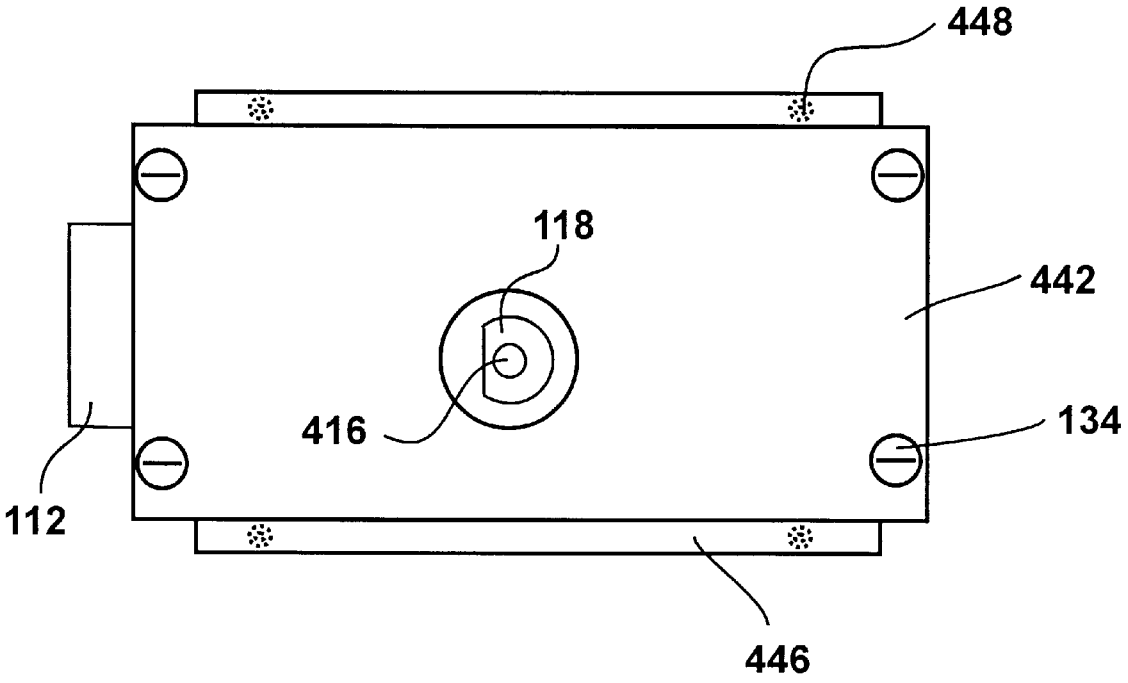
FIG. 18 is a plan view showing the assembly with the cover illustrated in FIG. 16 mounted upon the housing illustrated in FIG. 17.
Figure 19:
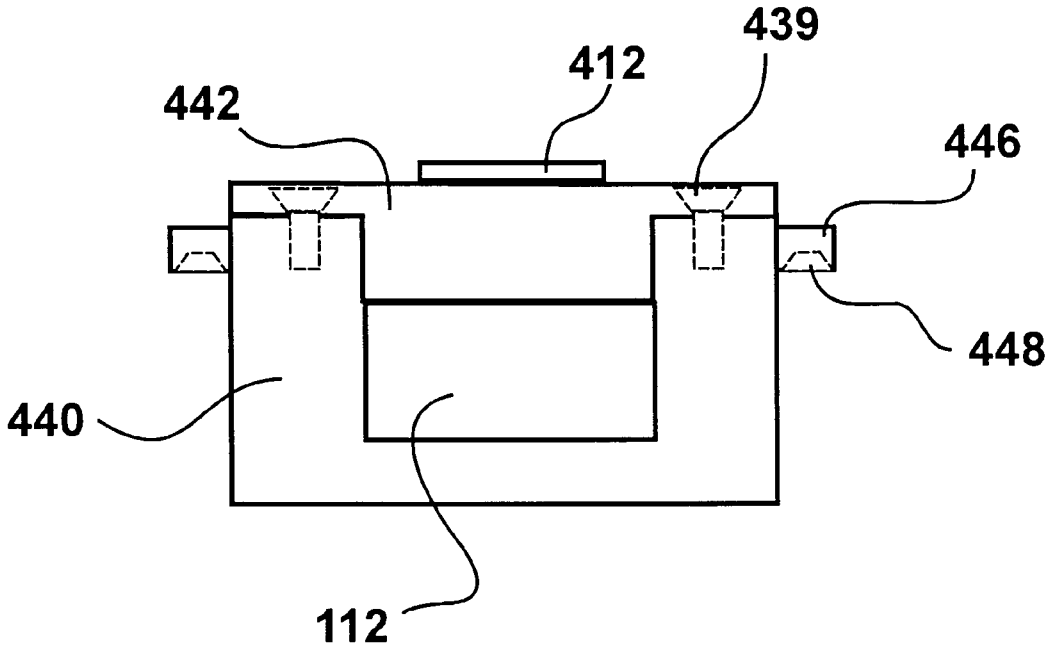
FIG. 19 is an end view of the embodiment shown in FIG. 18.
Figure 20A:
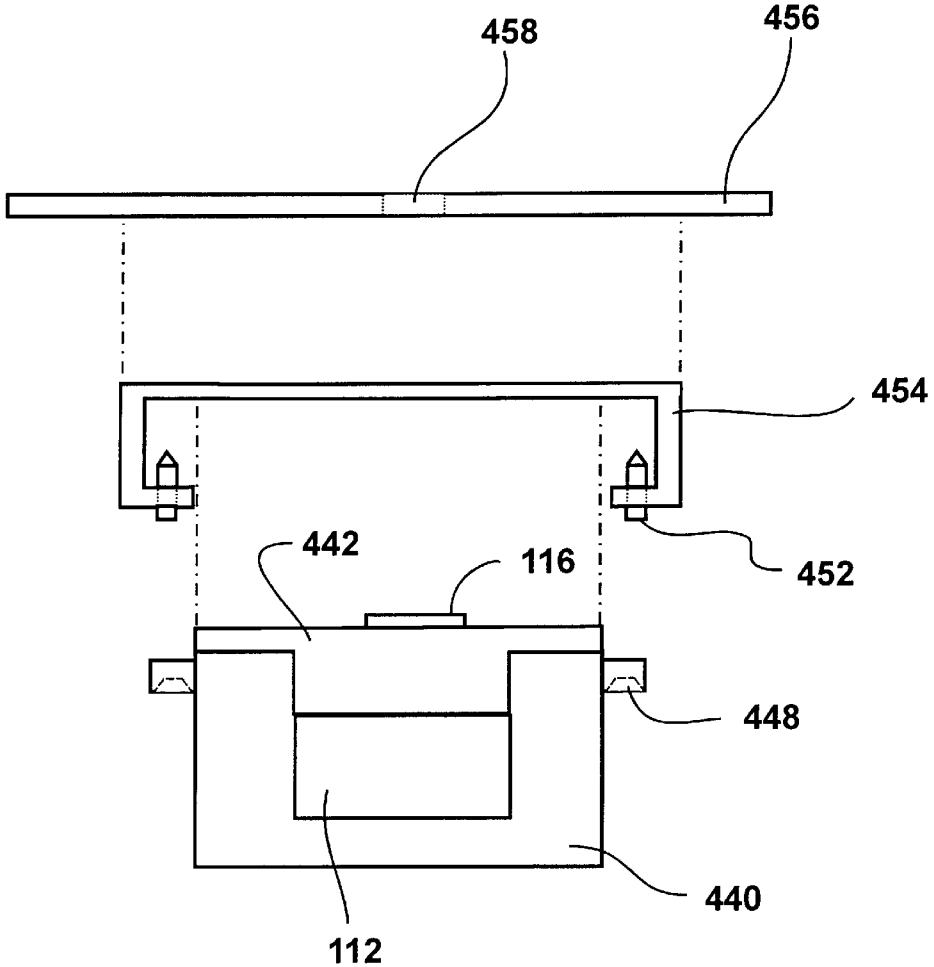
FIG. 20A is an exploded view showing the embodiment of FIG. 19 incorporated into a safe deposit door.
Figure 20B:
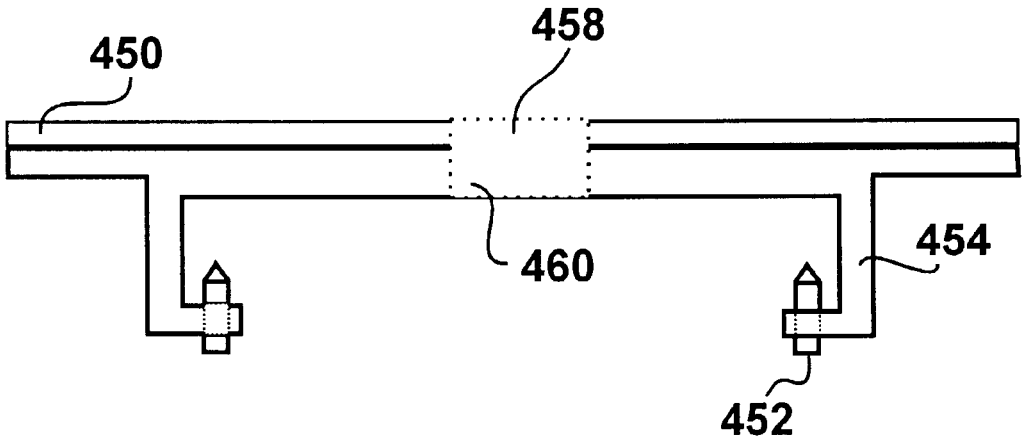
FIG. 20B is an assembled view showing a channel attached to the safe deposit door.
Figure 21:
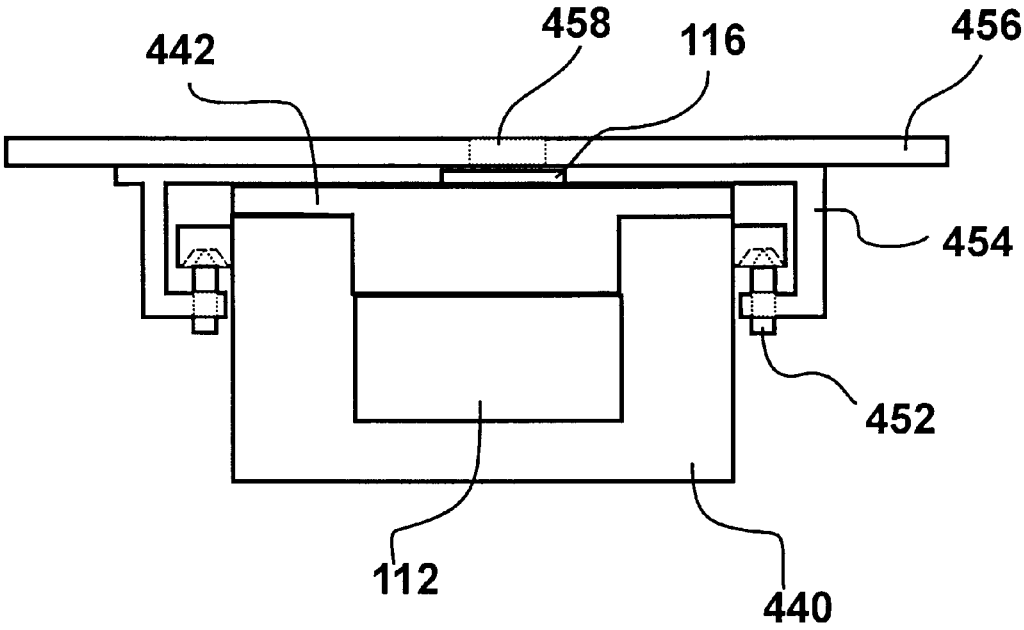
FIG. 21 is an end view of the assembly illustrated in FIG. 20.
Figure 22:
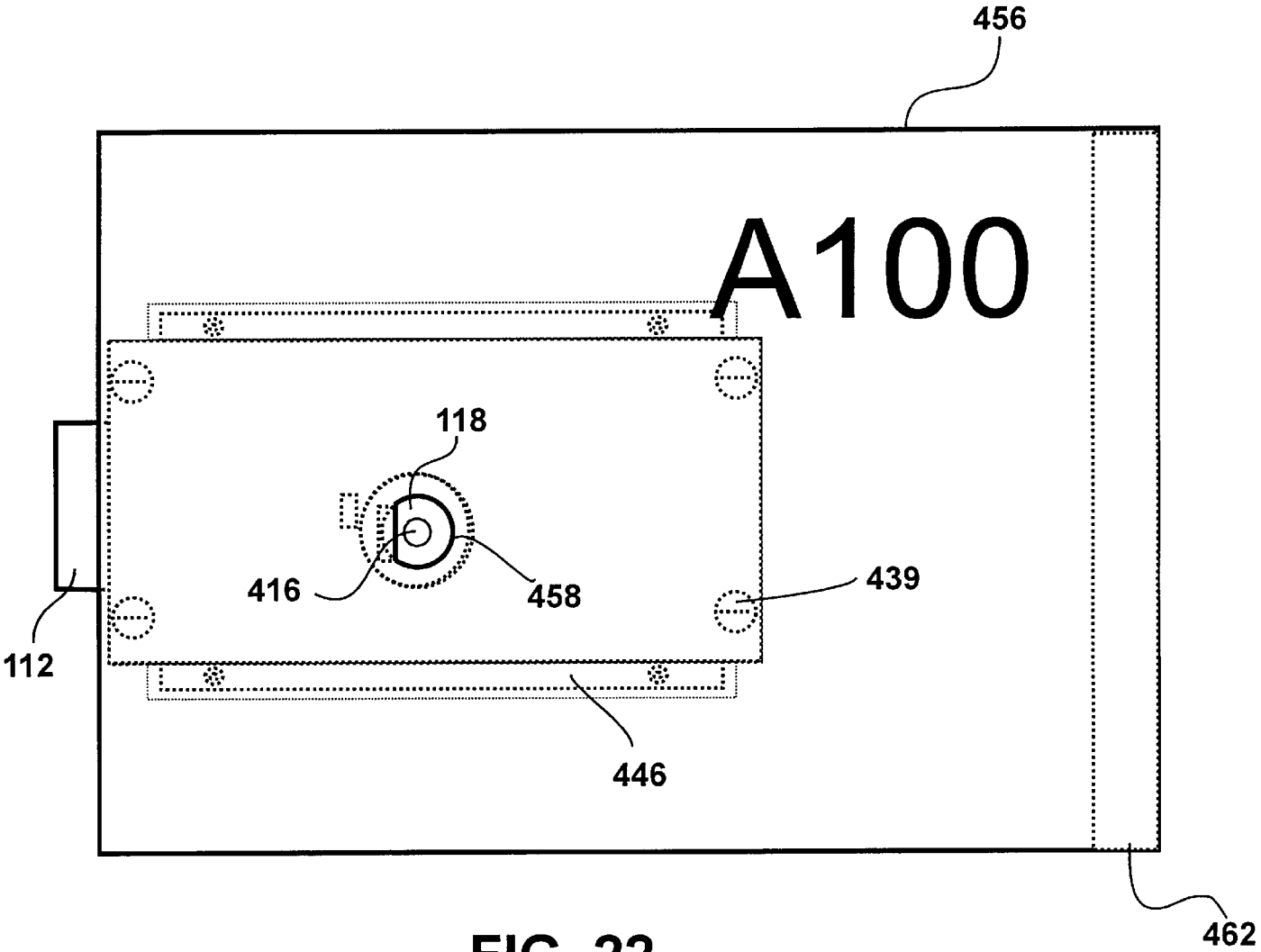
FIG. 22 is a front elevational view of the embodiment of FIG. 21.
Figure 23:
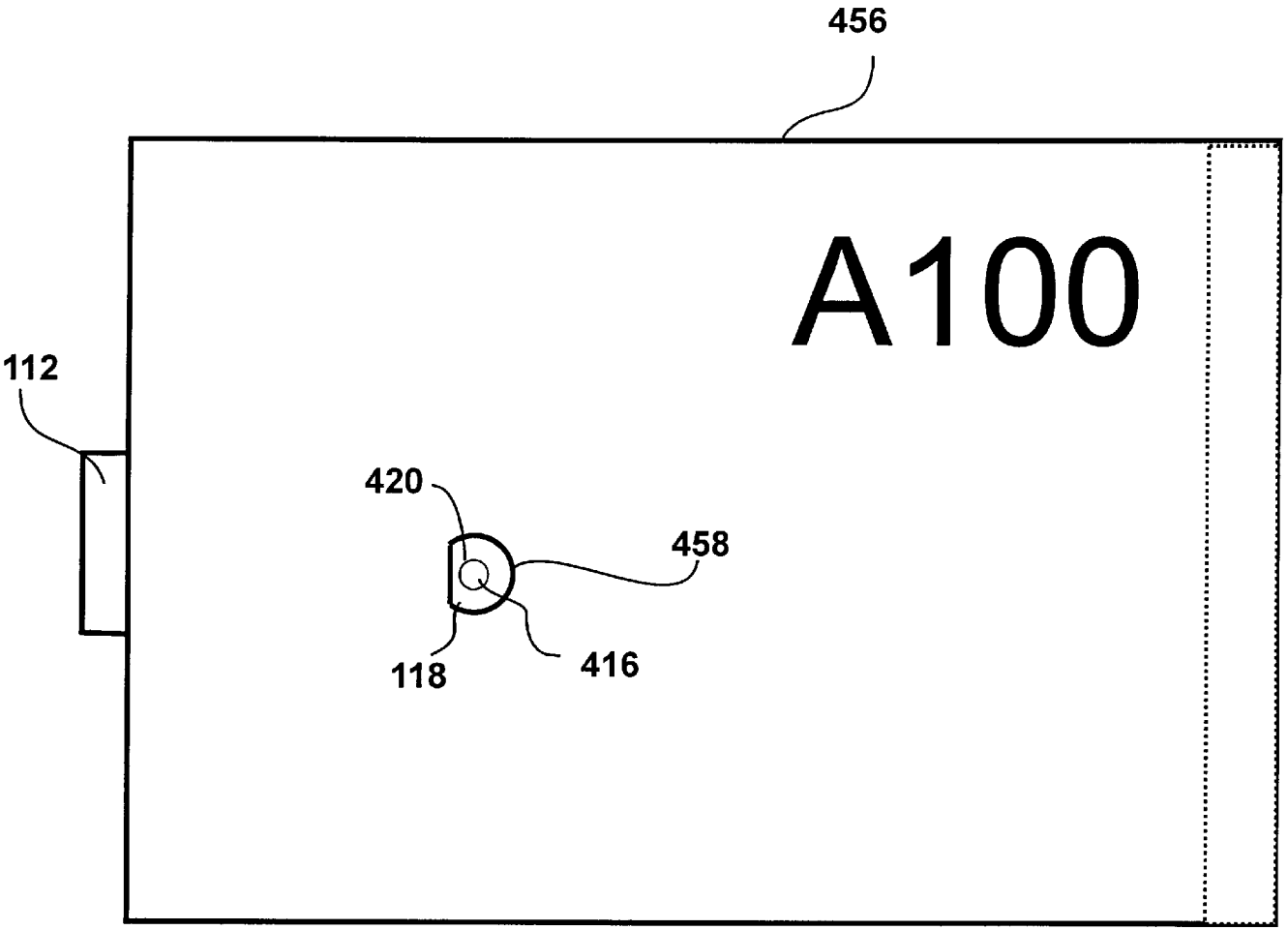
FIG. 23 is a front elevational view of a safety deposit door fitted with an embodiment of the present invention.
Figure 24:
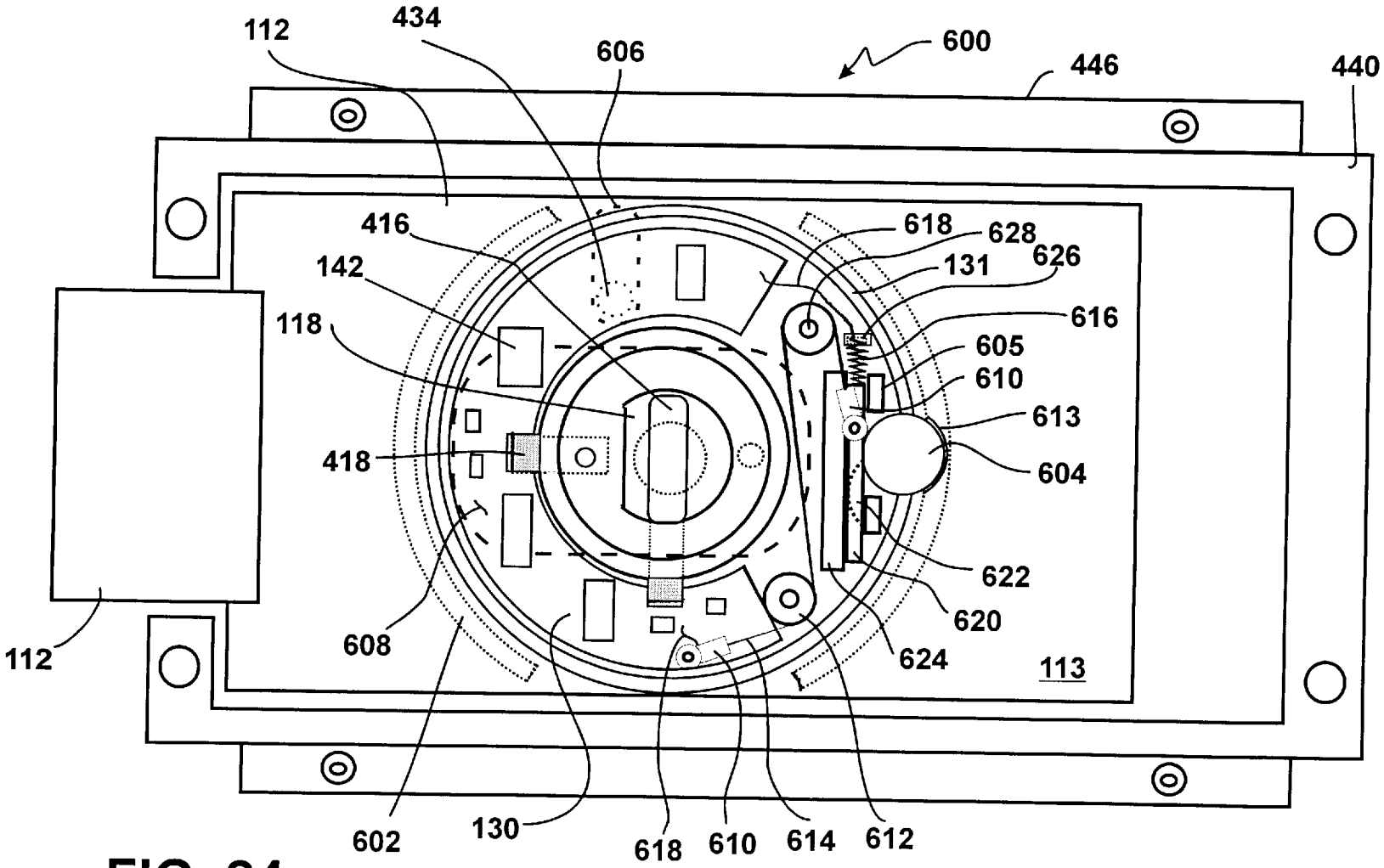
FIG. 24 is a plan view showing details of another embodiment constructed according to the principles of the present invention, while in a locked state.

Looking now to FIGS. 15, 16 and 17 in combination, insertion of an electrically conforming key into keyway 118 will, after electrical exchange of data via power and data conductor 416, enable circuit 130 mounted upon circuit board 139 to energize the coil of solenoid 400 and withdraw armature 404 against the force of return compression spring 406, thereby enabling torque manually applied by the key to cylinder plug 116 to rotate cam plate extension 123 and in turn, cam plate 126; as cam plate 126 rotates about pivot 430, drive pin 434 engages the surface of slot 606 formed in shank 113, and as the clockwise rotation of the torque applied to cam plate 126 drives drive pin 434 through a clockwise arc, drive pin 434 travels through slot 606 while forcing shank 113 to the right in FIG. 17, thereby retracting bolt 112. Subsequent counterclockwise rotation of the key to the position shown in FIG. 17, enables spring 406 to force armature 404 back into slot 413 after termination of the electrical current through the coil of solenoid 400. Cover 442 may be attached to housing 440 by threaded fasteners 439.

Considering FIGS. 15 through 23 collectively, the assembled housing 440 with cover 442 and protruding flanges 446 exposed on opposite sides of housing 440, may be received within channel 454 to enable set screws 452, or other detents, to be inserted within set screw detents 448. Once channel 454 is securely attached to the thin safety deposit door 456 with D-shaped key hole 458 aligned substantially coaxially with plug clearance hole 460 as shown in the assembled view of FIG. 20B, cylinder plug 116 will be substantially coaxially aligned with plug clearance hole 460 and D-shaped key hole 458 of channel 454 and door 456, respectively. As shown in the elevation view of FIG. 22, this enables bolt 112 to protrude substantially beyond the left side of the door while in the locked position. Consequently, the entire lock assembly 140 as well as the pins 462 for door 456, are concealed, with only board mounted data and power electrical contact 416 visible through keyway 118, as is more apparent from FIG. 23.

Turning now to FIGS. 24 through 27, an alternative embodiment constructed with a pair of electrically conductive attachments 610, one of which is mounted upon circuit board 139 and one of which is mounted upon unlocking detent 622, terminate opposite ends of the length of relatively thin wire made of a paramagnetic alloy of a shape-memory alloy such as a NiTiNol wire 614. The locking device 600 is constructed with a cover 442 having a pair of spaced-apart, oppositely facing arcuate guide walls 602 partially surrounding circumferential wall 131 of cam plate 126. A groove 613 formed into one of the guide walls 602 conforms to the shape of spherical ball 604 over an arcuate length of less than one half of the circumference of ball 604. Ball 604 is positioned principally upon cam plate 126 and spaced equally distantly between a pair of rectangular guides 605, to extend through a gap in circumferential wall 131. An unlocking detent 622 is held in position by an electrically conductive compression spring 616, between guides 605 on one side, and guide wall 624 on its other side. Plate 620 also contains a circular concave groove 622 circumferentially conforming to the exterior of ball 604 with a greatest depth of less than one half the diameter of ball 604. A proximal end of locking plate 622 is attached to conductive attachment 610.

Figure 25:
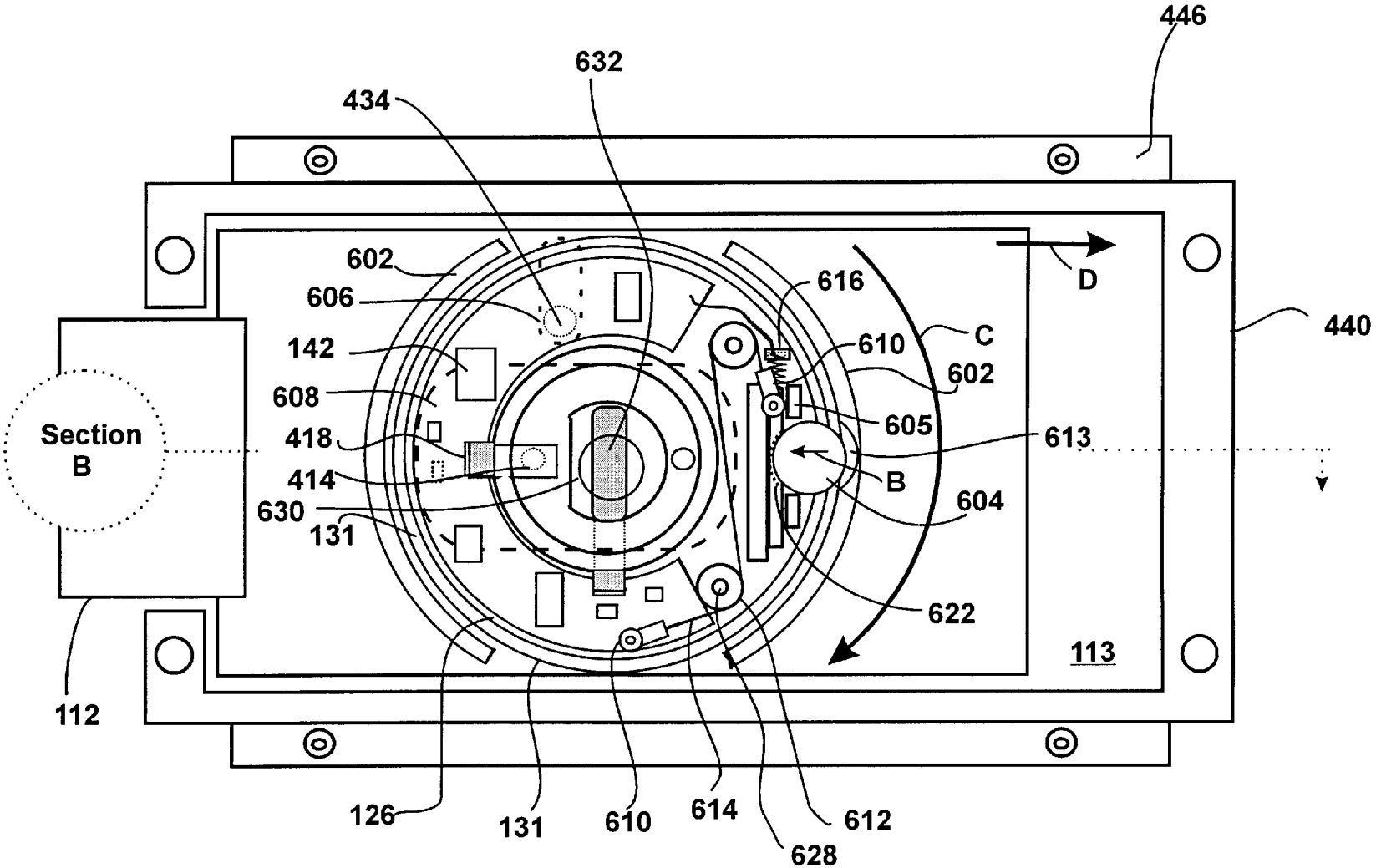
FIG. 25 is a plan view of the embodiment shown in FIG. 24, while in an unlocked state with the bolt still extended.
Figure 26:
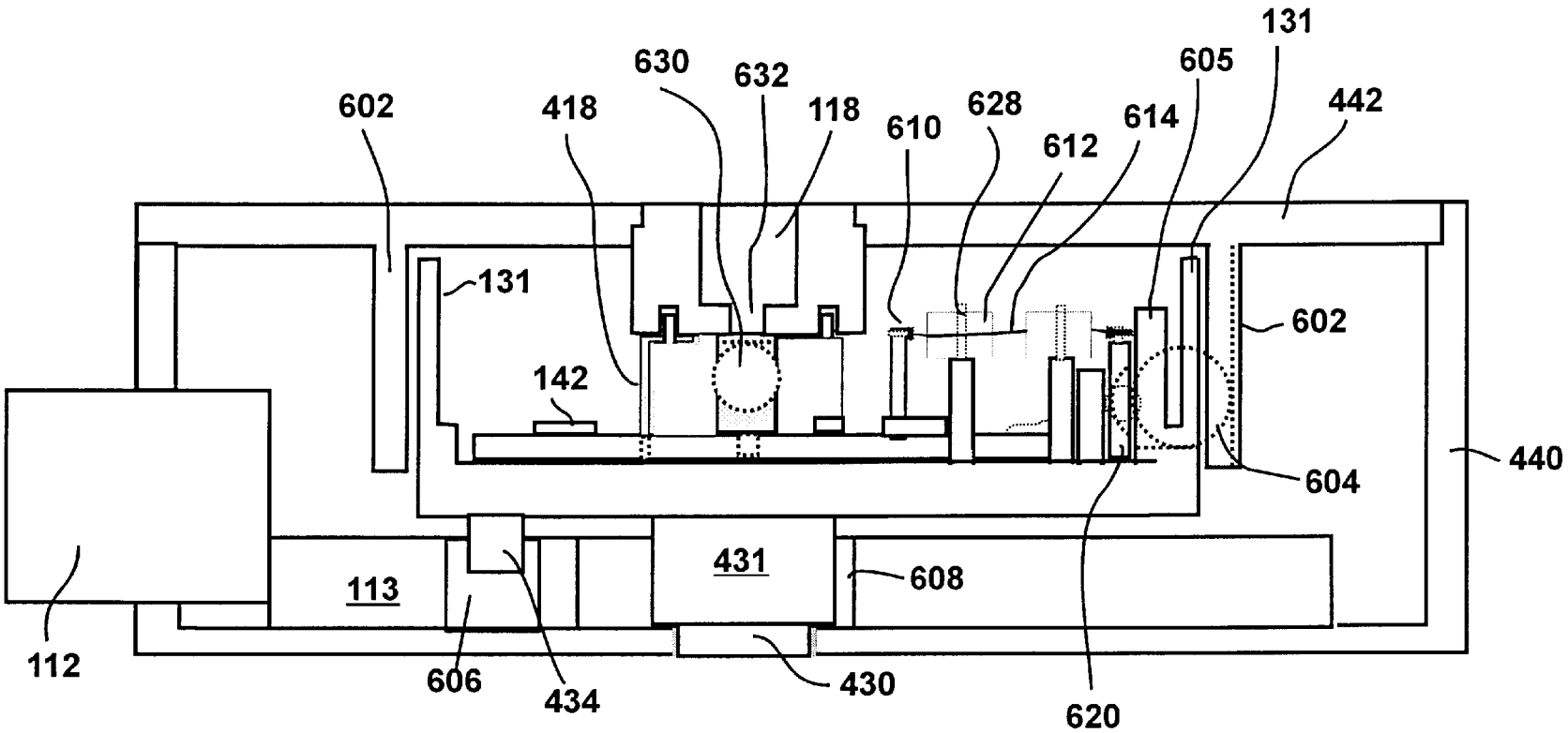
FIG. 26 is a side, cross-sectional view showing the embodiment of FIG. 24 in transition between locked and unlocked states.

In operation, a manual key electronically conforming to circuit 130 after insertion into keyway 118 and making electrical contact with conductives 416, 418, enables circuit 130 to apply electrical current between attachment 610; the electrical current causes the NiTiNol alloy wire 614 to contract, thereby drawing locking plate 622 upwardly against the force of compression spring 616, as shown in FIG. 25, thereby enabling the manual torque applied by the key to cam plate 126 to force ball 604 to roll out of groove 613 and to roll into groove 622 in a direction shown by arrow B as cam plate turns clockwise in a direction indicated by arrow C. The clockwise movement of cam plate 126 causes drive pin 434 to travel along slot 606, thereby forcing shank 113 to the right in a direction of arrow D as shown in FIG. 25, thus retracting bolt 112 substantially into the interior of housing 440. Cam rotation and withdrawal of the key from keyway 118 terminates access, by causing interruption of electrical current through NiTiNol alloy wire 614. Alternatively, (FIGS. 11A, 11B) software stored in ROM 534 may instruct microprocessor 530 after a certain number of pulses from counter 538 to change switch 544 to its rest state, causing interruption of power through N-iTiNol alloy wire 614. This enables spring 616 to force locking plate 620 downwardly to discharge ball 604 alternately into groove 613 of guide wall 602. Simultaneously, the cam clockwise rotation opposite to the direction shown by arrow C in FIG. 25, forces drive pin 434 against the wall of slots 606, thereby causing shank 113 to travel in the opposite direction shown by arrow D, thus ejecting bolt 112 and locking the door to which the assembly has been attached.

Figure 27A:
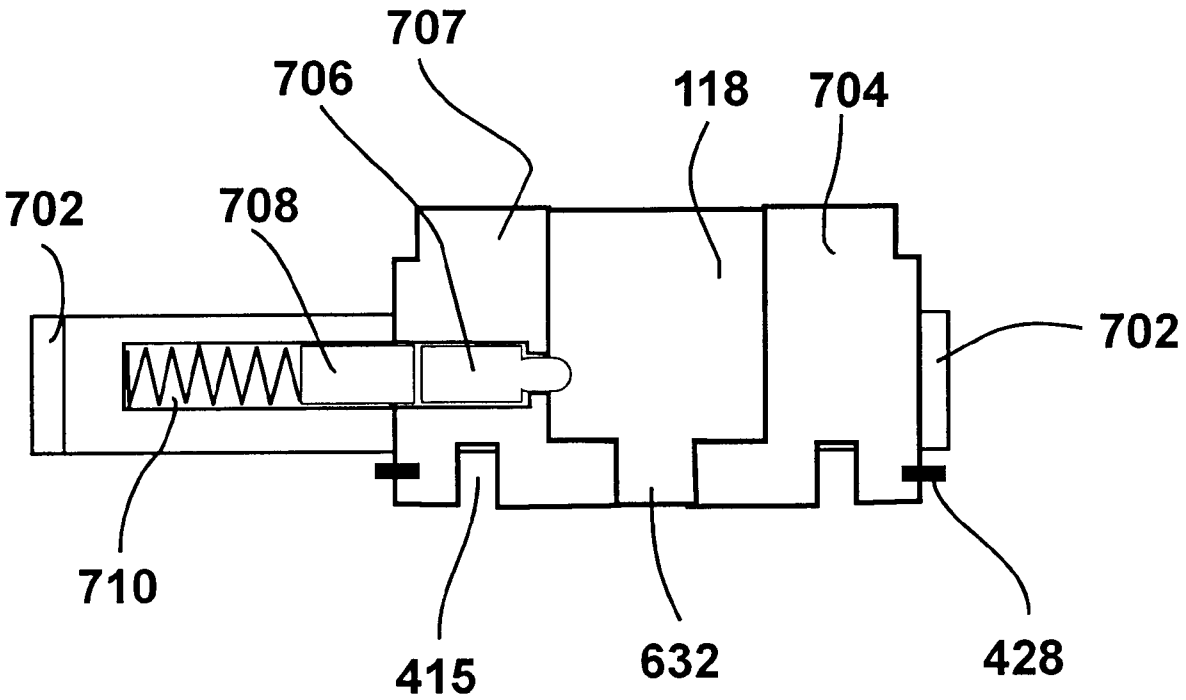
FIG. 27A is a cross-sectional view of a unbitted lock cylinder that may be incorporated into the embodiment of FIG. 24.
Figure 27B:
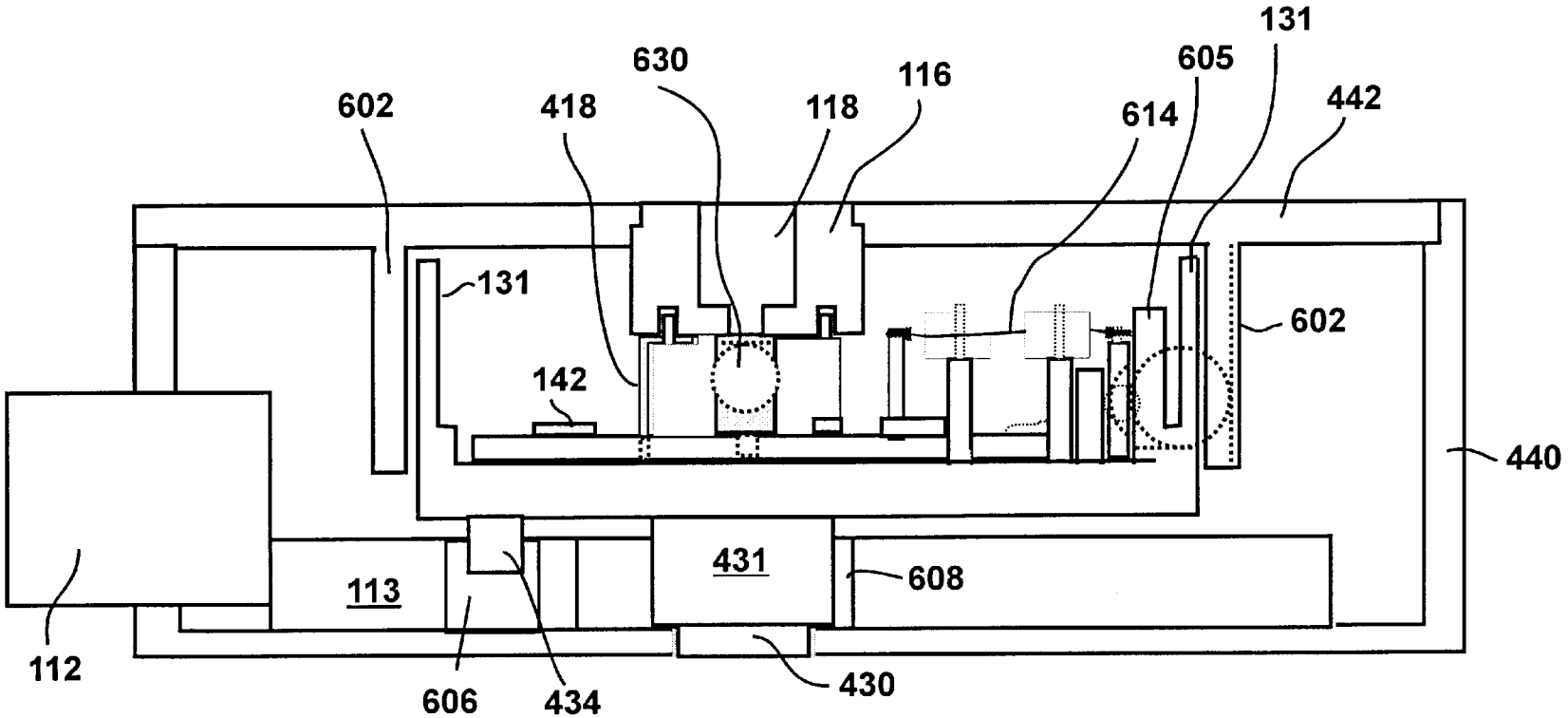
FIG. 27B is a cross-sectional view of a bitted lock cylinder that may be incorporated into the embodiment of FIG. 24.
Figure 28:
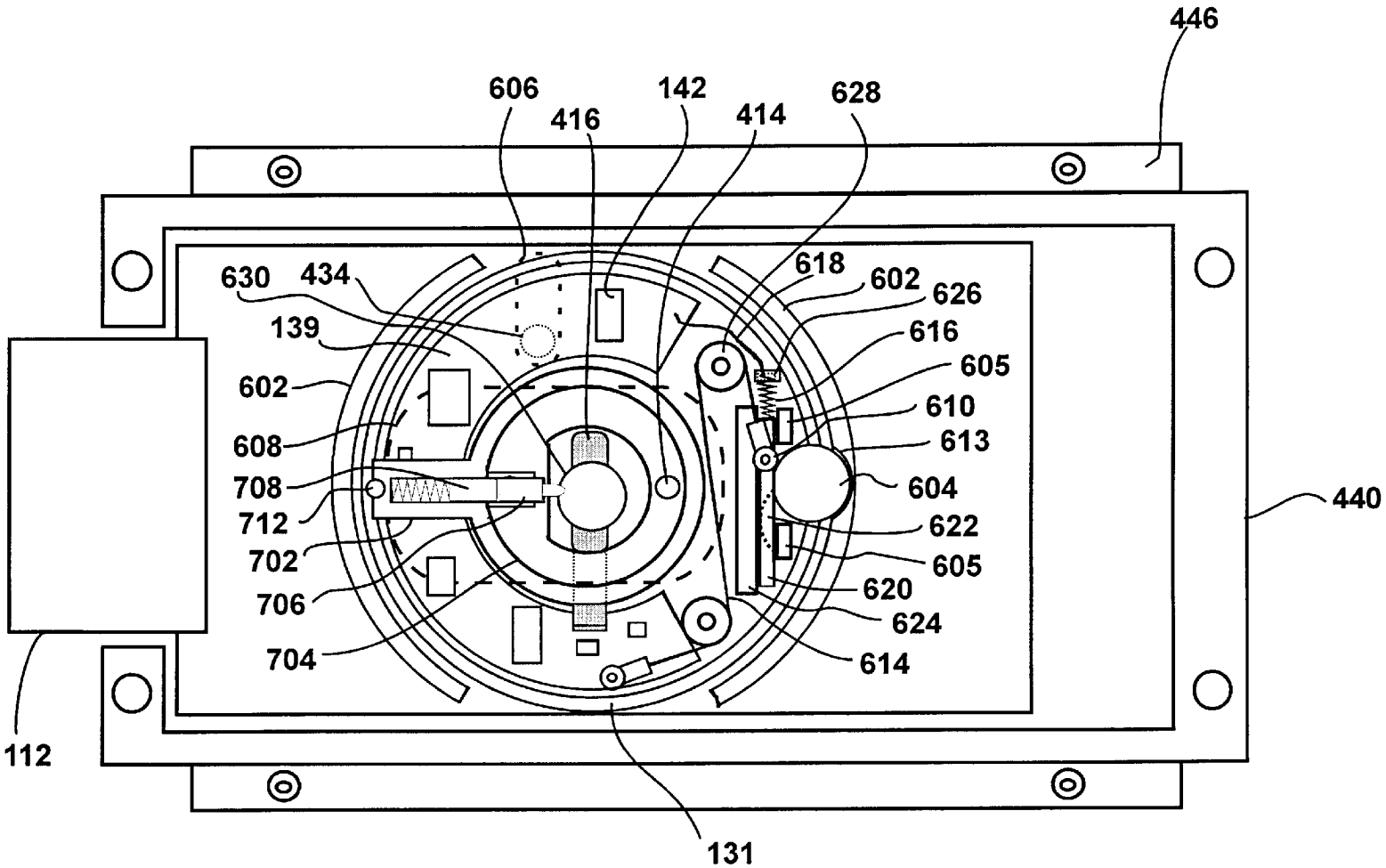
FIG. 28 is a plan view illustrating incorporation of a bitted lock cylinder incorporated into an embodiment constructed according to the principles of the present invention.

FIG. 27B shows a bitted cylinder 700 fitted with a cylinder plug 704 which may be incorporated into the embodiment represented by FIGS. 24 through 27A. In this embodiment, the key (not shown) can be configured with a plurality of teeth cut to conform to the shear lines 707 formed by the relative length of bottom pins 706 and top pins 708 within cylindrical shell 702. As shown in FIG. 27B, compression spring 710 holds bottom pins 706 and top pins 708 inwardly to prevent rotation of cylinder 704 relative to shell 702. A Truarc ring 428 holds cylinder 700 within cover 442. With this alternative embodiment, the key must both mechanically conform to the shear line established by pins 706 and 708 and electronically conform to the digital signature required by circuit 130 before access can be obtained. As shown in FIG. 28, a fixed pin 712 holds the extreme wall of shell 712 fixed into position relative to circumferential wall 13 1.

Figure 29:
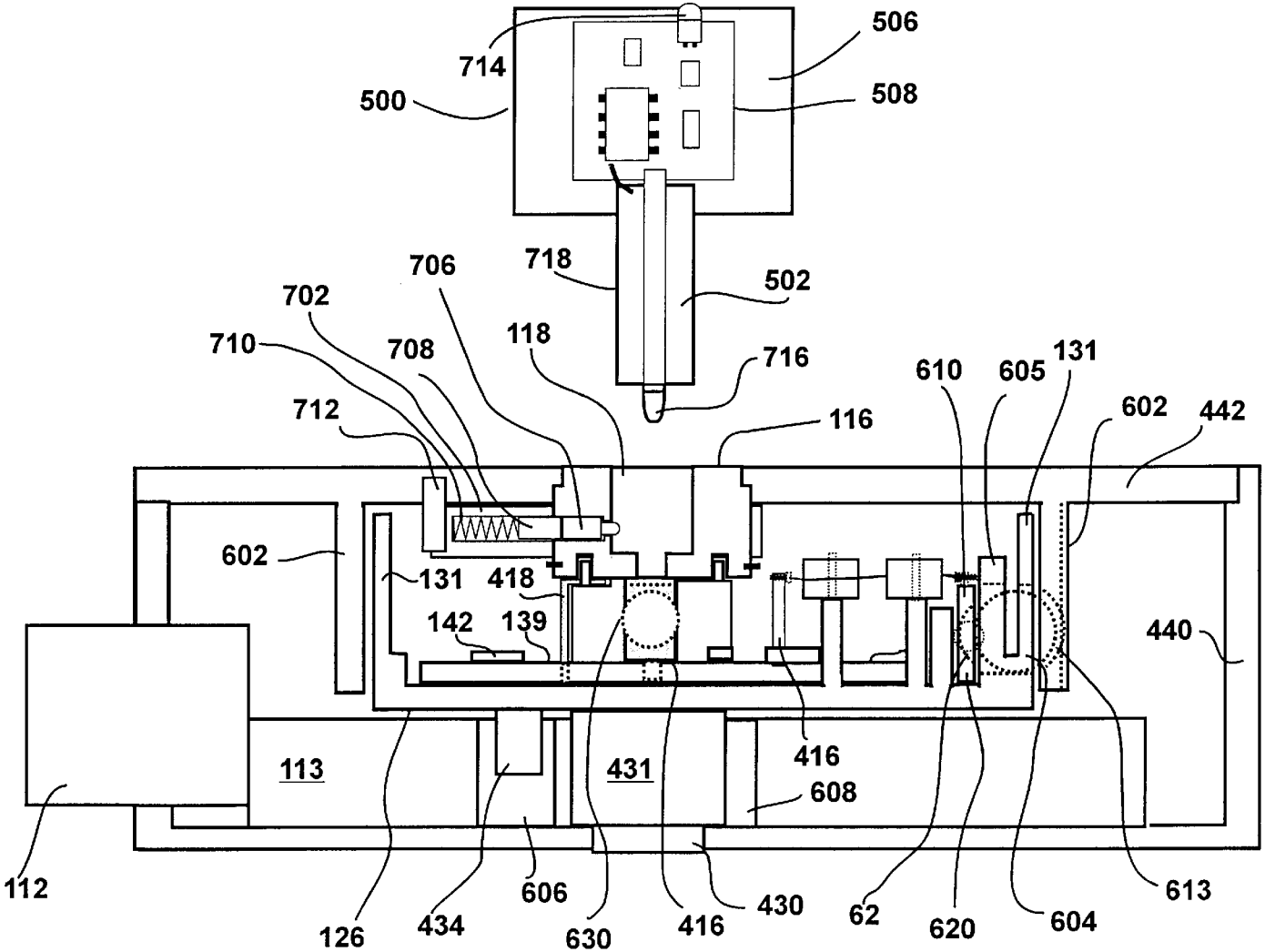
FIG. 29 is a cross-sectional view of the embodiment illustrated in FIG. 28 showing a key prior to insertion.
Figure 30:
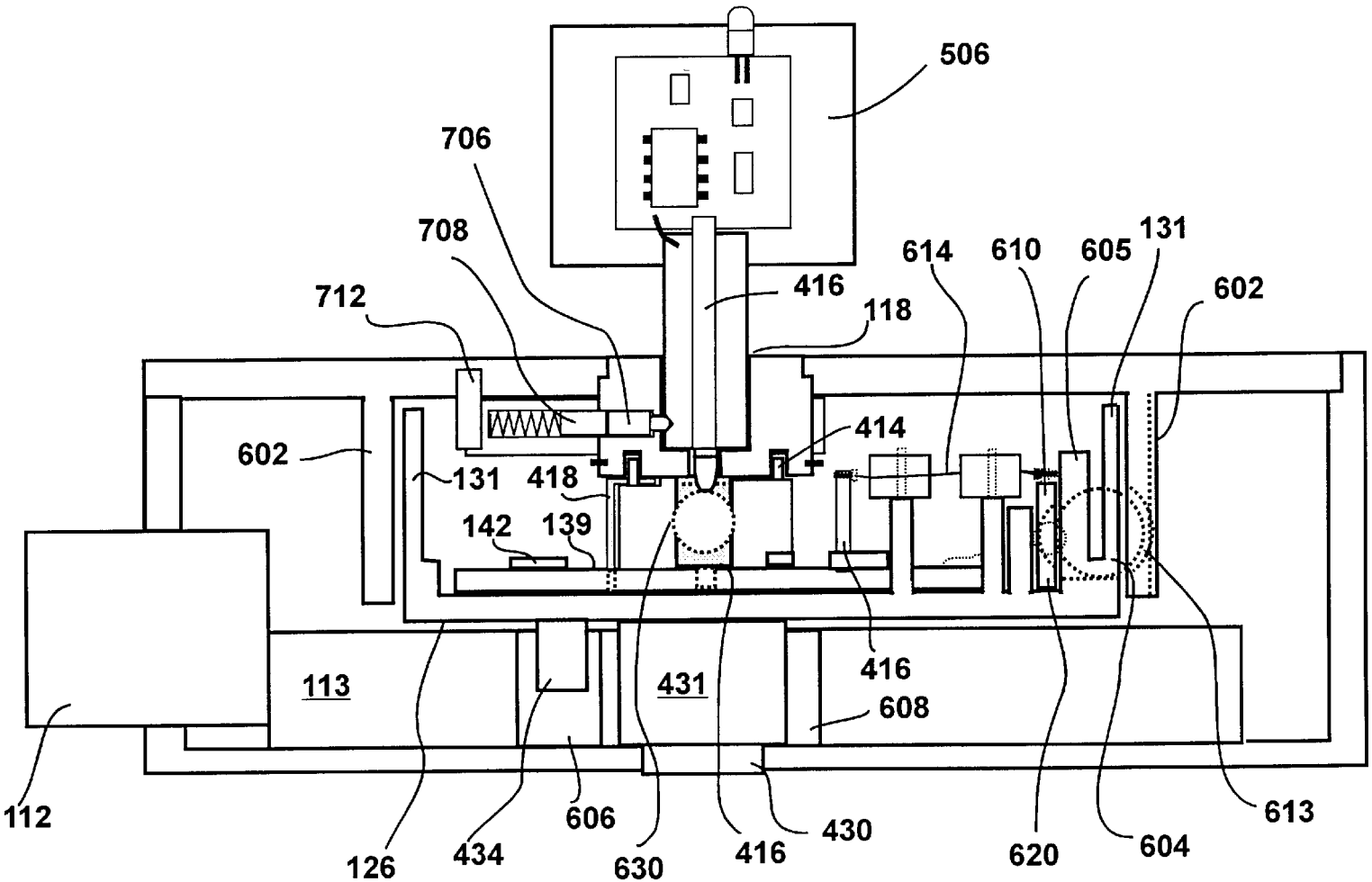
FIG. 30 is a cross-sectional view showing operational aspects of the embodiment illustrated in FIG. 28 with a mechanically conforming key inserted into its keyway.

Turning collectively to FIGS. 24 through 36, a sphere 630 of an electrically conductive material (preferably, with a polished exterior surface such as a chrome plated ball bearing, may be inserted into spacer 123 within a spherically conforming recess, under electrical contact 416 between the open portion of keyway 118, namely 632, and circuit board 139. Sphere 630 has unrestrained multiple degrees of freedom of rotation. Consequently, sphere 630 blocks direct access to circuit board 139 and, among other advantages, deters efforts to defeat locking device 600 by drilling for example with a rotating bit inserted into keyway 118. Accordingly, and as may be seen in FIGS. 29 and 30, electrically insulated central electrical contact 716 of key 500 makes electrical contact with contact 416 directly, and sphere 630 is interposed between contact 416 and an extension of keyway 118 through spacer 123, to protect circuit board 139 from damage caused by improper access such as drilling through keyway 118.

Turning again to FIGS. 29 and 30, when bitted key 500 is coaxially inserted into keyway 118 of a bitted cylinder plug 116, the bitting of key 500 radially displaces top and bottom pins within shell 702, and if there is a mechanical conformance between the bitting of the teeth and the shear line between the top and bottom pins, electronic conformance between circuit 508 of the key and circuit 130 formed on circuit board 139 will enable the battery 437 held by the head 506 of key 500 to apply electrical power via spring pin key data contact 716 and contact wiper 416 to paramagnetic alloy wire 416 extending between connectors 610, thereby contracting wire 416 and drawing locking plate 620 upwardly to receive a less than hemispheric exterior surface of ball 604, thereby allowing cam plate 126 to rotate under the torque applied by the key 500 relative to guide wall 602. Formation of groove 61, 620 with depths of less than one radius of bearing 604, in preferably less than one half of the radius of bearing 604, enables the torque applied manually to key 500 to force bearing 604 out of the corresponding groove 613 or unlocking detent 622 once plate 620 has been positioned by either spring 616 or paramagnetic wire 614.

Figure 31:
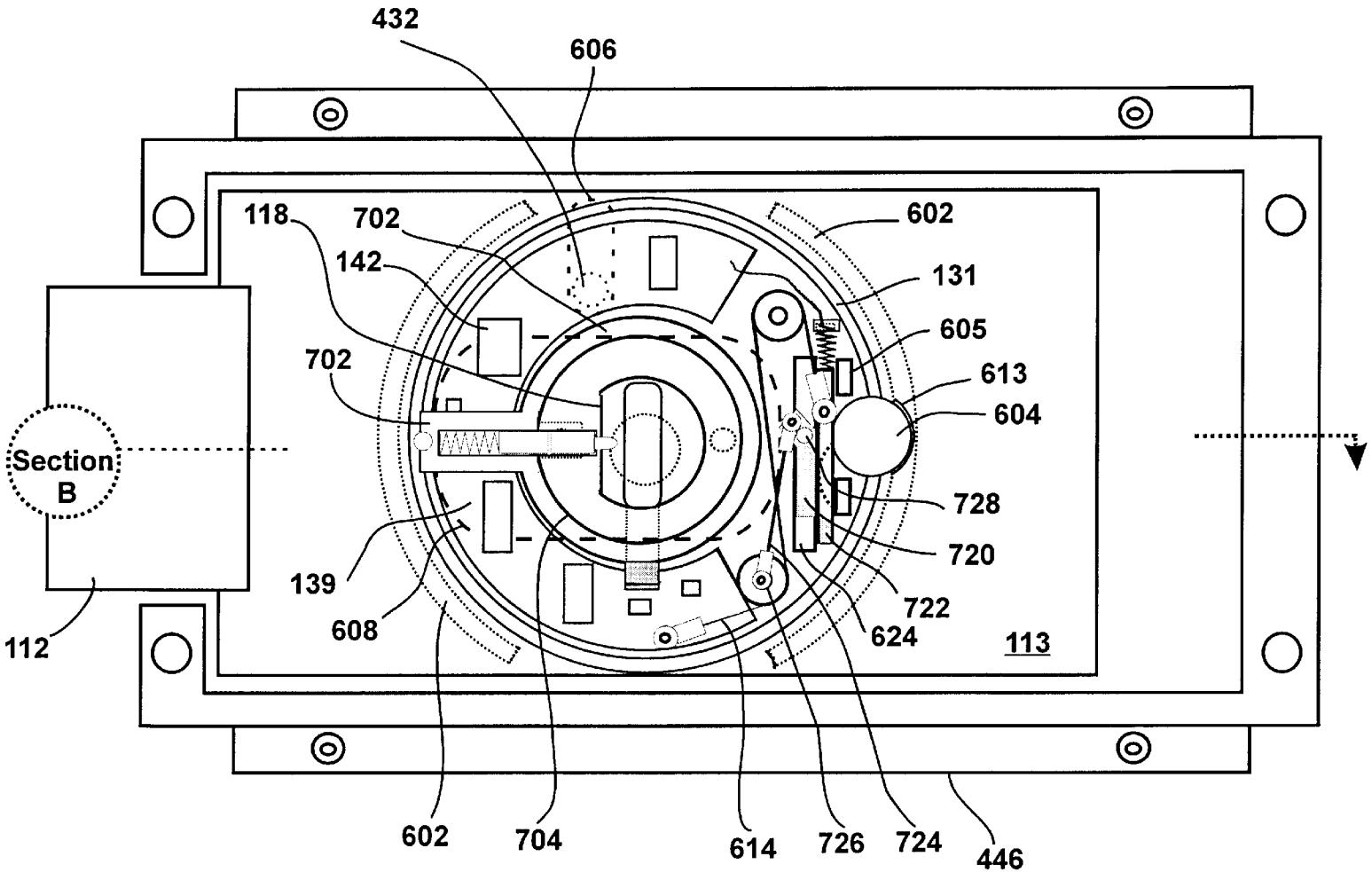
FIG. 31 is a plan view showing another embodiment constructed according to the principles of the present invention with a heat sensitive paramagnetic re-locking mechanism shown in an unrelocked state.
Figure 32:
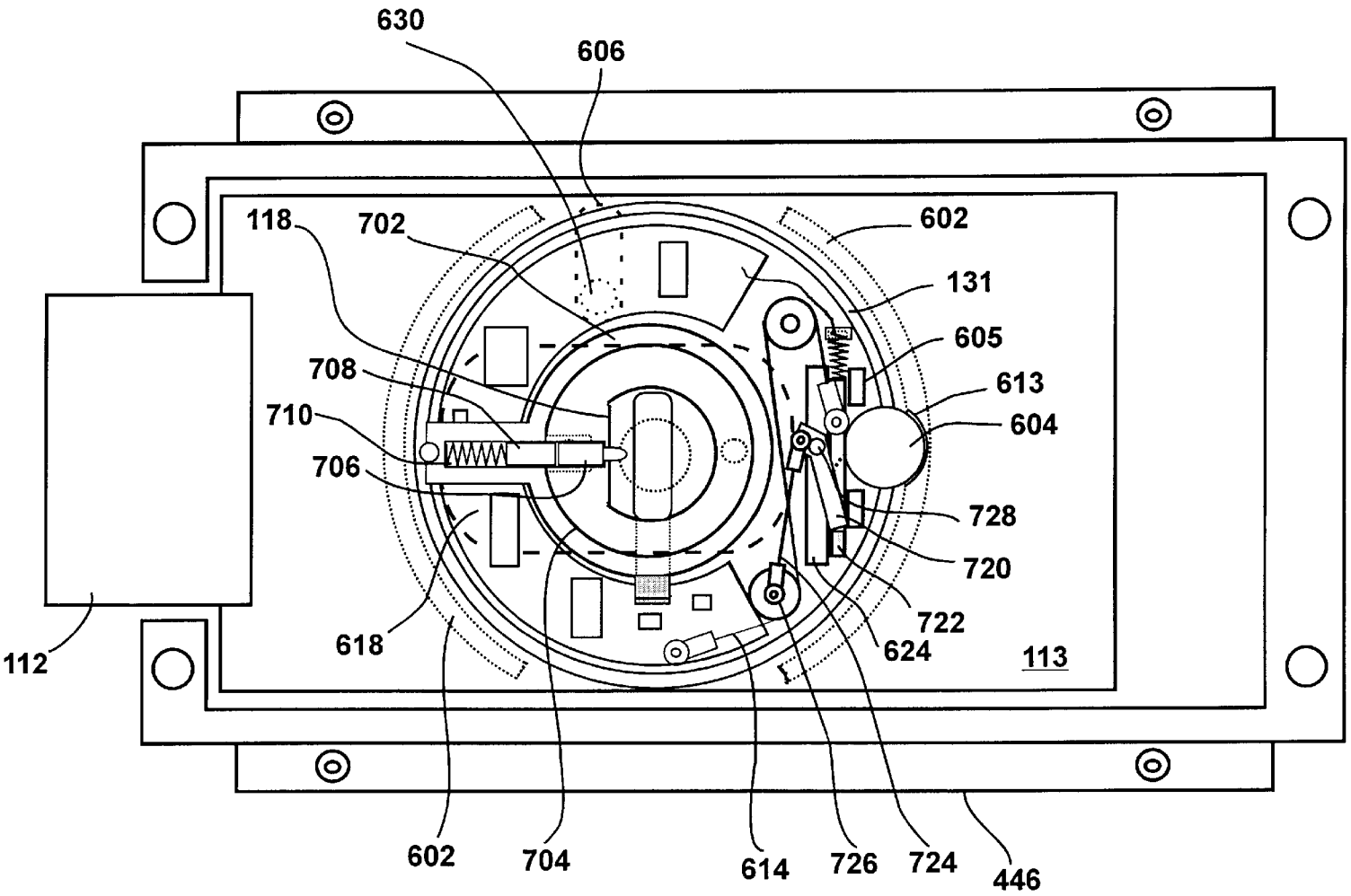
FIG. 32 is a plan view showing another embodiment constructed according to the principles of the present invention with a heat sensitive paramagnetic re-locking mechanism shown in a re-locked state.
Figure 33:
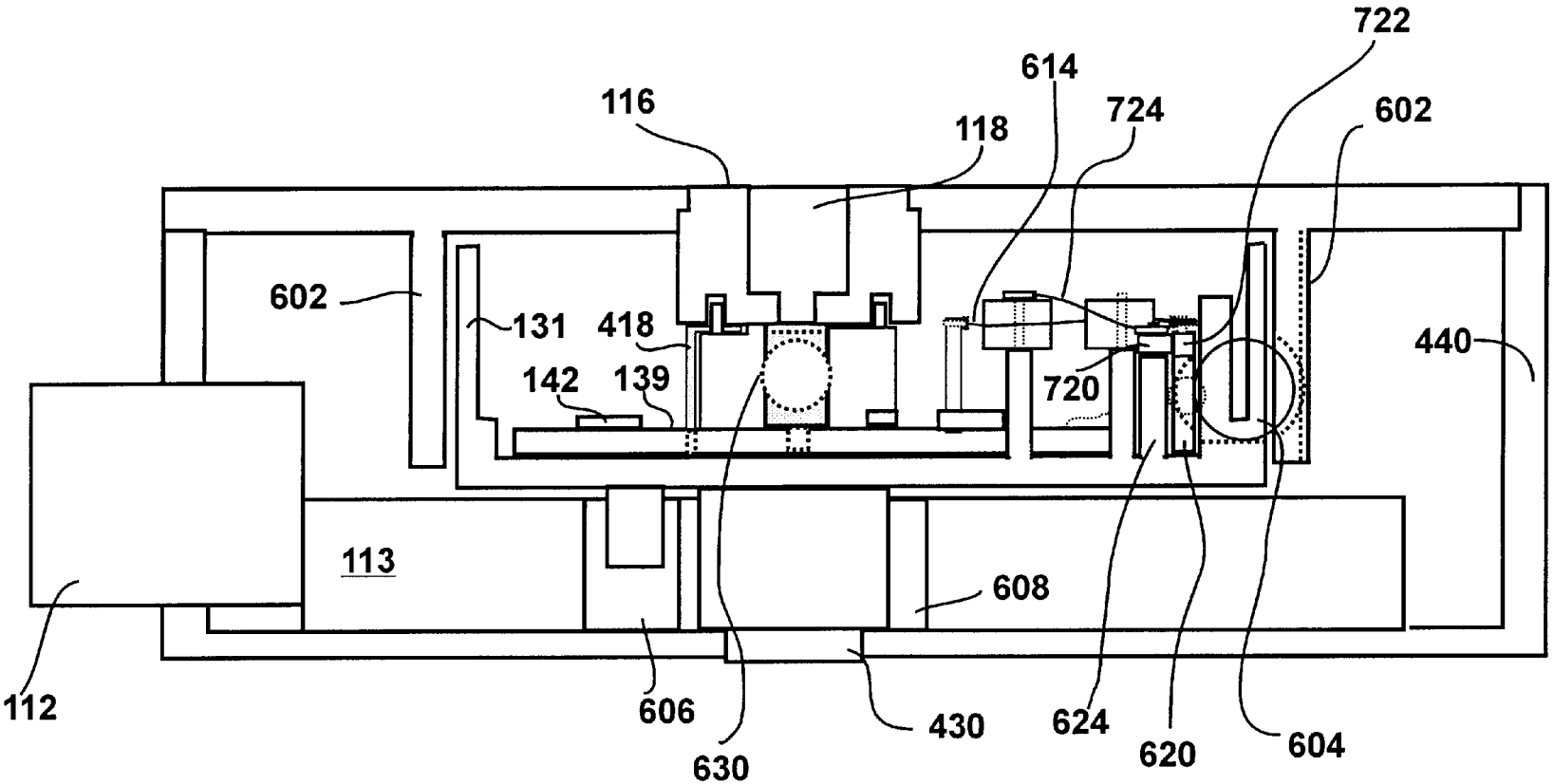
FIG. 33 is a side cross-sectional view of the embodiment illustrated by FIG. 32 while in an unrelocked states.

Turning now to FIGS. 31 through 33, not infrequently heat is applied to the keyway 118 in an improper effort to influence the behavior of the locking mechanism through thermal expansion caused by application of the heat. Paramagnetic alloys are especially responsive to heat. Therefore, in the embodiment illustrated a re-locking lever 720 is superimposed alongside locking plate 620, with a pivot 728 rotatably attaching lever 720 to the upper surface of guide wall 624. Re-lock lever 720 has a bell crank shape with one arm attached to a second paramagnetic alloy wire 724 extending between fasteners 726, 727. Application of heat to the cam assembly via keyway 118 will cause wire 724 to contract, thereby pulling the proximal end of lever 720 downwardly as shown in FIG. 32, thus forcing the distal end of lever 720 to engage slot 722 formed within locking plate 620. This prevents plate 620 from moving in response to contraction of wire 614 due to either application of an electrical current or heat. Consequently, improper efforts to open the locking mechanism via application of heat through keyway 118 are thwarted because locking plate 620 remains under the influence of spring 616, thereby preventing bearings 604 from leaving slot 613 within guide wall 602.

Figure 34:
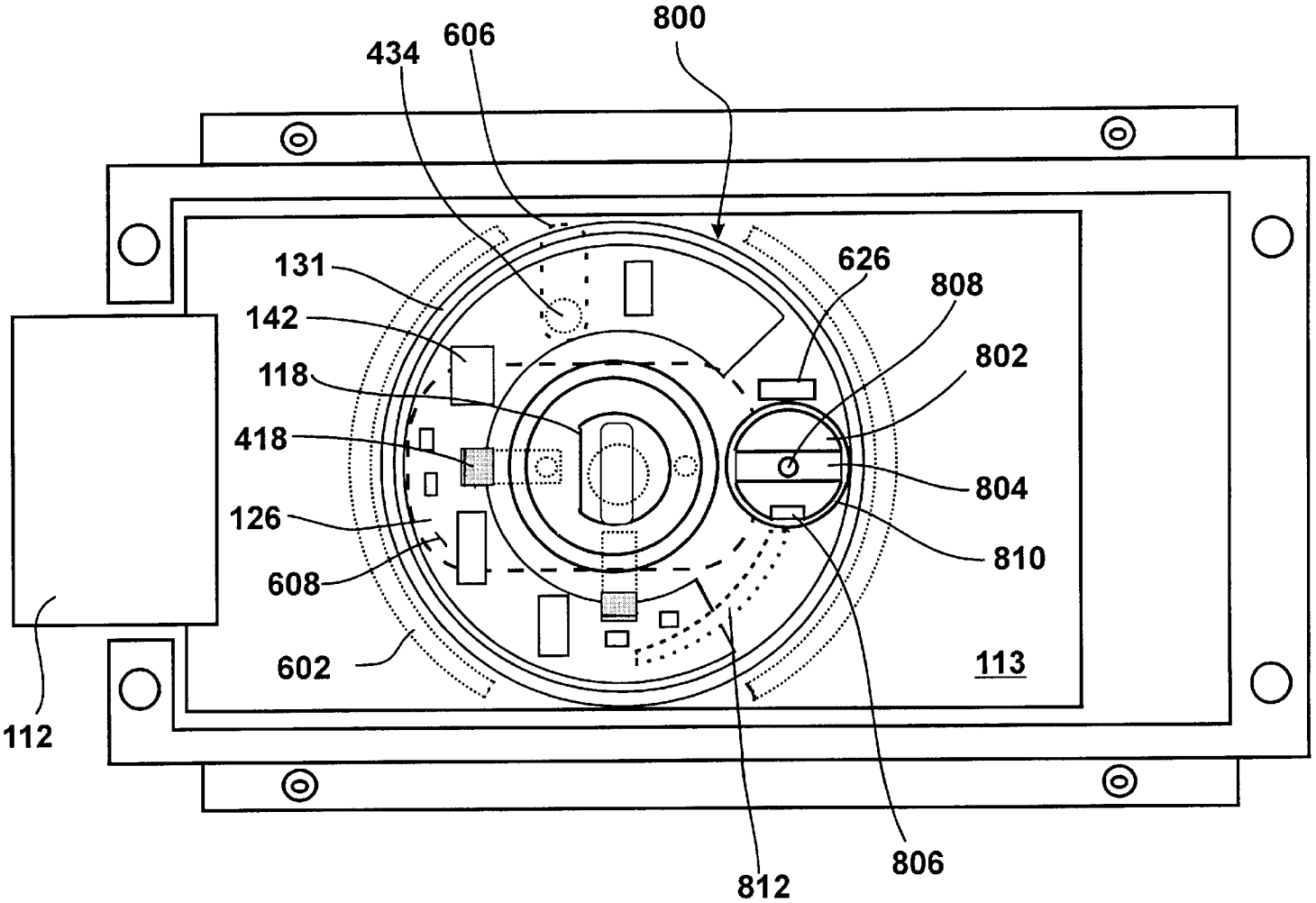
FIG. 34 is a plan view showing details of still another embodiment constructed according to the principles of the present invention using a rotary solenoid.
Figure 35A:
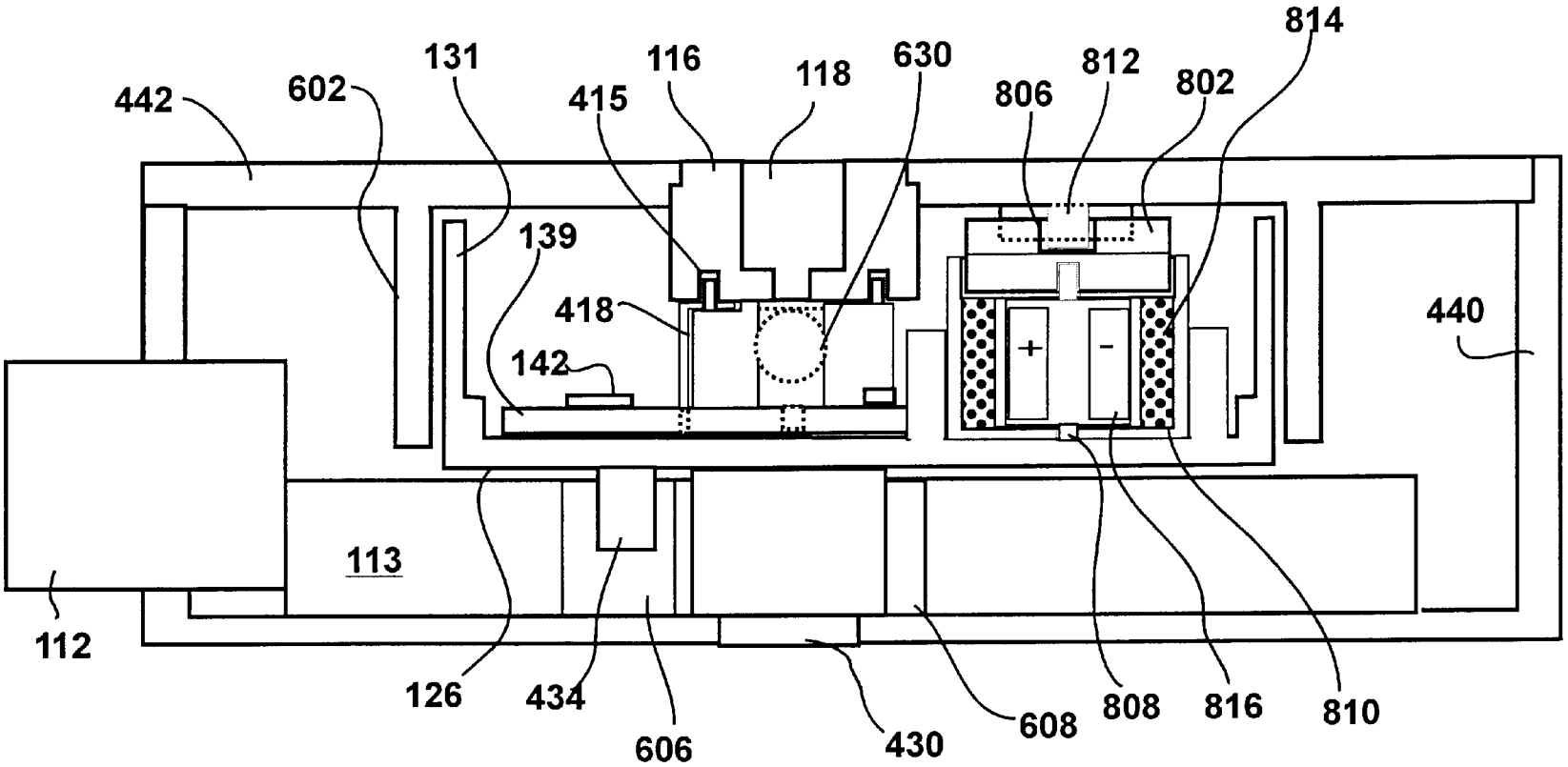
FIG. 35A is a cross-sectional view of the embodiment illustrated in FIG. 34.
Figure 35B:
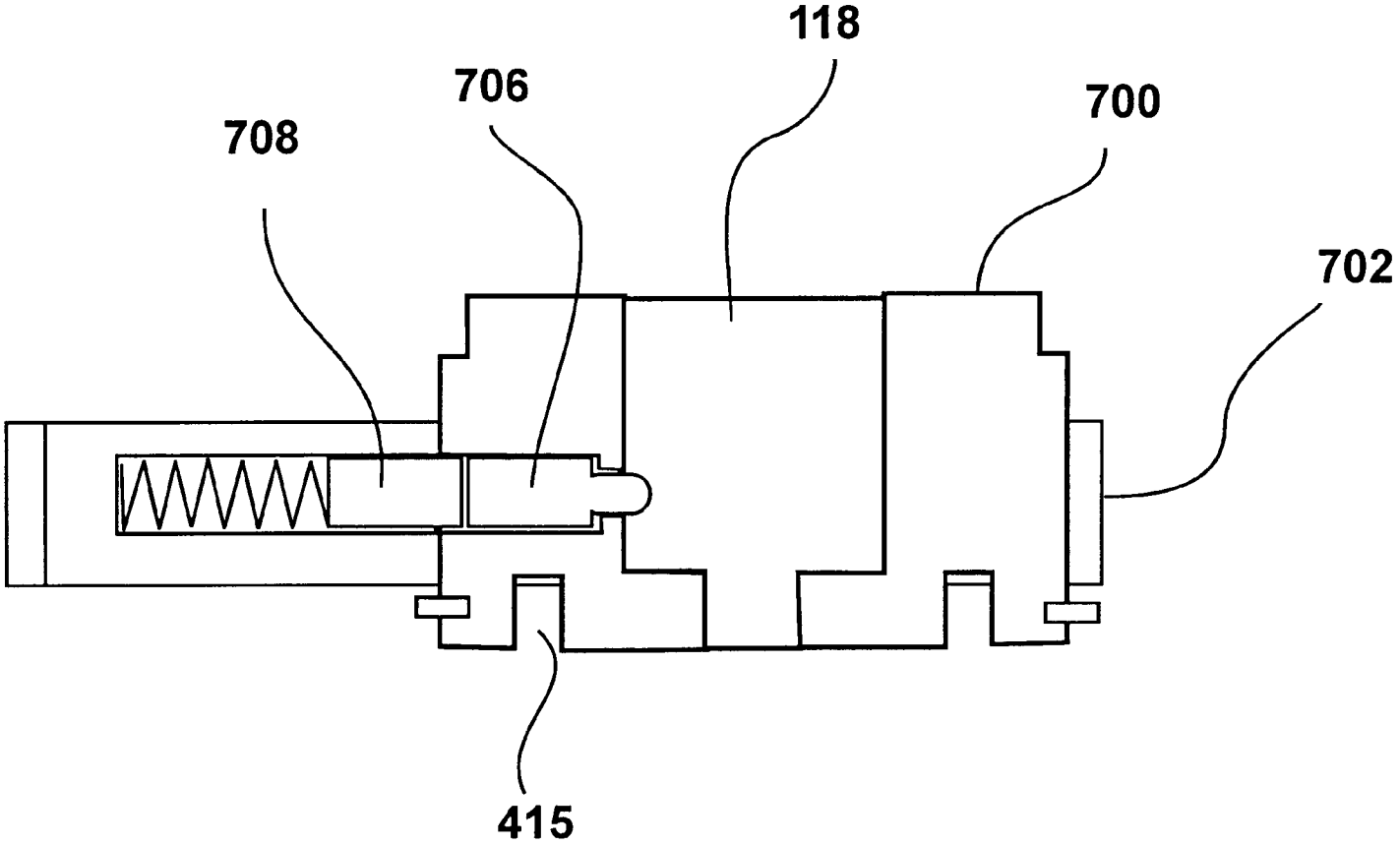
FIG. 35B is a detailed cross-sectional view of a bitted lock cylinder that may be incorporated into the embodiment illustrated by FIG. 34.
Figure 36:
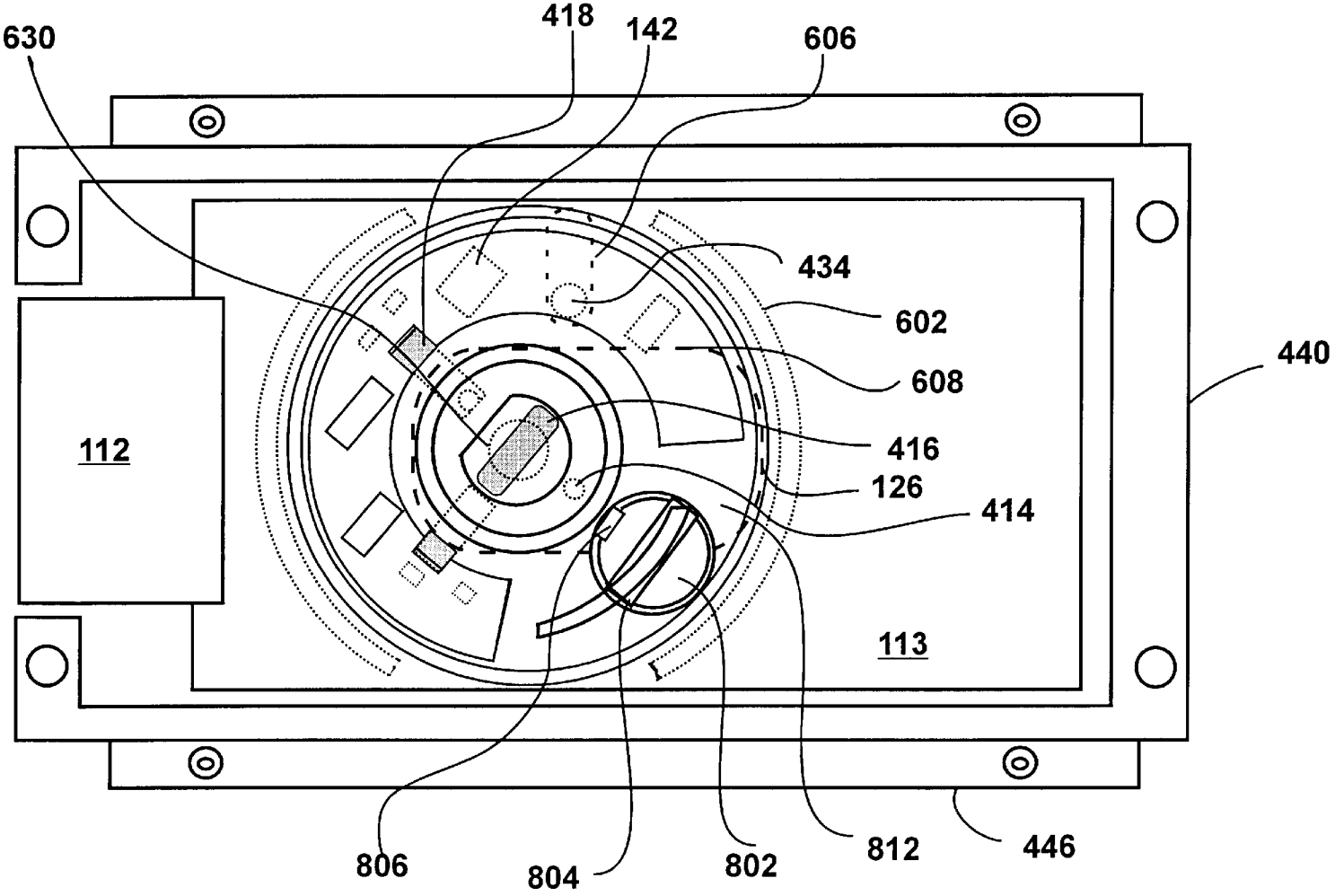
FIG. 36 is a plan view showing the embodiment of FIG. 34 while in an unlocked state with the bolt shown retracted.
Figure 37:
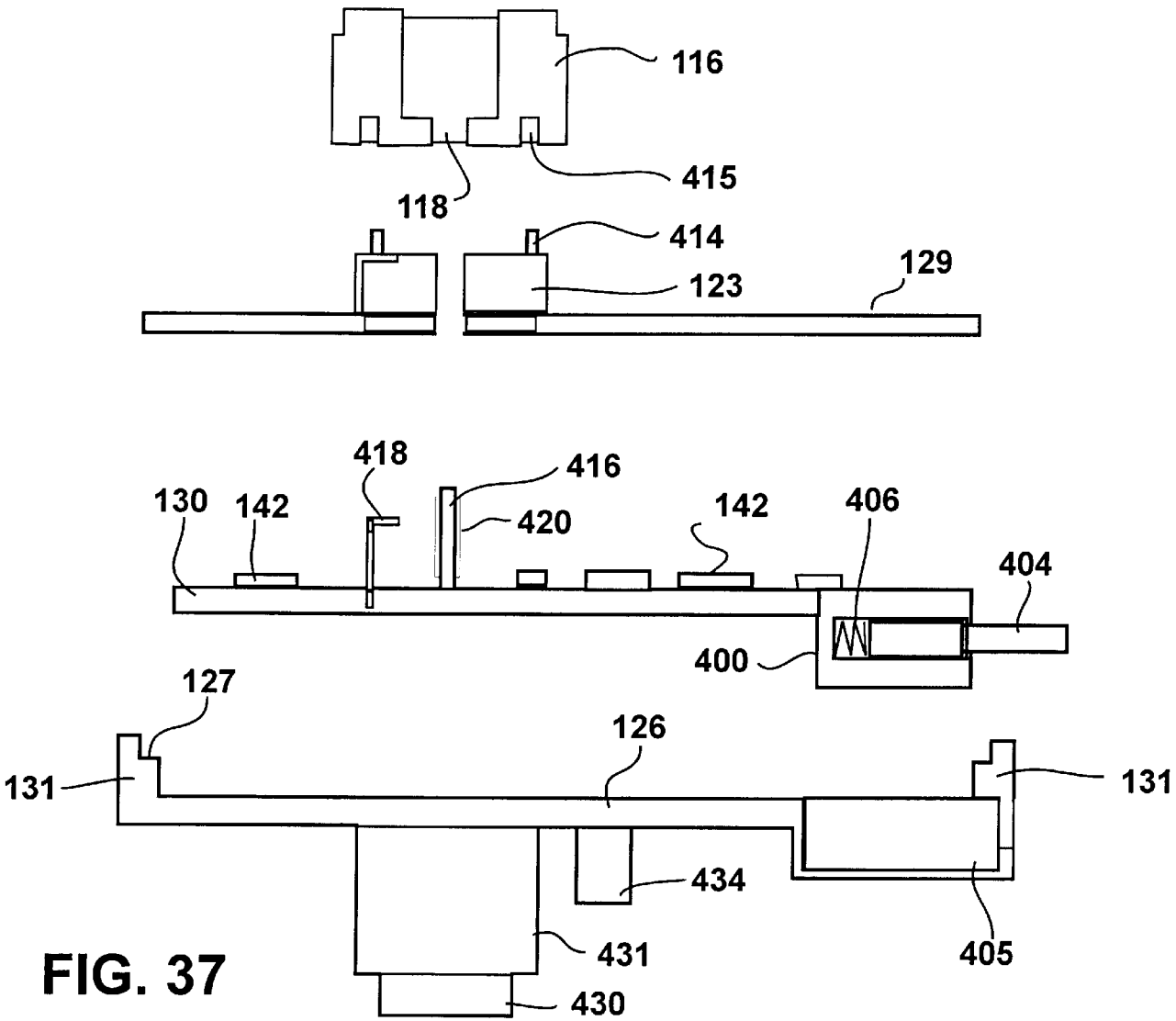
FIG. 37 is a partial assembly view showing an embodiment constructed according to the principles of the present invention with a non-bitted cylinder and a directly locking solenoid.
Figure 38:
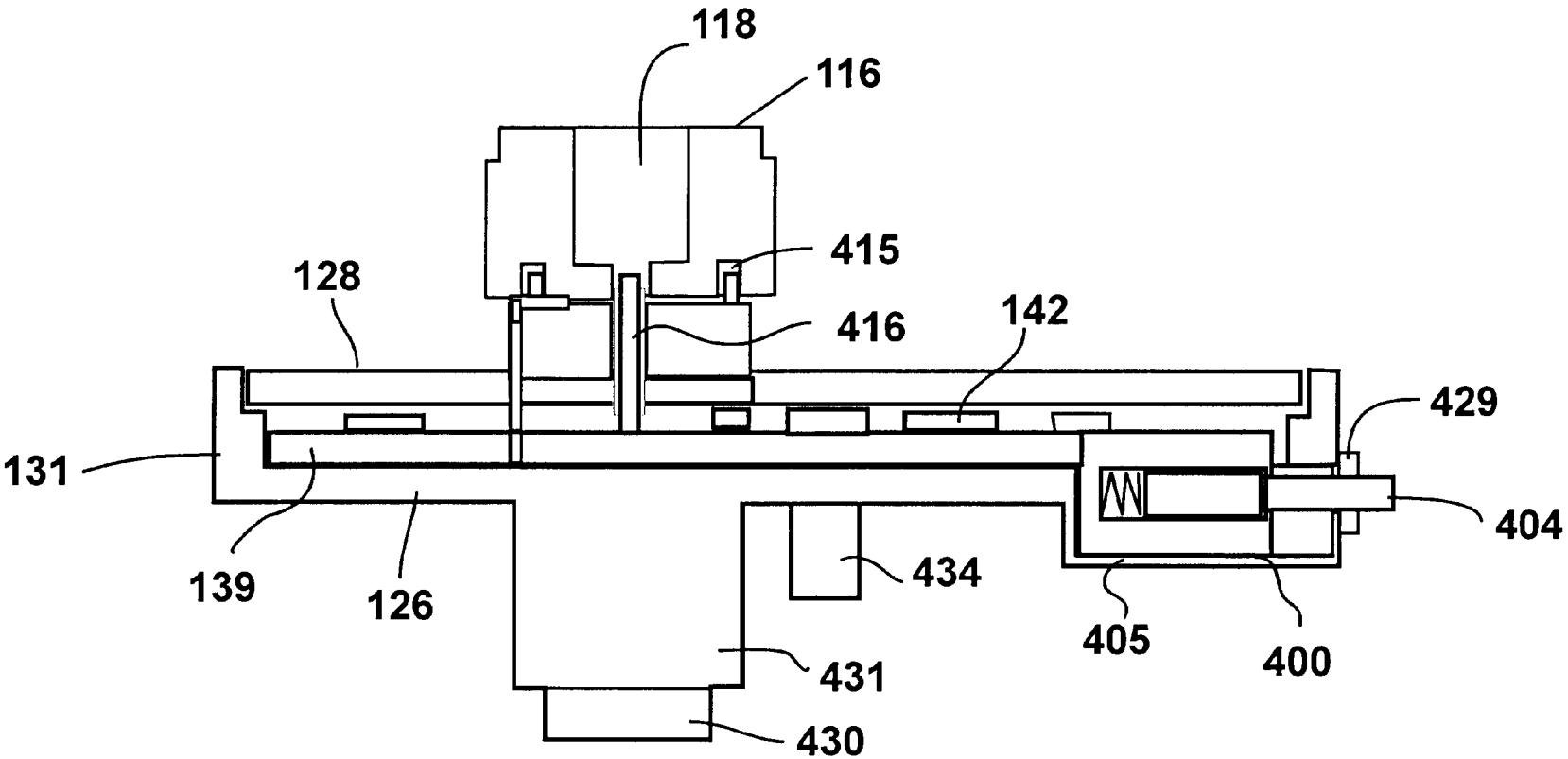
FIG. 38 is a cross-sectional view showing the assembly of the embodiment illustrated in FIG. 37.
Figure 39:
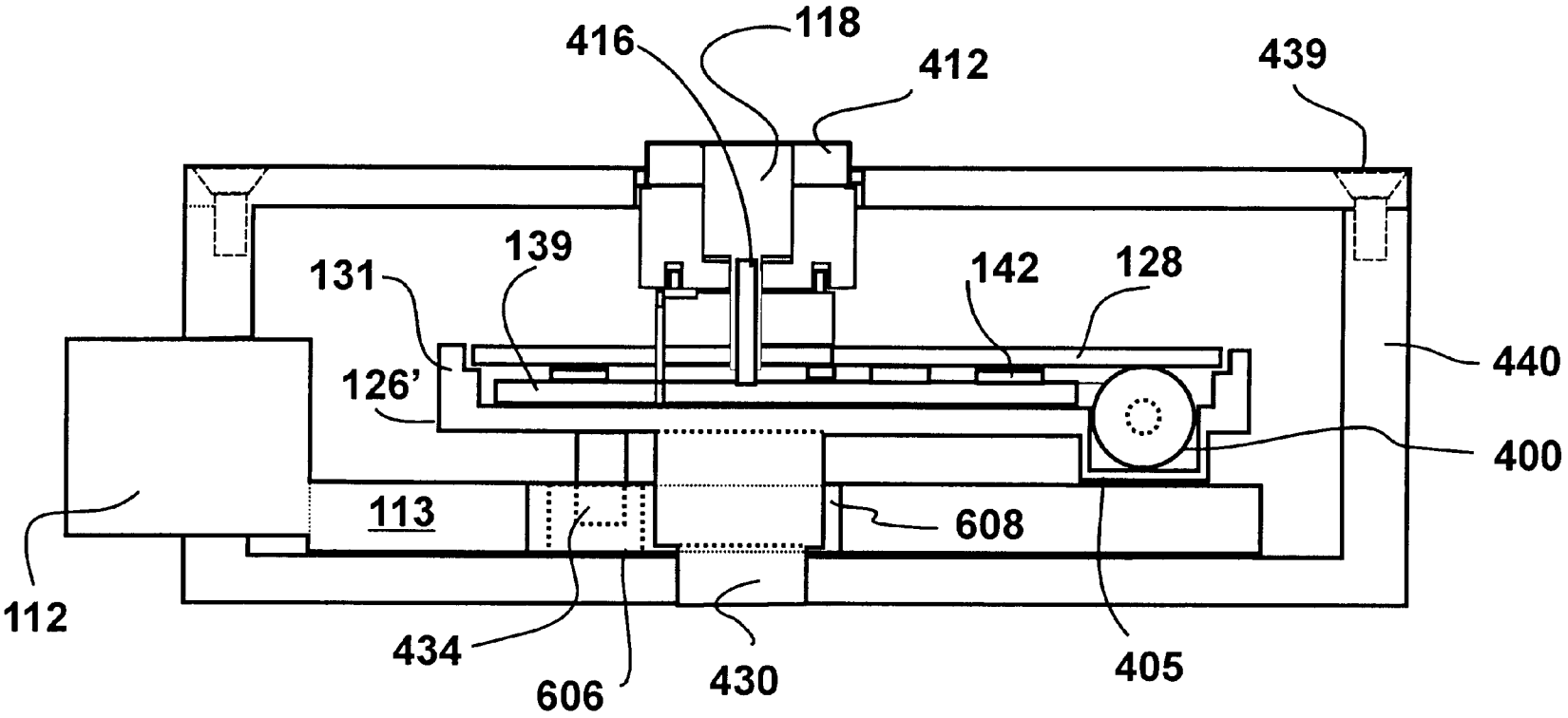
FIG. 39 is a cross-sectional side view showing the assembly of the embodiment illustrated in FIG. 37.

Turning now to FIGS. 34 through 36, the cam assembly 800 fitted with an electrically operated motor incorporated into the locking mechanism is illustrated. The motor is constructed with a shaft 808 supporting a drum 802 bearing a slot 804 formed through its upper surface that is sufficiently wide to accommodate passage of the arcuately curved fence 812 protruding downwardly from the under side of cover 422. Mechanical and electronic conformity of a key inserted into keyway 118 will enable circuit 130 to apply an electrical current to the coil 8 14 of the stepping motor, thereby turning the armature 816 of the motor by ninety degrees to an unlocked state accommodating passage of fence 812 as shown in FIG. 36 as cam plate 126 rotates. Shaft 808 can rest in the motor housing 810, which is in turn mounted upon circuit board 139 or, alternatively, directly upon cam plate 126. As shown in FIG. 34, drum 802 contains a false notch (shown on one side) designed to accommodate entry, but not passage of a short portion of fence 812. This thwarts improper efforts to unlock the mechanism simply by application of rotational torque to the cylinder plug as, by insertion of the blade of a screw driver into keyway 118. Counterclockwise rotation and removal of the key will trigger application of a charge held by a capacitor within circuit 130 that has been charged by battery 437, to rotate locking drum 802 by one additional ninety degree step in the clockwise direction to block rotation of cam plate 126 relative to fence 812. Alternatively, the motor may be fitted with a torsion spring (not shown) anchored to the drum 802 and motor body 810 to restore the drum to its original locked position.

As shown in FIG. 35B, a bitted lock cylinder 700 maybe incorporated into the cam assembly of FIGS. 34 and 35A, to provide an additional level of mechanical conformance required to gain entry to the container closed by the locking mechanism.

Figure 40:
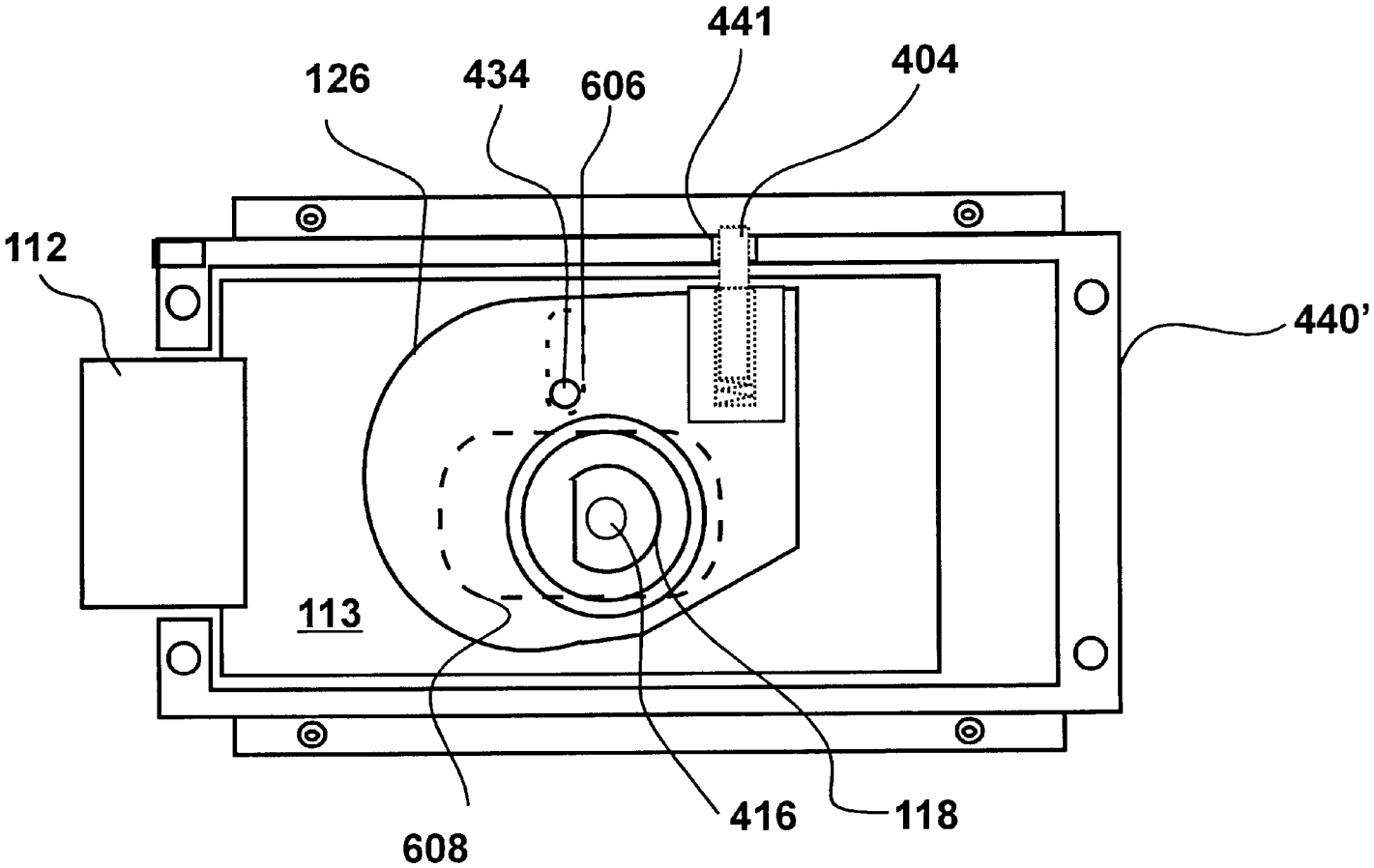
FIG. 40 is a plan view showing the assembly of the embodiment illustrated by FIG. 37.
Figure 41:
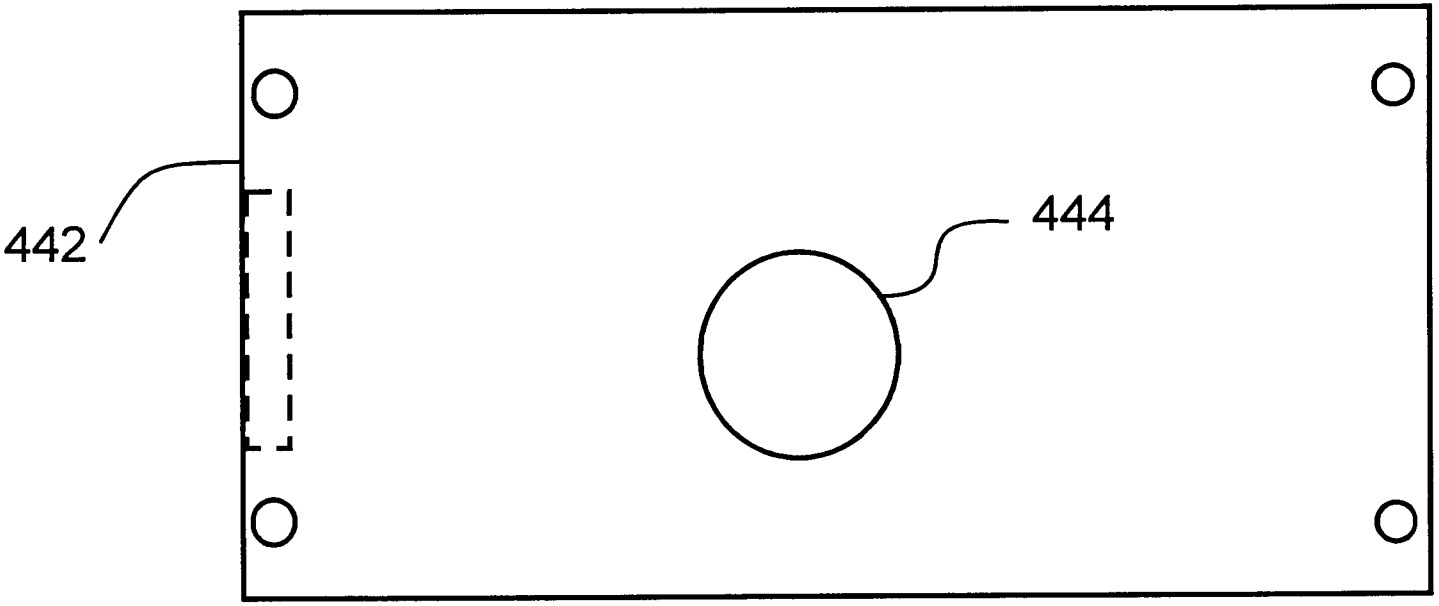
FIG. 41 is a plan view showing a cover that may be installed upon the assembly illustrated by FIG. 40.
Figure 42:
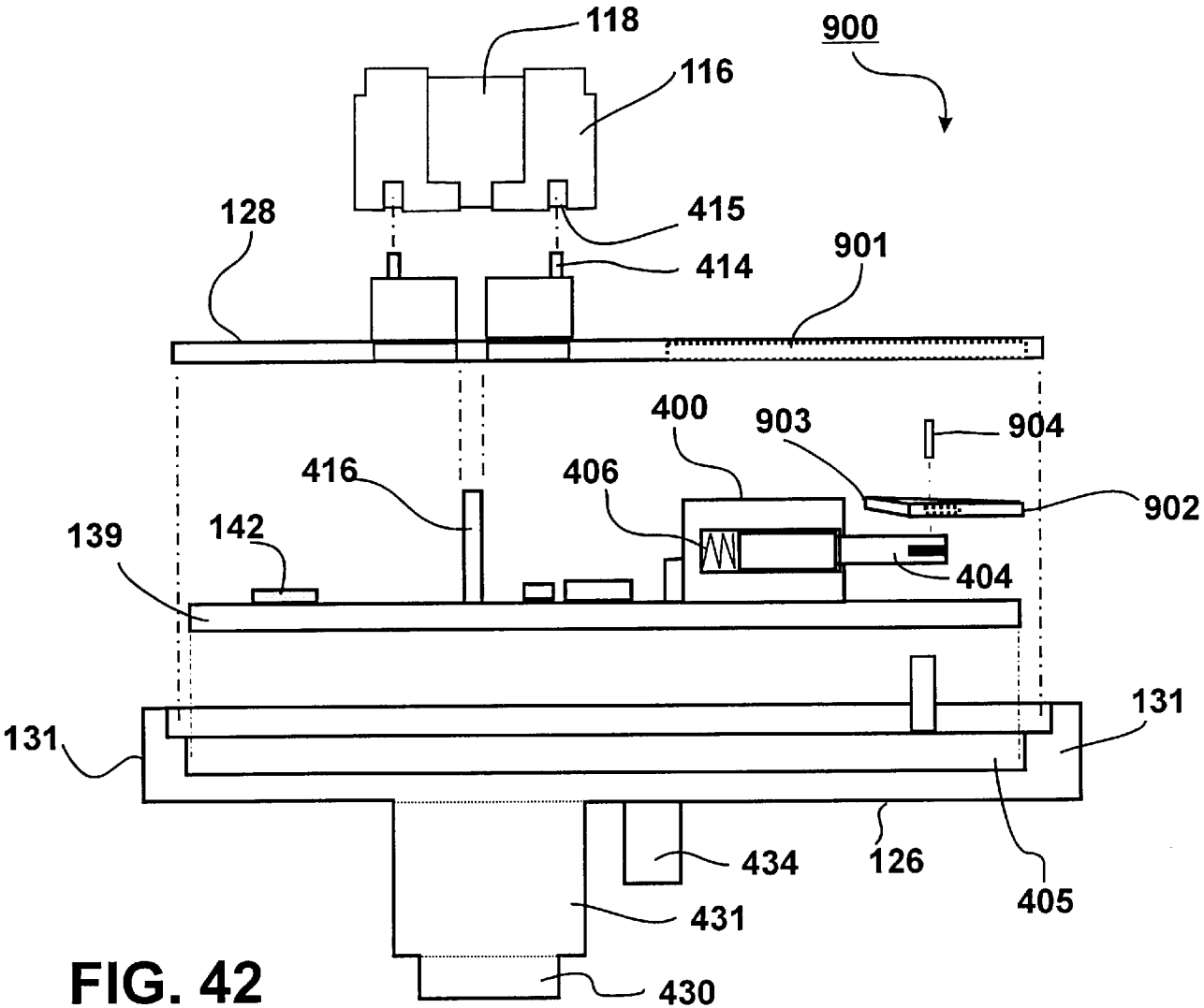
FIG. 42 is a cross-sectional assembly view showing an embodiment constructed with a solenoid activated linkage.
Figure 43:
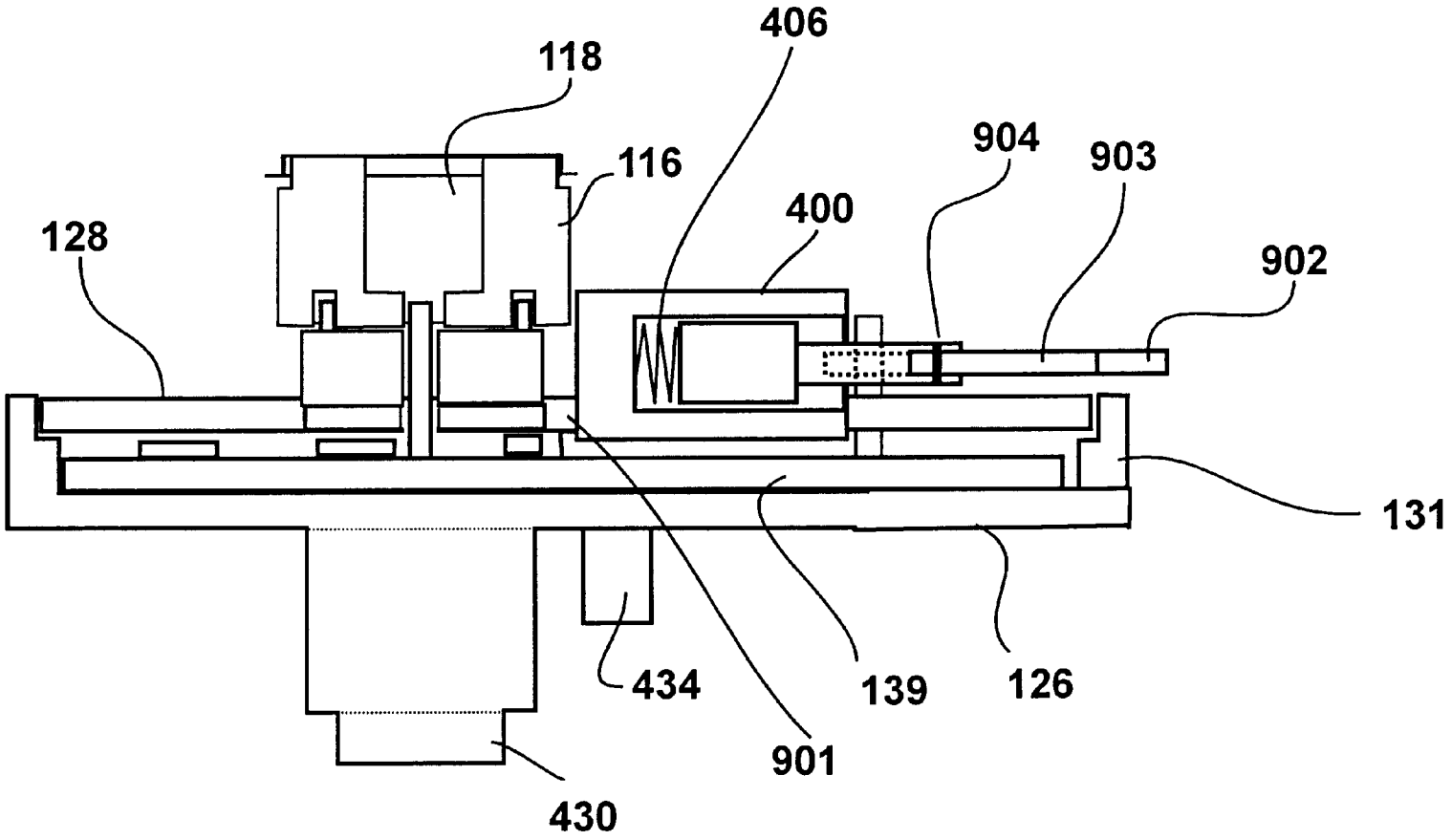
FIG. 43 is a side cross-sectional view of the embodiment illustrated in FIG. 42.
Figure 45:
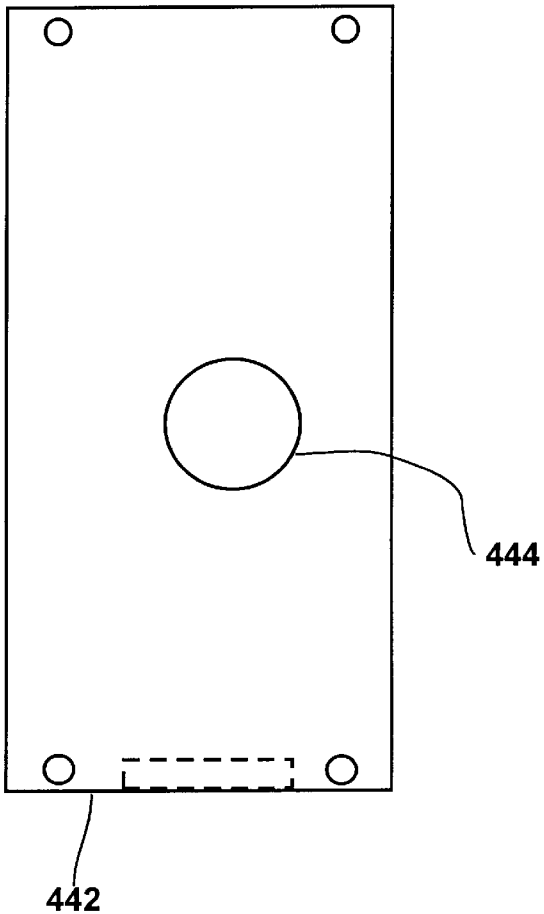
FIG. 45 is a plan view of a cover that may be installed upon the cam assembly illustrated by FIG. 44.

Turning now to FIGS. 37 through 41 collectively, a non-bitted cylinder plug 116 is mounted to a cam assembly extension 123 via shear pins 414 received within conforming apertures 415 in a cylinder plug. A solenoid 400 is mounted directly upon circuit board 139, as an interval component of circuit 130, and is received within cavity 405 of cam plate 126'. Lock housing 440' has one wall perforated by an opening 441 conforming in size and shape to solenoid armature 404. In the lock state therefore, spring 406 holds armature 404 within aperture 441. Correct mechanical conformance and electronic conformance between the key inserted into keyway 118 and circuit 130 will enable application of an electrical current to solenoid 400 that will cause withdrawal of armature 404 from aperture 414, thereby enabling cam plate to rotate clockwise (as shown in FIG. 40) under the torque applied by the key to keyway 118, thus withdrawing shank 113 under the force of drive pin 434 applied to slot 606, and thus withdrawing bolt 112. Clockwise rotation of the key will restore alignment between armature 404 and aperture 441.

Figure 44:
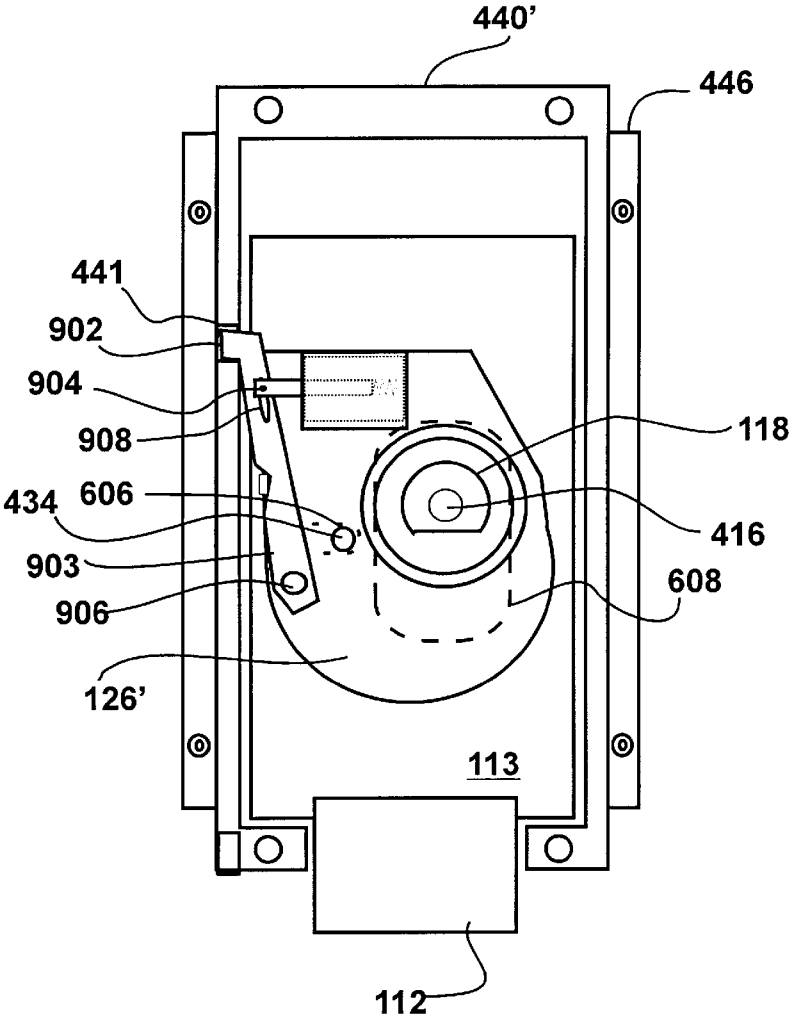
FIG. 44 is a plan view showing the embodiment illustrated by FIG. 42.
Figures 46, 47:
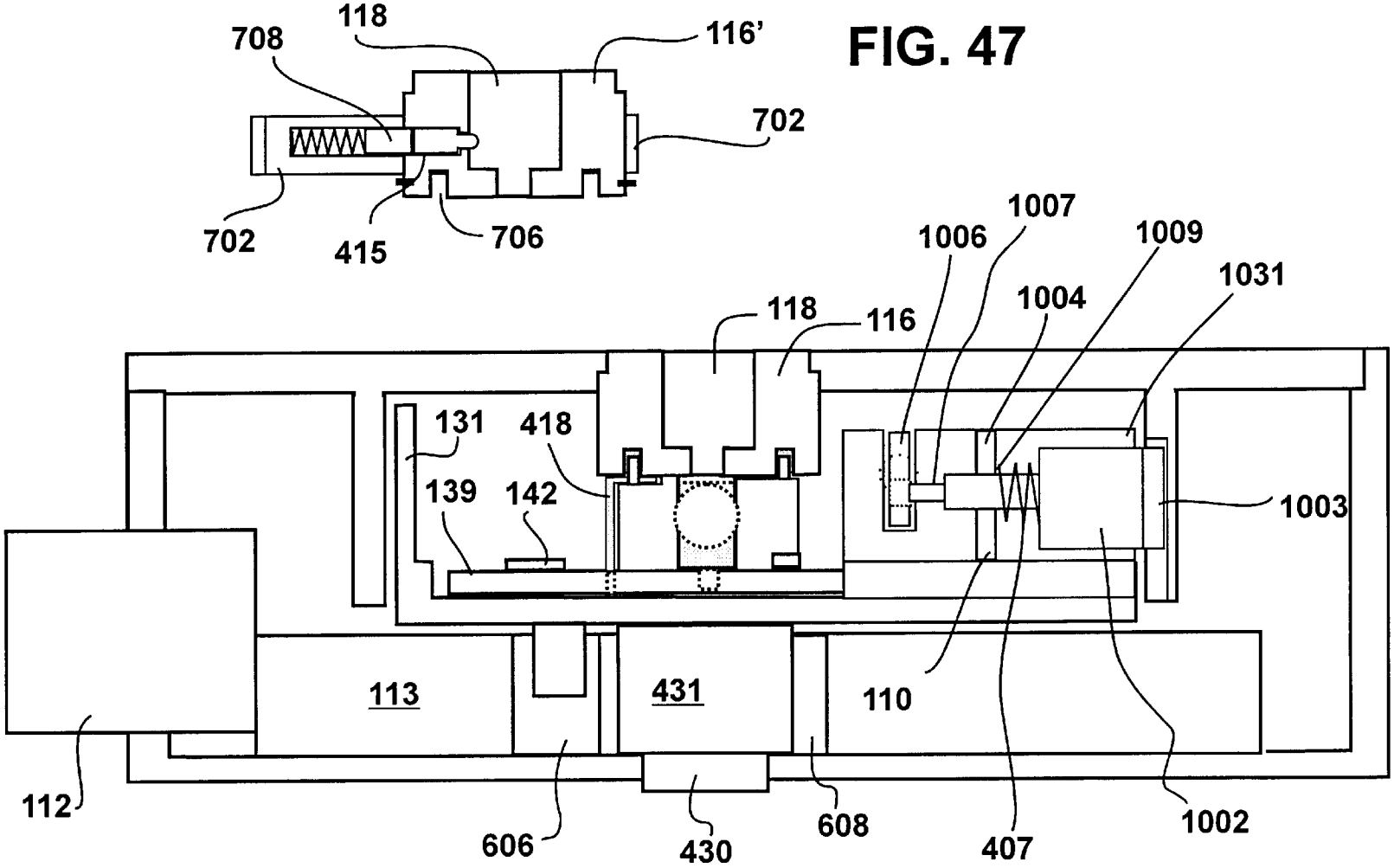
FIG. 46 is a cross-sectional elevation taken along sectional line XXIXVIII–XXIXVIII' showing still another embodiment constructed according to the principles of the present invention.
FIG. 47 is a cross-sectional view of a bitted lock cylinder that may be incorporated into the embodiment illustrated by FIG. 46.

Turning now to FIGS. 42 through 45, an alternative embodiment is constructed with solenoid release assembly 400 mounted upon circuit board 139, to protrude through slot 901 formed in cover is 128. A lever 903 pivotally attached at a distal end to cam plate 126' via a rotating pin 906. Armature 404 is connected, at its distal end, via pin 904 to lever 903. Pin 904 slides within a slot 908 extending nearly longitudinally along a distal portion of lever 903. The distal end of lever 903 is terminated by a detent 902 conforming to aperture 441. Accordingly, when spring 406 forces armature 404 to its fully extended position as shown in FIG. 44, lever 903 forces detent 902 fully within aperture 441, thereby preventing rotation of cam plate 126' relative to shank 113. Consequently, efforts to apply a manual torque to via keyway 118 to cam plate 126' will, absent electronic conformance of the circuit held by the key with circuit 130 mounted on cam plate 126'. will cause detent 902 to round the circumferential surface of aperture 441, thus preventing rotation of cam plate 126'. Given electronic conformance between circuit held by the key and circuit 130 however electrical current running through solenoid 400 will retract armature 404 within solenoid 400 against spring 406, thereby compressing spring 406 while withdrawing detent 902 from aperture 441, thus enabling clockwise rotation of cam plate 126' relative to shank 113 and housing 440'. This rotation causes drive pin 434 to engage the walls of slot 606 and force shank 113 along the walls of spacer 431. Consequently, slots 608 slides along the circumferential walls of spacer 431, thus withdrawing bolt 112 substantially into the interior of housing 440'. Cover 442 fits upon and maybe fasten with threaded fasteners to housing 440'.

It may be noted that this structure provides an indirect locking mechanism with detent 902. Moreover, the radial displacement of detent 902 from the central axis of keyway 118 provides an enhanced advantage in the amount of torque required to mechanically defeat the lock. Additionally, the increased diameter of pin 906 pivotally coupling the distal end of lever 903 to the peripheral of cam plate 126' further enhances a mechanical strength of locking mechanism.

Figure 48:
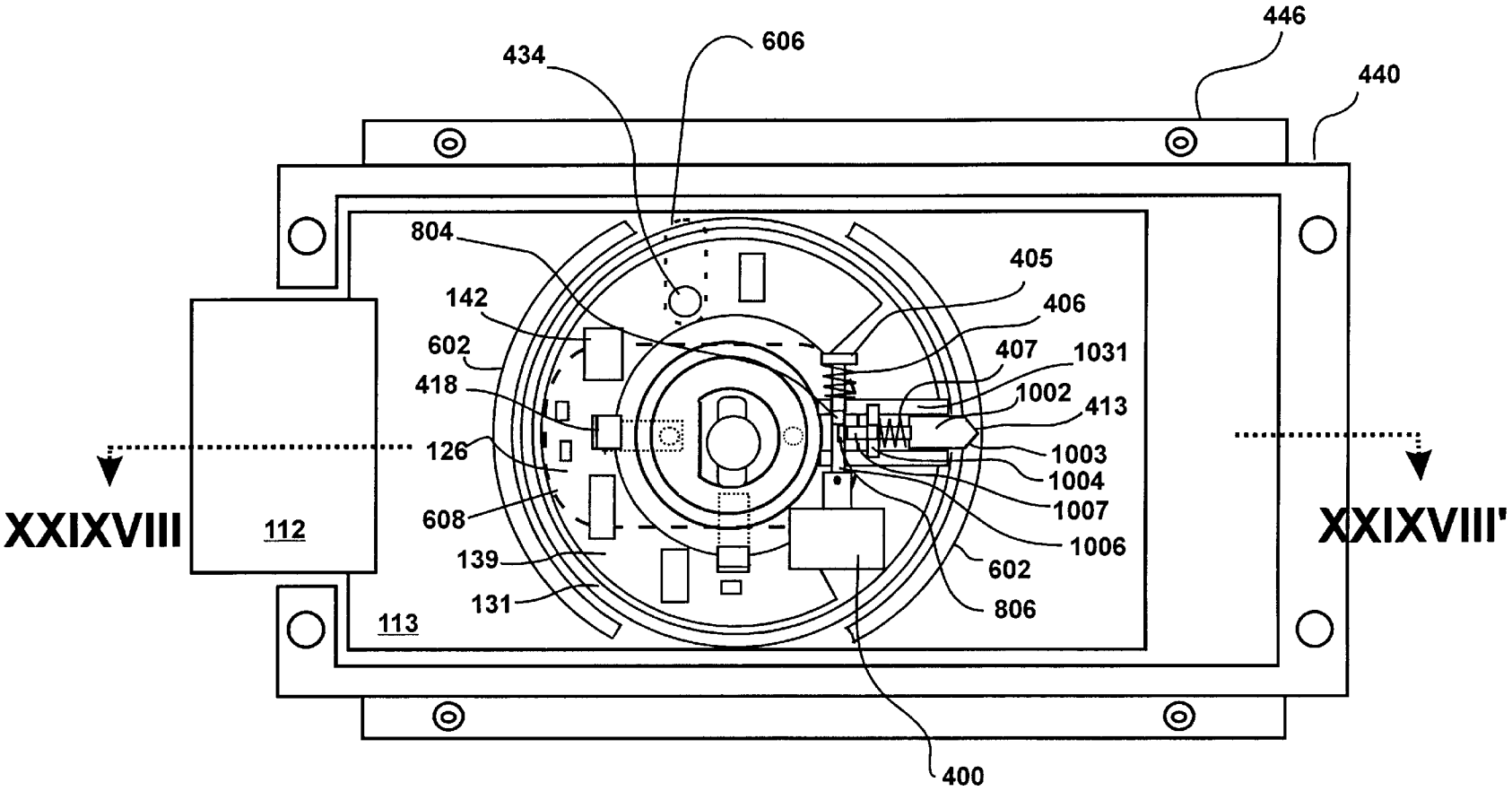
FIG. 48 is a plan view of the embodiment illustrated by FIG. 46 while in a locked state.
Figure 49:
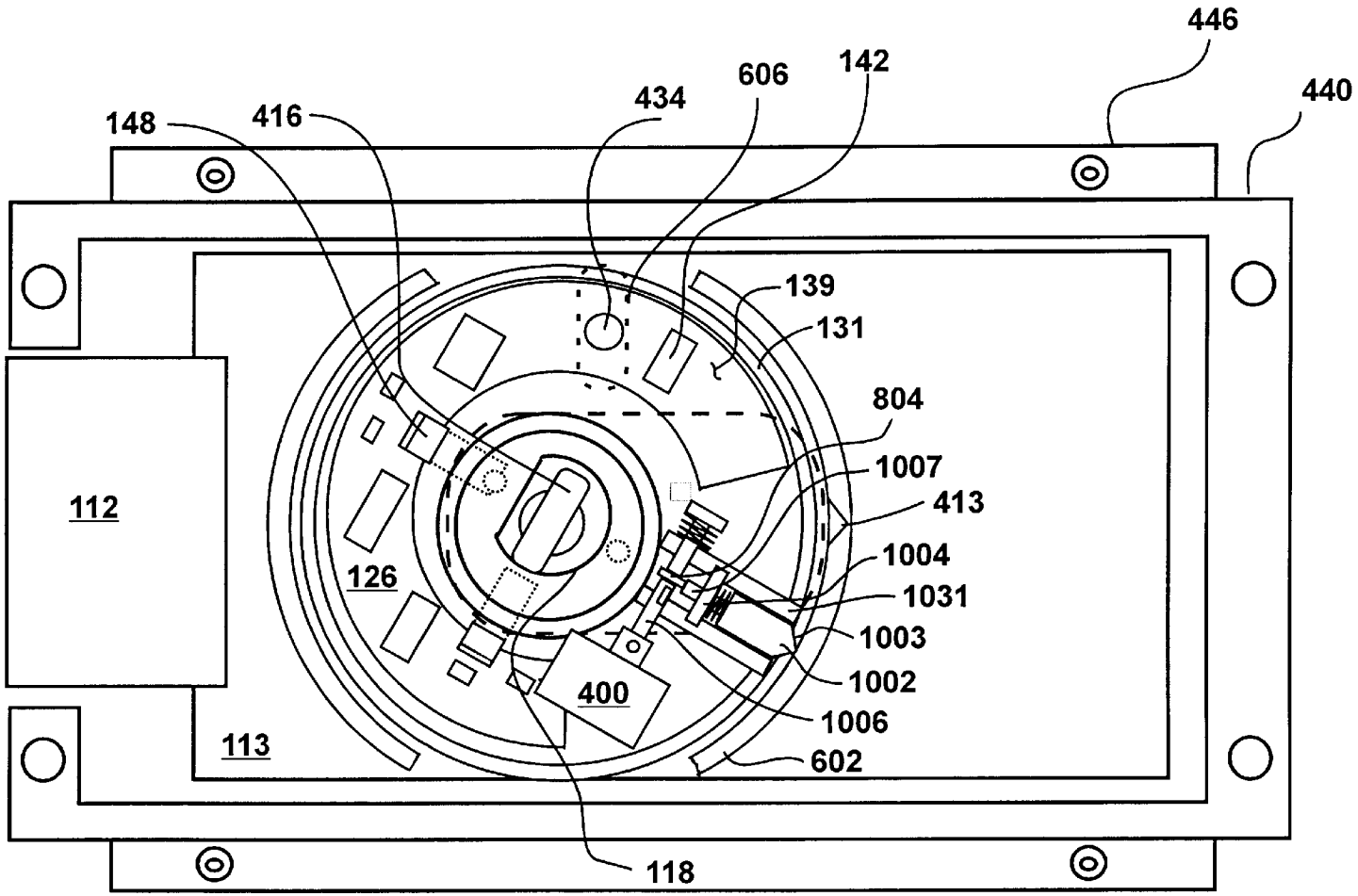
FIG. 49 is a plan view of the embodiment illustrated by FIG. 48 while in an unlocked state.
Figure 51:
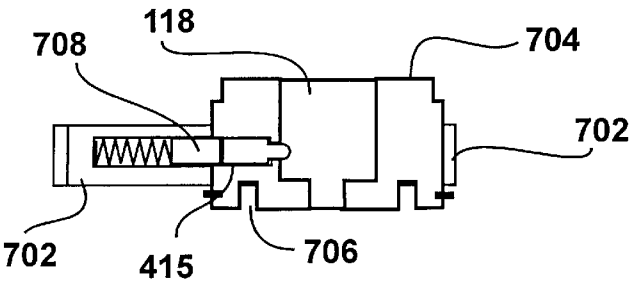
FIG. 51 is a detailed cross-sectional view of a bitted lock cylinder that may be incorporated into the embodiment illustrated by FIG. 50.
Figure 50:
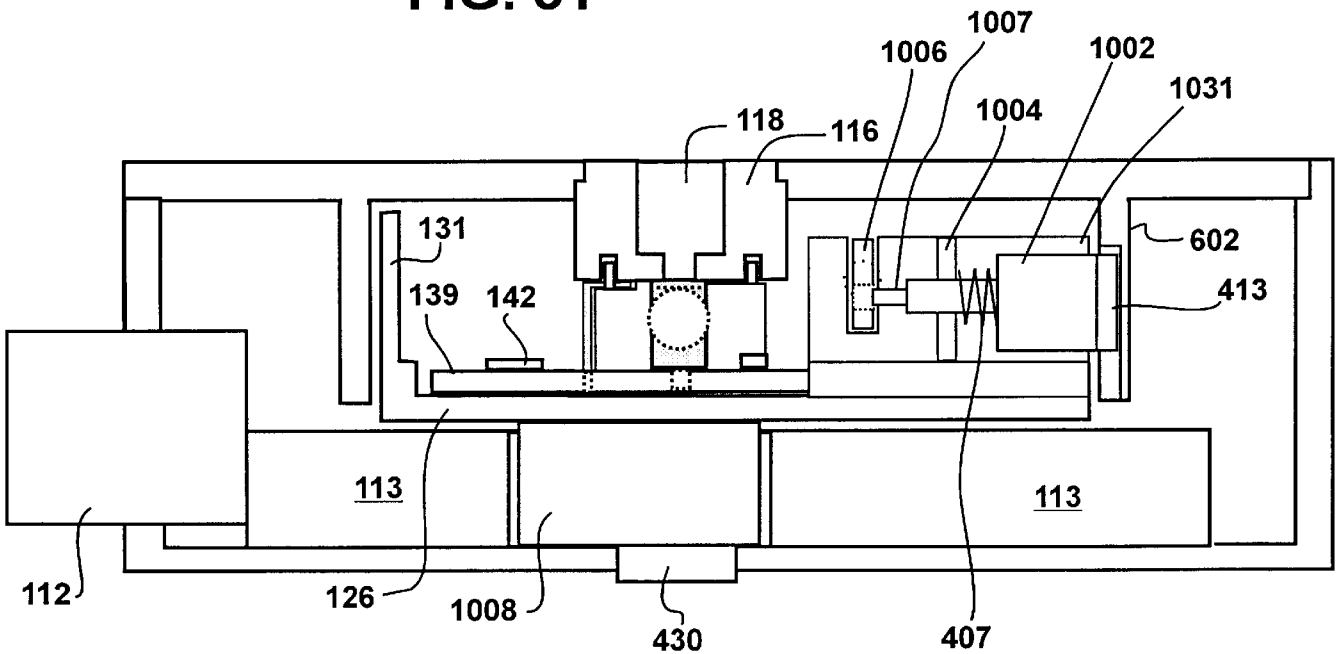
FIG. 50 is a cross-sectional elevation showing the details of still yet another embodiment constructed according to the principles of the present invention.

Turning now to FIGS. 46 through 49, an alternative embodiment is constructed using a solenoid 400 mounted upon cam plate 126. Solenoid 400 drives a locking plate 1006 reciprocally between a pair of radial extensions 1031 of circumferential wall 131, against the force of compression spring 406. Spring 406 is mounted between the cap 405 terminating one end of locking end 1006, and the side of upper extension wall 1031. Locking plate 1006 is partially perforated by blind false notch 806 positioned to axially aligned with an received the distal end of shaft 1007 of plunger 1002 when solenoid 400 is un energized and in its rest position as shown in FIG. 48. When a mechanically conforming key is inserted into keyway 118 and the digital electronic signature borne by that key conforms to data stored within circuit 130, solenoid 400 is energized to retract plate 1006 in a downward direction, as shown in FIG. 48, and unlocking slot 804 is axially aligned with the distal end of shaft 1007, as shown in FIG. 49.

Guide plate 1004 extends transversely between radial extension walls 103 1, and is perforated by a through aperture accommodating entry in partial passage of the enlarged proximal end of shaft 1007. Return spring 407 acts against plate 1004 to hold plunger 1002 within groove 413 formed in guide wall 602. The distal doubled end surfaces 1003 of plunger 1002 conform with the shape of groove 413 to form an obtuse angle at its apex, thereby enabling application of manual torque to keyway 118 to force, through camming action between surfaces 1003 and the walls of groove 413 plunger 1002 to the left as shown in FIG. 48. Consequently, absent electronic conformance between the digital electronic signature held by the key inserted in the keyway 118 and data stored within the memory of circuit 130, the distal end of shaft 1007 will engage false notch 806. This is frequently the situation when a person seeking unauthorized access to the container secured by the locking mechanism attempts to simultaneously jar solenoid 400 while overcoming the bias force created by spring force 406. The much larger force created by return spring 407 however requires a substantial jarring motion applied to the container, with result that the plunger 1002 tends to mover suddenly and thereby overcome the bias force of return spring 407, with result that the distal end of shaft 1007 engages false notch 806. Electronic conformance between the signature held by the key and data stored within the memory of circuit 130 enables radially inward movement of shaft 1007 through aperture 804, thereby enabling the manual torque to rotate cam plate 126 clockwise as shown in FIG. 49. The apex of surfaces 1003 rides along the inner circumferential surface of guide wall 602.

Figure 52:
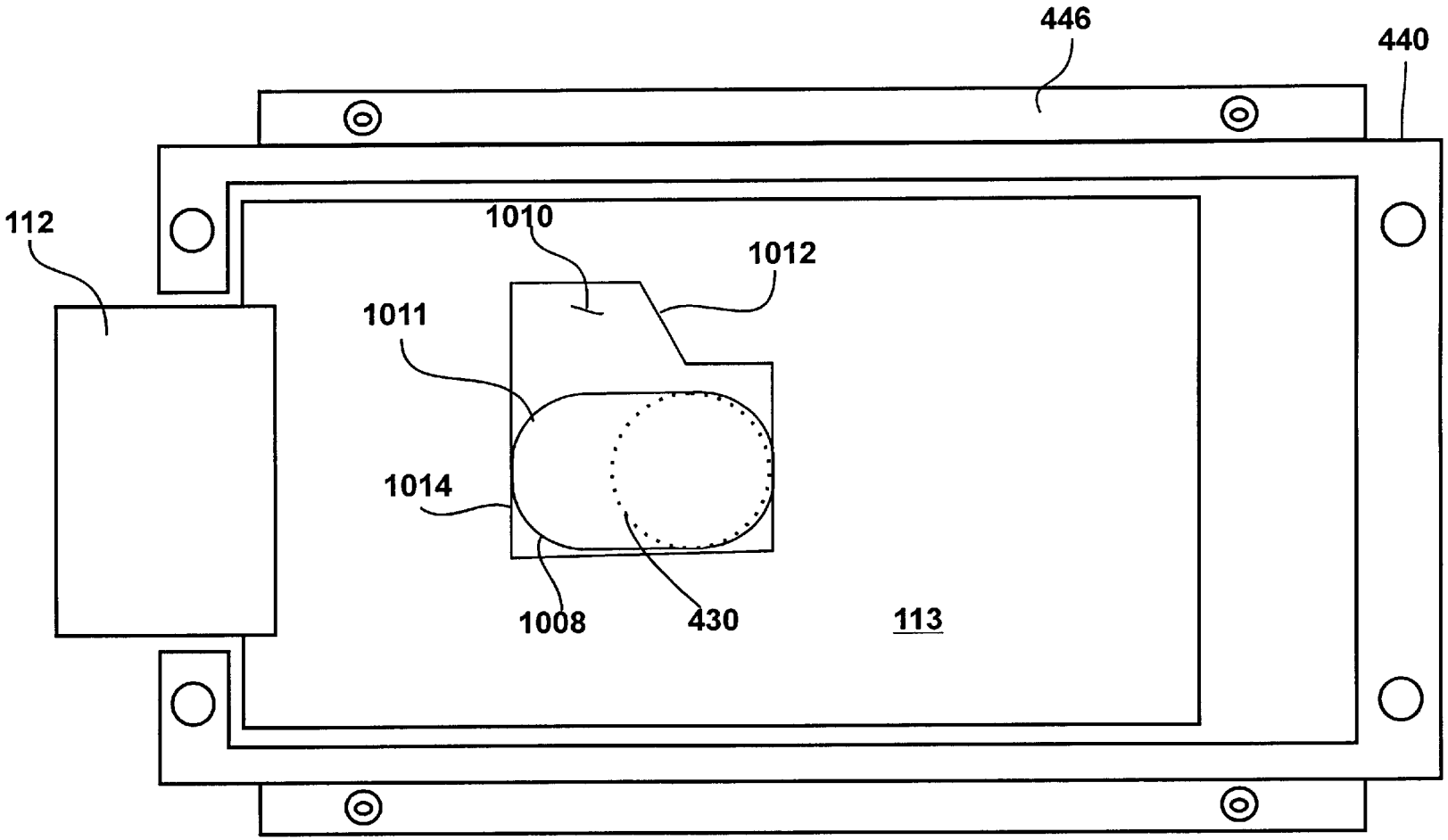
FIG. 52 is a plan view illustrating the embodiment of FIG. 50 while in a locked state.
Figure 53:
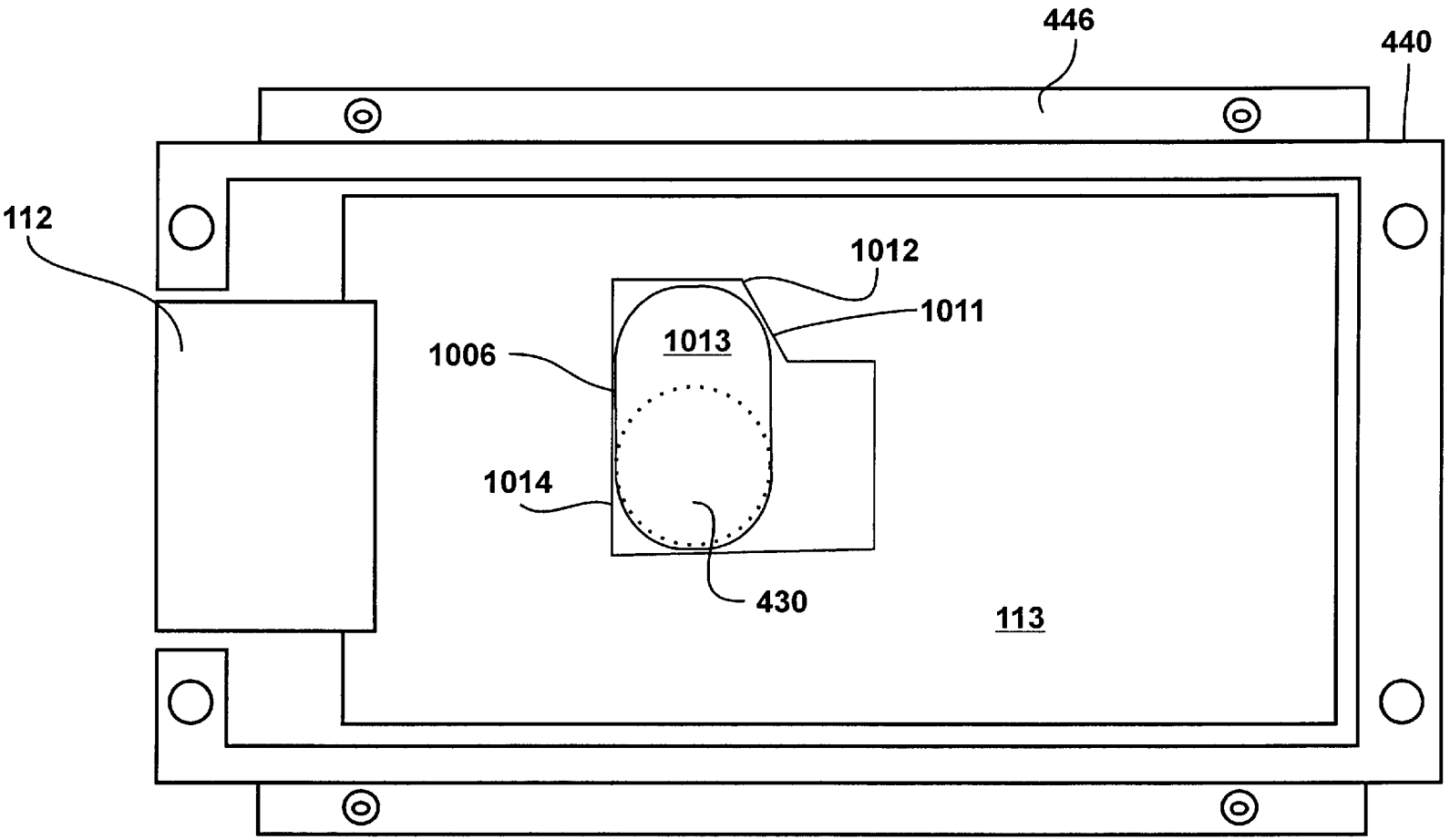
FIG. 53 is a plan view showing the embodiment illustrated by FIG. 50 while in an unlocked state.

Turning now to FIGS. 50 through 53, an alternative embodiment is shown constructed with an elliptical bolt drive lobe 1008 positioned between post 430 and cam plate 126. This embodiment eliminates the need for a separate, discrete bolt drive pin 434. Instead, the configuration shown relies upon camming action between surface 1011 of lobe 1013 to rotate through ninety degrees while engaging retract surface 1012 as manual torque is applied to a key that mechanically and electrically conforms to keyway 118 and circuit 130, as the key is turned counterclockwise (looking at FIGS. 52 and 53). This enables the camming action between surfaces 1011, 1012 to draw shank 113 to the right (as shown in FIGS. 52 and 53), thereby withdrawing bolt 112 substantially within housing 440. In an alternative configuration, the bitted plug 704 may be substituted for cylinder plug 116, to add an additional element of access security.

Turning now to FIGS. 54 through 57 show yet another alternative embodiment constructed with a cam plate 126" having a centrally positioned spacer 431 and pivot post 430 coaxially aligned with the keyway 118 of cylinder plug 116 mounted upon cover 128 via spacer 123. Cam plate 126" is equipped with a downwardly depending drive pin 434 radially offset from the central axis of keyway 118. A notch 1113 is formed at an intersection of two sides of plate 126" separated by spacer 431 from bolt 112. Notch 1113 engages blocking plate 1107 mounted on the distal end of armature 404. Solenoid 400 is mounted upon the floor of housing 440, rather than upon cam plate 126". A pair of electrical leads 1018 coupled to plug 1012 electrically engage a pair of jacks 1016 mounted upon circuit board 139. Leads 1018 flex as cam plate 126" rotates through an approximate forty five degree arc in response to manual torque applied by a key inserted into keyway 118 when the key mechanically and electronically conforms to keyway 118 and circuit 130.

Figure 54:
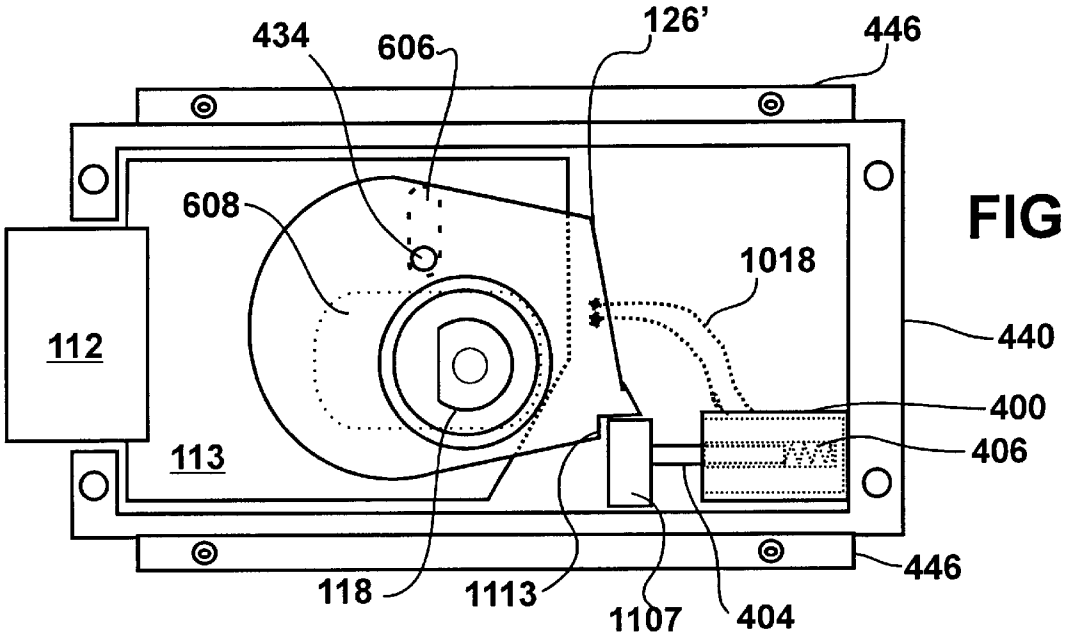
FIG. 54 is a plan view of another alternative embodiment constructed according to the principles of the present invention.
Figure 55:
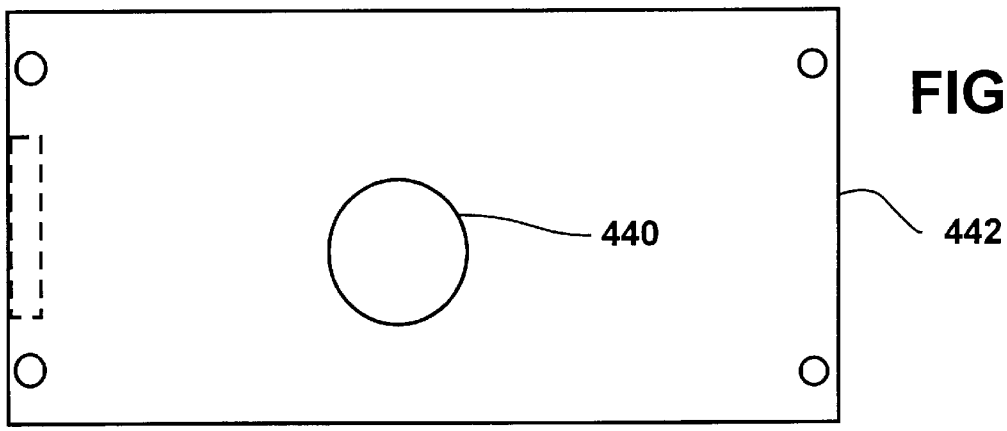
FIG. 55 is a cover that may be attached to the embodiment illustrated by FIG. 54.
Figure 56:
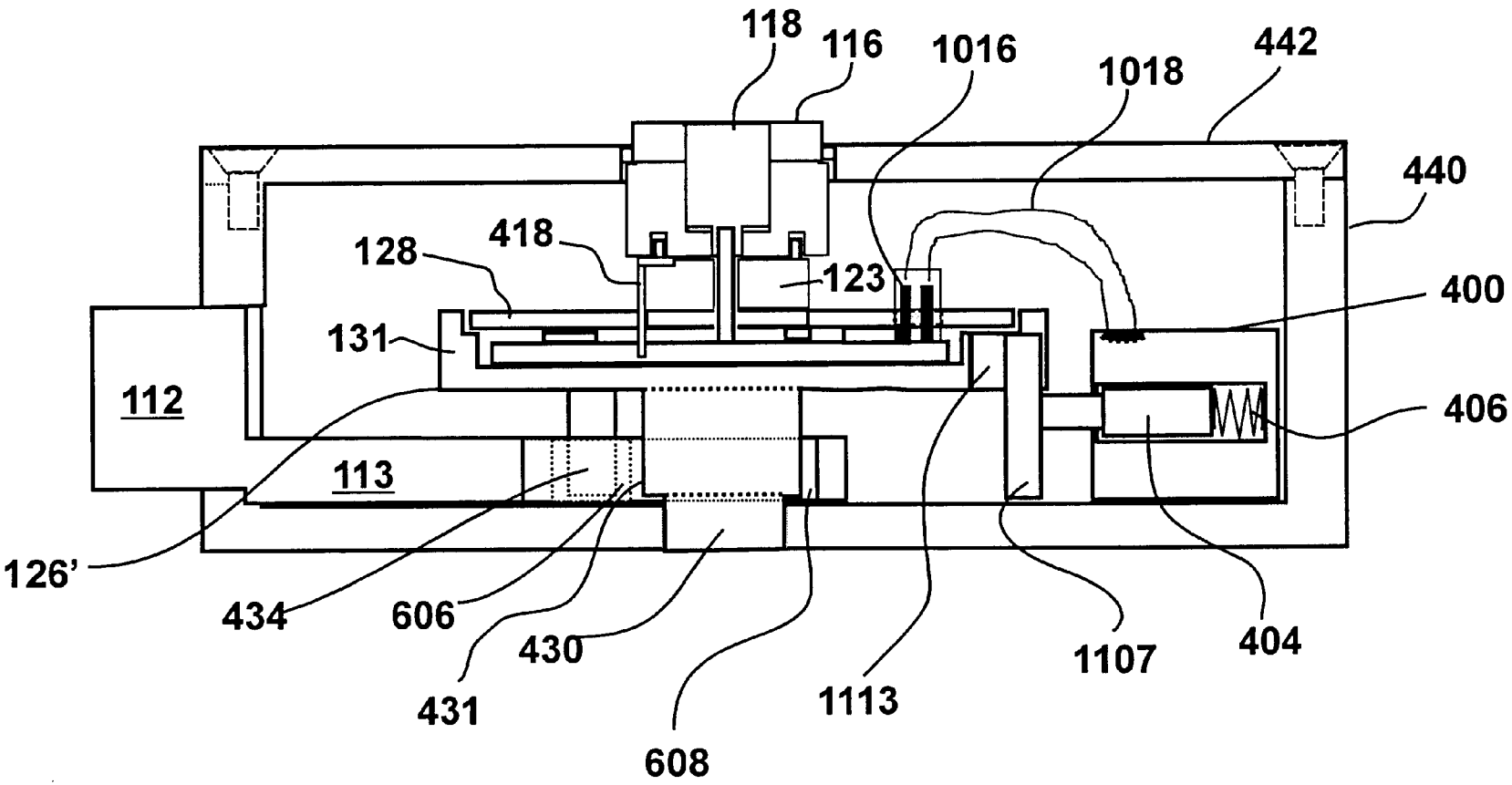
FIG. 56 is a cross-sectional elevation of the embodiment illustrated by FIG. 54.
Figure 57:
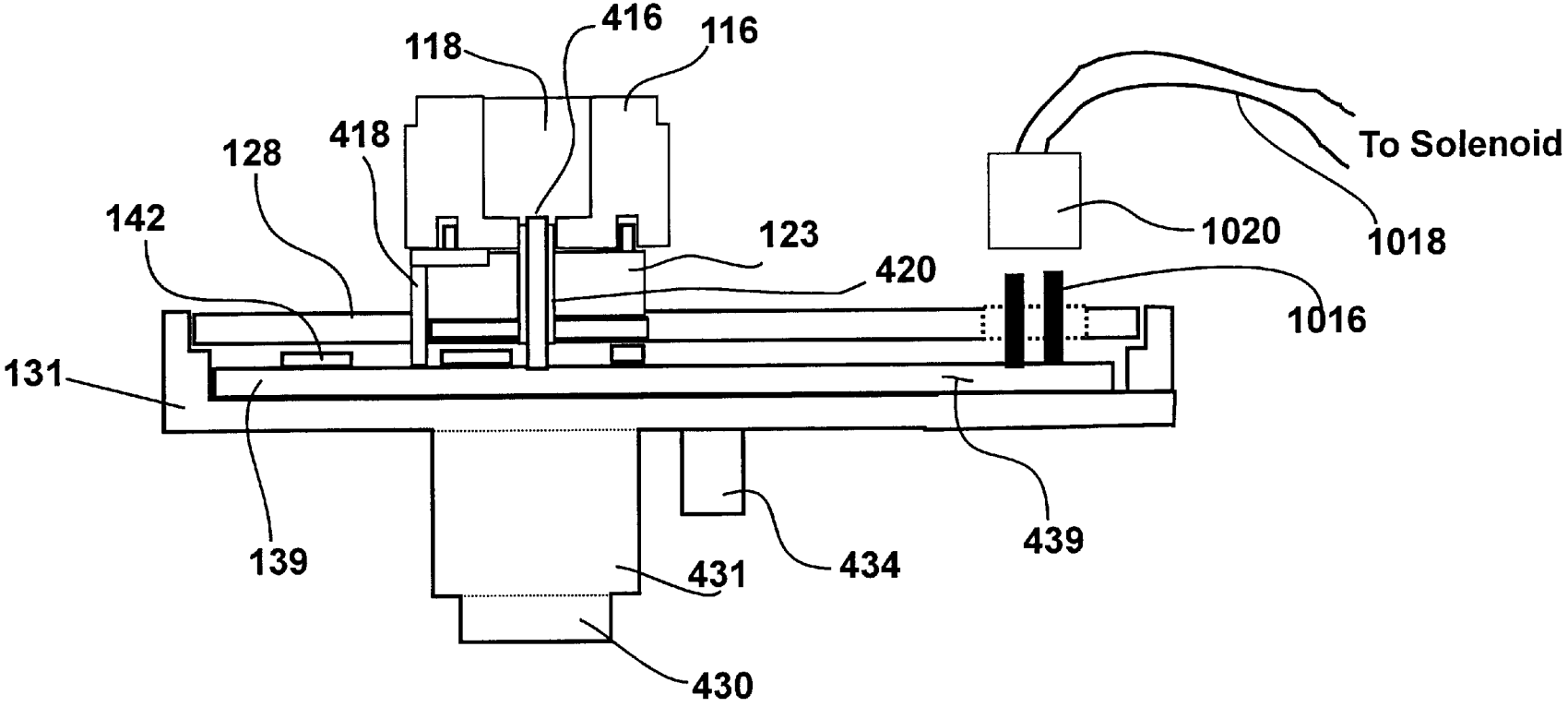
FIG. 57 is a side elevational view of the embodiment illustrated by FIG. 54.

Mechanical conformance of the key to keyway 118 and electronic conformance of the lot electronic digital signature held by the key to digital data stored within circuit 1301 enables circuit 130 to apply an electrical current derived from the battery held by the key (or alternatively, by a battery mounted within circuit 130) to the winding of solenoid 400 via leads 10 18, thereby retracting armature 404 and locking plate 1101, and thus allowing counterclockwise rotation of cam plate 126" under the force of the torque of the key. This causes drive pin 434 to force the walls of slot 606 to the right as shown in FIG. 54, thereby shifting shank 113 and bolt 112 to the right, thus withdrawing bolt 112 substantially within housing 440. Cover 442 is secured to housing 446. As shown in FIG. 57, plug 1020 may be easily removed from jacks 10 16 to enable and easy replacement of solenoid 400.

Figure 60:
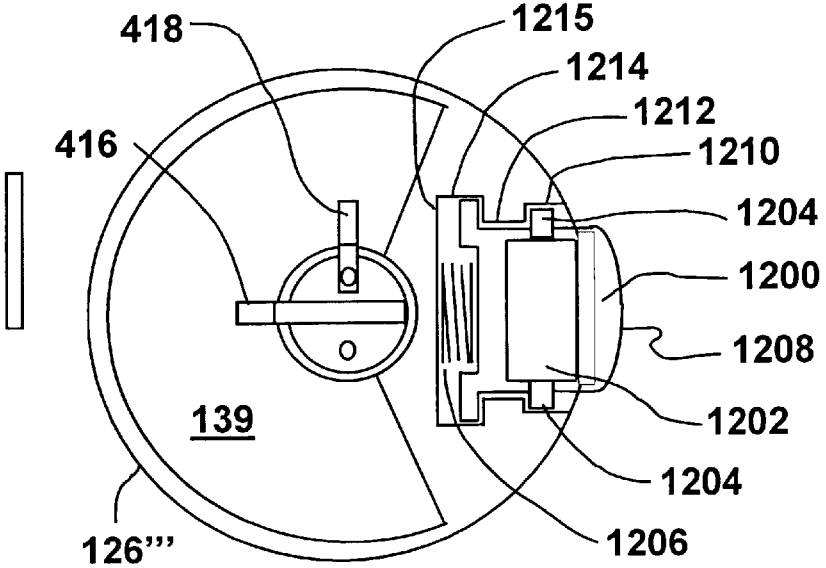
FIG. 60 shows a plan view of the cam assembly of FIG. 58.
Figure 58:
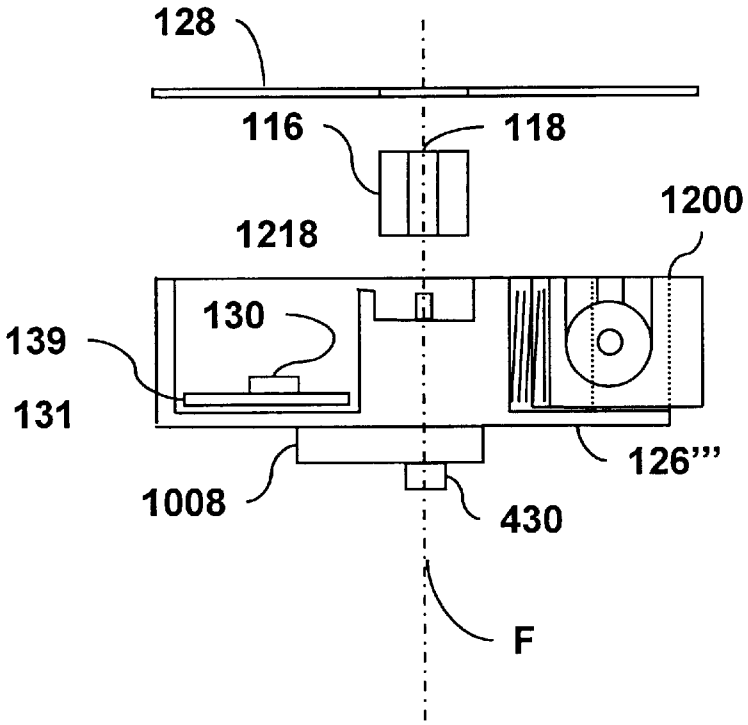
FIG. 58 shows a cross-sectional view taken along the sectional line in FIG. 60, of an alternative embodiment.
Figure 63:
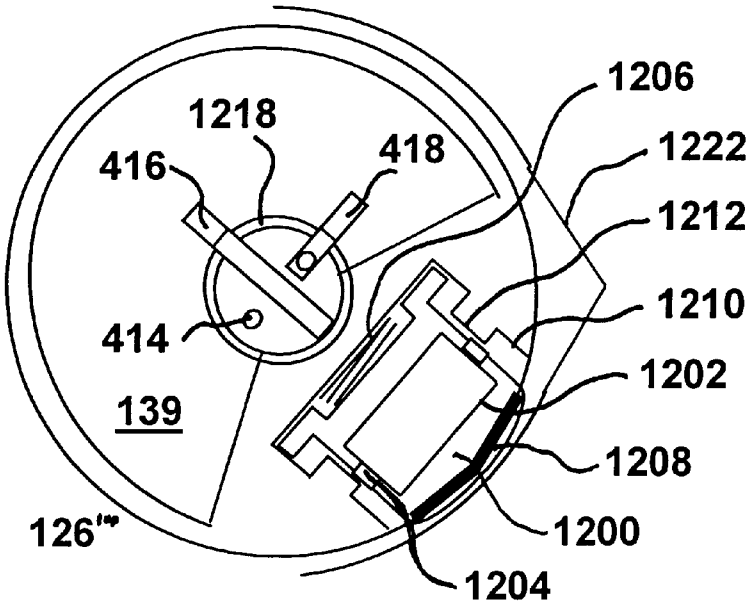
FIG. 63 shows a plan view of the embodiment of FIG. 58 in an unlocked and opened position.
Figure 59:
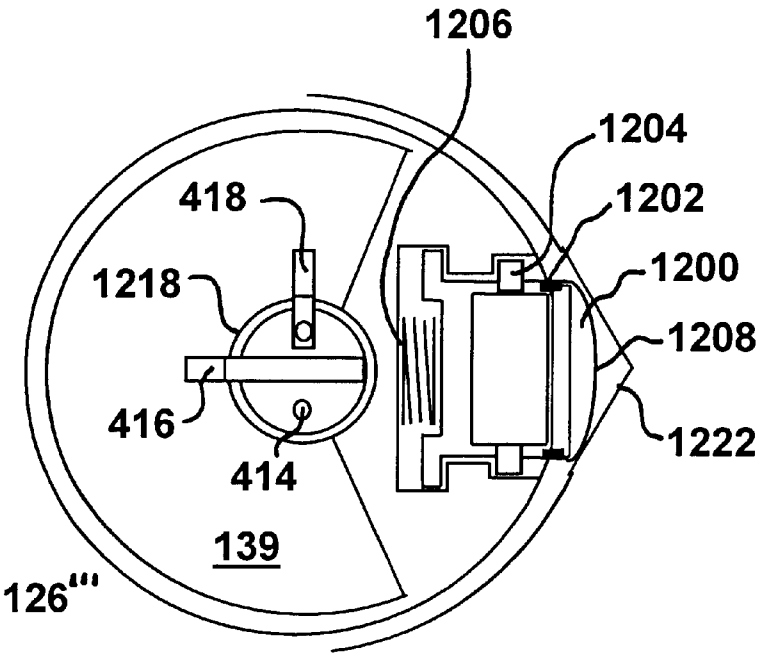
FIG. 59 shows a plan view of the embodiment of FIG. 58, when installed with a guide wall.
Figure 61:
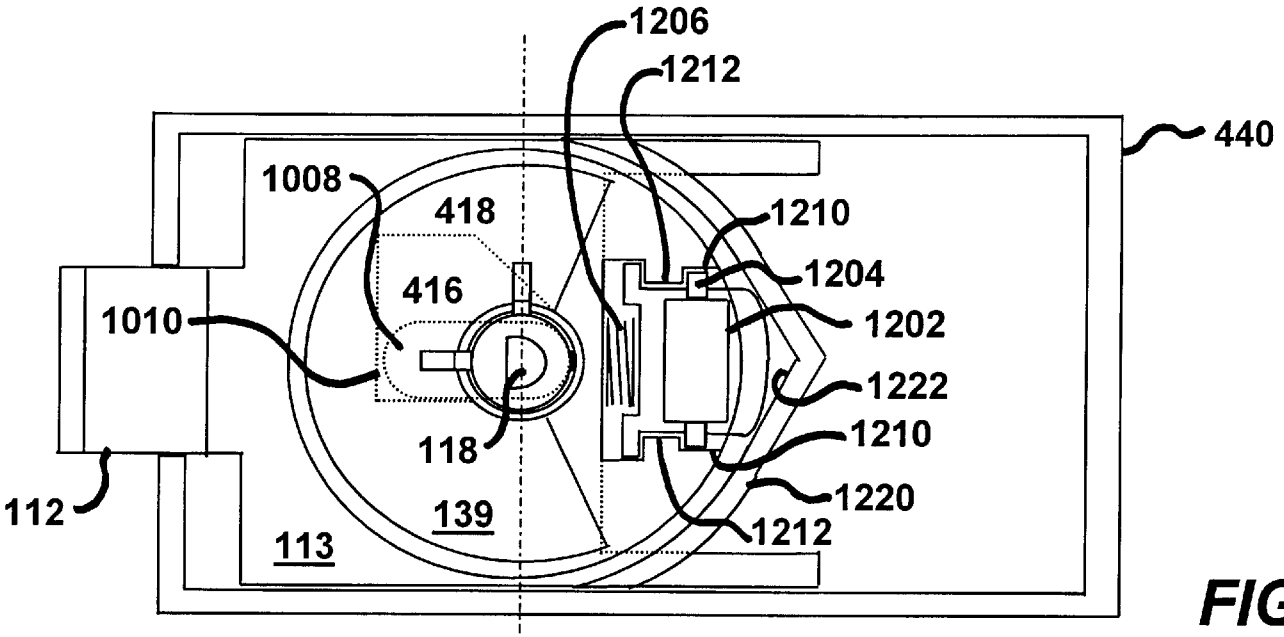
FIG. 61 shows a plan view of the embodiment of FIG. 58, as installed in a lock assembly.
Figure 62:
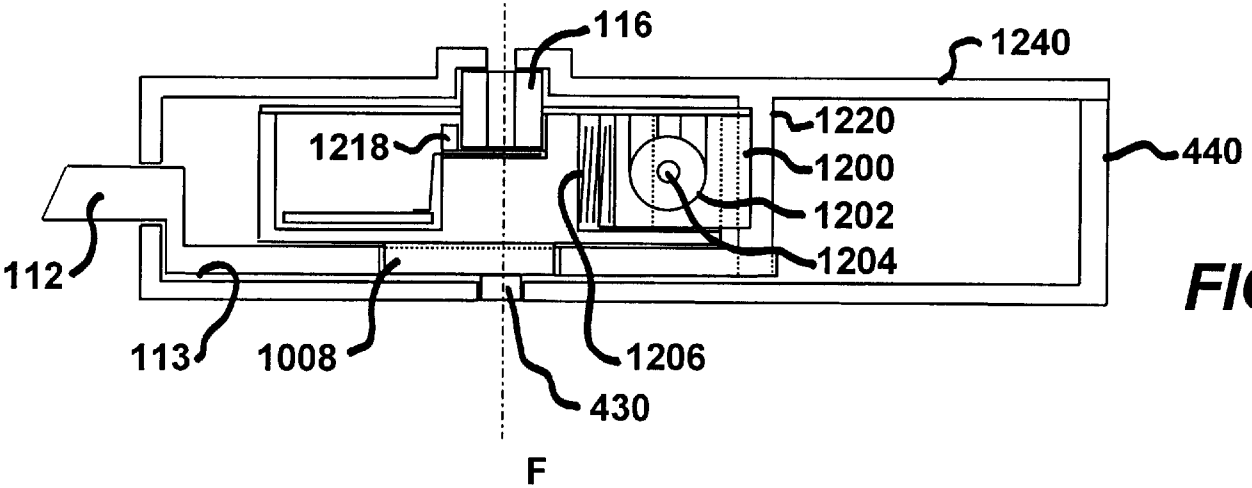
FIG. 62 shows a cross-sectional view taken along the sectional line in FIG. 61.
Figure 65:
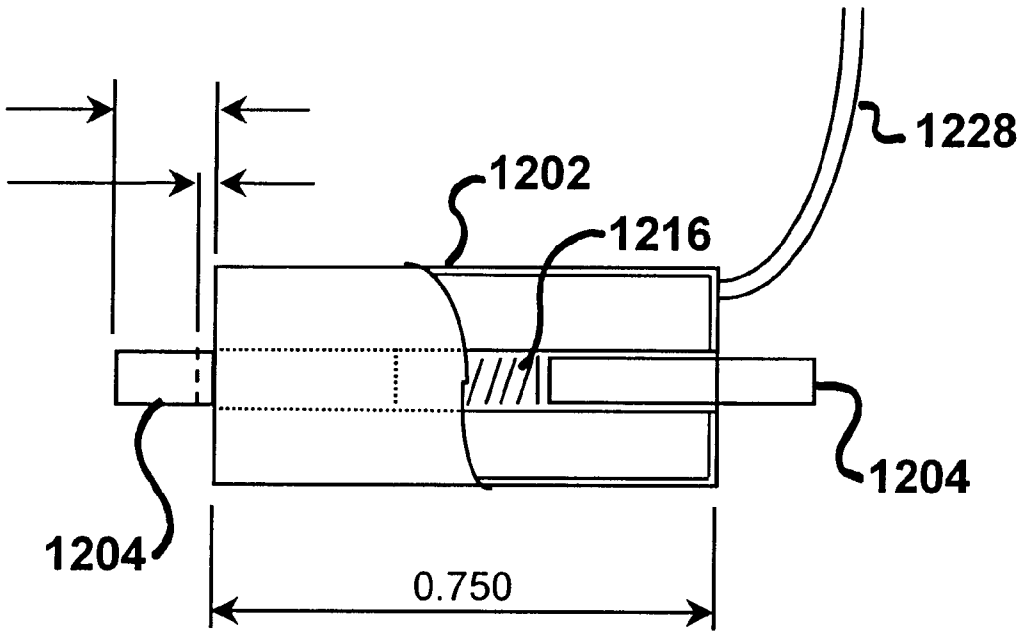
FIG. 65 shows a side view of the solenoid of FIG. 64.
Figure 64:
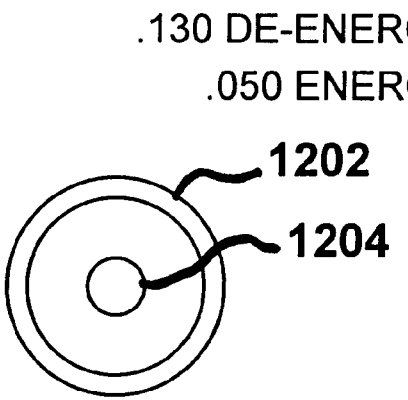
FIG. 64 shows a side view of a solenoid usable in the embodiment of FIG. 58.

Turning now to FIGS. 58 through 65, an alternative embodiment of a cam assembly is illustrated with a cam plate 126'" supporting the circuit board 139 containing an electronic circuit such as 130 (FIG. 11B). Power and data electrical contact wiper 416 is centrally positioned across the longitudinal axis (which extends out of the plane of the paper) while ground contact wiper 418 is spaced regularly apart from contact wiper 416. Shear pins 414 may connect a cylinder plug 116 with a centrally disposed boss 1218 formed within cam plate 126'". An elliptical bolt drive lobe 1008 extends axially downwardly from the lower surface of cam plate 126'", to support a much smaller pivot post 430 that is symmetrically positioned around the longitudinal axis F of keyway 118. Elliptical lobe 1008 is situated within slot 1010 centrally formed within shank 113. The central boss 1218 of cam plate 126"" has a series of spaced-apart side walls 1210, 1212 and 1214 connected by an in wall 1215, loosely accommodating a solenoid carriage 1200, while allowing carriage 1200 to reciprocate radially relative to central axis F. A spring 1206 is compressed between end wall 1215 and the central inside portion of carriage 1200, thereby holding nose 1208 of carriage 1200 outwardly protruding to engage an arch 1222 formed in a guide wall 1220 of housing cover 1240. Carriage 1200 supports solenoid 1202 with oppositely extending coaxially positioned armatures 1204 which, when solenoid 1202 is de-energized, extend axially outwardly as shown in FIG. 60 in order to place the cam assembly in the locked position. Solenoid 1202 may be constructed with a single annular wound coil driving both armatures 1204 in opposite coaxial directions. Mechanical conformance of the key inserted into keyway 118 and electronic conformance of the digital signature held by the key with the memory of circuit 130 (not separately shown) mounted upon circuit board 139 will enable circuit 130 to apply an electrical current to the coil of solenoid 1202, thereby retracting both armatures 1204 against compression spring 1216. This enables the manual torque applied by the key to keyway 118 in a clockwise direction, to cam nose 1208 of carriage 1200 out of arch 1222 and thus accommodate clockwise rotation of cam plate 126... against the bias force of spring 1206, as shown by FIG. 63. While energized by circuit 130, solenoid 1202 withdraws armatures 1204 by a sufficient distance to allow the distal ends of armatures 1204 to an axial length less the distance between opposite side walls 1212. In a locked, unenergized state solenoid 1202 has armatures 1204 extending to coaxial length somewhat less than the separation between opposite side walls 1210; it is the energization of solenoid 1202 that retracts solenoid 1202 to an axial length less than least distance separating side walls 1212. In one embodiment, each armature 1204 extended approximately 0.130 inches while solenoid 1202 was de-energized, but extended only 0.050 inches while solenoid 1202 was energized. Wire leads 1228 electrically coupled the coil of solenoid 1202 to circuit 130.

It may be seen therefore, that counterclockwise rotation of the key placed within keyway 118 will enable nose 1208 of carriage 1200 to reciprocate regularly outwardly into arch 1222 prior to withdrawal of the key.

The electronic cam and its key may be employed as components of a system having a method of programming (i.e., in some instances a computer terminal), an optional key programming station, an electronic key, and the electronic cam. Generally, the foregoing paragraphs describe a lock that may be constructed with a housing bearing a hole centered upon a first axis, a bolt supported by the housing and moving transversely relative to the first axis to protrude beyond the housing to and extended position and to retract within the housing to a retracted position, a lock cylinder perforated by a keyway, having an exposed circumferential surface surrounding the keyway rotatably fitted within the hole, and rotating within the hole in response to rotational force applied by a key conformingly corresponding to the lock through an arc centered upon the first axis, a cam positioned to rotate with the lock cylinder as the key conformingly corresponding to the lock manually applies a rotational force to the lock cylinder rotates through the arc, a member eccentrically positioned relative to the axis, extending between the cain and the bolt to drive the bolt between the extended and the retracted positions as the lock cylinder through the arc, an electronic circuit containing a memory and a microprocessor, mounted upon and supported by the cam to rotate with the cam through the arc, the electronic circuit operationally responding to digital data carried by the key a conformingly corresponding to the lock when the microprocessor determines that the digital data conformingly corresponds to resident data stored within the memory, a release spaced-apart from the cylinder and eccentrically positioned away from the first axis, the release being functionally activated by the electronic circuit to move between a deployed position preventing rotation of the cam relative to the housing, and a released position accommodating the rotation of the cam relative to the using.

What is claimed is:

1. A lock, comprising:

a housing bearing a hole;

a bolt supported by and travelling when a plane belayed a first position protruding beyond said housing and a second position retracted within said housing, said bolt being perforated by a guide aperture and a drive aperture;

a cylinder plug perforated by a keyway having an axis transversely oriented relative to said plane, said cylinder plug having an exposed circuimferential surface surrounding said keyway, and a key retainer positioned within said cylinder plug to retain a shank of a key inserted within said cylinder plug;

a cam positioned along said axis between said cylinder plug and said bolt, to rotate with said cylinder plus and force said bolt to travel between said first position and said second position as a key conformingly corresponding to said cylinder plug manually applies a rotational force to said cylinder plug through an arc centered upon said axis;

a shear pin exhibiting a shear force, said shear pin extending between said cylinder plug and said cam, to transmit said rotational force between said cylinder plug and said cam until said rotational force exceeds said shear force:

a spacer extending along said axis from said cam and into said guide aperture;

a guide centered along said axis extending from said spacer, conforming to and received within said hole borne by said housing;

a second pin spaced radially apart from said axis, extending from said cam and into said drive aperture;

an electronic circuit containing a memory, said electronic circuit being mounted within said housing and borne by said cam to rotate with said cam through said arc, said electronic circuit operationally responding to digital data carried by the key conformingly corresponding to said lock; and a release mounted upon and borne by said cam, and operationally activated by said electronic circuit to move between a deployed position preventing rotation of said cam relative to said housing, and a released position accommodating said rotation of said cam relative to said housing.

2. The lock of claim 1, further comprising:

a first electrical conductor mounted on said cam and extending from said electronic circuit and into said keyway to electrically engage a corresponding portion of any key inserted into said keyway; and a second electrical conductor forming an electrical path between said circuit board and said exposed circumferential surface.

3. The lock of claim 1, with said release comprising:

first and second pulleys mounted in a spaced-apart configuration upon said cam; and a mass positioned to move between said deployed position engaging both said cam and said housing, and said released position accommodating said rotation of said cam relative to said housing.

4. A lock, comprising:

a housing bearing a hole centered upon an axis;

a bolt supported by said housing and moving transversely relative to said axis to protrude beyond said housing to an extending position and to retract within said housing to a retracted position, said bolt having an aperture;

a cylinder plug perforated by a keyway, having an exposed circumferential surface surrounding said keyway, said cylinder plug being rotatably fitted within said aperture, and rotating within said aperture in response to rotational force applied by a key conformingly corresponding to said cylinder plug through an arc centered upon said axis;

a cam positioned to rotate with said cylinder plug as the key conformingly corresponding to said cylinder plug manually applies a rotational force to said cylinder plug and rotates through said arc;

a member eccentrically positioned relative to said axis, extending between said cam and said bolt to drive said bolt between said extended position and said retracted position as said cylinder plug rotates through said arc;

an electronic circuit containing a memory and a microprocessor operationally coupled to read and write information on said memory, mounted upon and borne by said cam to rotate with said cam through said arc, said electronic circuit operationally responding to digital data carried by the key conformingly corresponding to said cylinder plug when said microprocessor determines that said digital data conformingly corresponds to resident data stored within said memory;

a release spaced-apart from said cylinder plug and eccentrically positioned away from said axis, said release being functionally activated by said electronic circuit to move between a deployed position preventing rotation of said cam relative to said housing, and a released position accommodating said rotation of said cam relative to said housing.

5. The lock of claim 4, further comprising:

a first electrical conductor mounted on said cam and extending from said electronic circuit and being accessible through said keyway to electrically engage a corresponding portion of a key inserted into said keyway; and a second electrical conductor forming an electrical path between said electronic circuit and said exposed circumferential surface.

6. The lock of claim 4, with said release comprising:

first and second pulleys mounted in a spaced-apart configuration upon said cam;

a mass positioned to move between said deployed position engaging both said cam and said housing, and said released position accommodating said rotation of said cam relative to said housing.

7. The lock of claim 4, further comprising:

a shear pin deforming in shape in response to application of a shearing force, said shear pin extending between said cylinder pus and said cam, to transmit said rotational force between said cylinder plus and said cam until said rotational force exceeds said shear force.

8. The lock of claim 4, further comprising a coupling having a unitary structure deforming in shape in response to application of a shearing force, said coupling extending between said cylinder plug and said cam housing, to transmit said rotational force between said cylinder plug and said cam housing until said rotational force exceeds said shear force.

9. A lock, comprising:

a housing;

a bolt supported by and traveling between a first position protruding beyond said housing and a second position retracted within said housing, said bolt being perforated by a guide aperture and a drive aperture;

a plug having an axis transversely oriented relative to said bolt, perforated by a keyway accommodating insertion of a shank of a key exhibiting a first orientation relative to said housing and conformingly corresponding to physical characteristics of said keyway;

a key retainer positioned within said lock to retain the shank of the key inserted within said keyway while the shank exhibits an orientation other than said first orientation;

a cam positioned along said axis coaxially with said plug, to rotate with said plug and force said bolt to travel between said first position and said second position as the key conformingly corresponding to said physical characteristics of said keyway manually applies a rotational force to said plug through an arc centered upon said axis;

said plug and said cam providing a plurality of mating surfaces transmitting said rotational force between said plug and said cam;

a member eccentrically positioned relative to said axis, extending between said cam and said bolt to drive said bolt between said first position and said second position as said plug rotates through said arc;

an electronic circuit containing a memory, said electronic circuit operationally responding to digital data carried by the key that functionally corresponds to information stored within said memory; and a release exhibiting operational activation under control of said electronic circuit in response to occurrence to functional correspondence between said digital data and information stored within said memory, to move between a first state and a second state, with one of said first state and said second state preventing rotation of said cam relative to said housing, and another of said first state and said second state accommodating said rotation of said cam relative to said housing.

10. The lock of claim 9, further comprised of said release being mounted on, borne by, and rotating with said cam.

11. The lock of claim 9, further comprised of a source of electrical power providing energy to said electronic circuit and to enable operational activation of said release, disposed to rotate with said cam.

12. The lock of claim 11, further comprised of said source of electrical power being mounted on and borne by said cam.

13. The lock of claim 11, further comprised of said source of electrical power being mounted on and borne by the key.

14. The lock of claim 10, further comprised of a source of electrical power providing energy to said electronic circuit and to enable operational activation of said release, disposed to rotate with said cam.

15. The lock of claim 14, further comprised of said source of electrical power being mounted on and borne by said cam.

16. The lock of claim 14, further comprised of said source of electrical power being mounted on and borne by the key.

17. The lock of claim 9, further comprised of said member exhibiting a shear force, transmitting said rotational force between said plug and said cam until said rotational force exceeds said shear force.

18. The lock of claim 9, with said plug and said cam comprised of discrete and separate elements.

19. The lock of claim 9, with said release further comprised of:

a nose biased to rest in said first state while simultaneously engaging said cam and said housing and preventing said rotation; and opposing elements biased to rest in said first state while restricting movement of said nose relative to said housing, and responding to said activation by releasing said nose to travel to said second state and accommodate said rotation.

20. The lock of claim 9, with said release further comprised of:

a nose biased to rest in said first state while simultaneously engaging said cam and said housing and preventing said rotation; and a pair of elements disposed to travel in opposing directions and biased to rest in said first state while restricting movement of said nose relative to said housing, and responding to said activation by releasing said nose to travel to said second state and accommodate said rotation.

21. The lock of claim 9, further comprised of said plug and said cam comprising discrete and separable components.

22. The lock of claim 9, with said key retainer comprising an element biased to protrude into said keyway and to move transversely to said keyway when displaced by passage of the shank within said keyway, obstructing said rotation absent the key conformingly corresponding to said physical characteristics, and accommodating said rotation with the key conformingly corresponding to said physical characteristics.

23. A lock, comprising:

a housing;

a bolt supported by and traveling between a first position protruding beyond said housing and a second position retracted within said housing, said bolt being perforated by a guide aperture and a drive aperture;

a cam positioned along an axis transversely oriented relative to said bolt, perforated by a keyway accommodating insertion of a shank of a key exhibiting a first orientation relative to said housing and conformingly corresponding to physical characteristics of said keyway, to rotate with the key and force said bolt to travel between said first position and said second position as the key conformingly corresponding to said physical characteristics of said keyway manually applies a rotational force to said cam through an arc centered upon said axis;

a key retainer positioned within said lock to retain the shank of the key inserted within said keyway while the shank exhibits an orientation other than said first orientation;

a member eccentrically positioned relative to said axis, extending between said cam and said bolt to drive said bolt between said first position and said second position as said cam rotates through said arc;

an electronic circuit containing a memory, said electronic circuit operationally responding to digital data carried by the key that exhibits a functional correspondence to information stored within said memory; and a release exhibiting operational activation under control of said electronic circuit in response to occurrence of said functional correspondence, to move between a first state and a second state, with one of said first state and said second state preventing rotation of said cam relative to said housing, and another of said first state and said second state accommodating said rotation of said cam relative to said housing.

24. The lock of claim 23, further comprised of said release being mounted on, borne by, and rotating with said cam.

25. The lock of claim 23, further comprised of a source of electrical power providing energy to said electronic circuit and to enable operational activation of said release, disposed to rotate with said cam.

26. The lock of claim 25, further comprised of said source of electrical power being mounted on and borne by said cam.

27. The lock of claim 25, further comprised of said source of electrical power being mounted on and borne by the key.

28. The lock of claim 24, further comprised of a source of electrical power providing energy to said electronic circuit and to enable operational activation of said release, disposed to rotate with said cam.

29. The lock of claim 28, further comprised of said source of electrical power being mounted on and borne by said cam.

30. The lock of claim 28, further comprised of said source of electrical power being mounted on and borne by the key.

31. The lock of claim 23, further comprised of said member exhibiting a shear force, transmitting said rotational force between the key and said cam until said rotational force exceeds said shear force.

32. The lock of claim 23, with said bolt and said cam comprised of discrete and separate elements.

33. The lock of claim 23, with said release farther comprised of:

a nose biased to rest in said first state while simultaneously engaging said cam and said housing and preventing said rotation; and opposing elements biased to rest in said first state while restricting movement of said nose relative to said housing, and responding to said activation by releasing said nose to travel to said second state and accommodate said rotation.

34. The lock of claim 23, with said release further comprised of:

a nose biased to rest in said first state while simultaneously engaging said cam and said housing and preventing said rotation; and a pair of elements disposed to travel in opposing directions and biased to rest in said first state while restricting movement of said nose relative to said housing, and responding to said activation by releasing said nose to travel to said second state and accommodate said rotation.

35. The lock of claim 23, with said key retainer comprising an element biased to protrude into said keyway and to move transversely to said keyway when displaced by passage of the shank within said keyway, obstructing said rotation absent the key conformingly corresponding to said physical characteristics, and accommodating said rotation with the key conformingly corresponding to said physical characteristics.

36. The lock of claim 23, further comprising:

an extension protruding from said housing; and said release comprising:

an actuator mounted upon said cam and engaging said extension and limiting said rotation of said cam while in a first orientation relative to said extension, and accommodating passage of said extension relative to said actuator during said rotation of said cam while in a second orientation relative to said extension; and a motor having a shaft mounting said actuator, rotating said actuator between said first orientation and said second orientation in dependence upon said occurrence of said functional correspondence.

37. A lock, comprising:

a housing;

a bolt;

a cylinder plug;

a cam positioned within said housing to rotate with said cylinder plug, said cam bearing a drive member spaced radially apart from said cylinder plug and engaging and forcing said bolt to move as said cylinder plug, applies a rotational force to said cam; and an electrical operator borne by said cam, in a first state preventing rotation of said cam and when in a second state allowing rotation of said cam.

38. The lock of claim 37, further comprising:

said cylinder plug being rotated by a keyway;

a first electrical conductor mounted on said cam and extending from said electrical operator and into said keyway to electrically engage a corresponding portion of a key inserted into said keyway; and a second electrical conductor forming an electrical path between said electrical operator and a circumferential surface of said cylinder plug surrounding keyway and ex posed by said housing.

39. The lock of claim 37, further comprising:

said cylinder plug being perforated by a keyway;

a cover perforated by an opening exposing said keyway and a surrounding face of said cylinder plug while said cover mates with said housing and encases said cam;

a release operationally controlled by said electrical operator to exhibit a first position accommodating rotation of said cam with rotation of said cylinder plug and to exhibit a deployed position hinder said rotation; and a glide wall positioned by said cover to partially surround said cam, and retentively engage said release when said release is in said deployed position.

40. A lock, comprising:

a housing;

a bolt supported by said housing while moving within a longitudinal plane between a first position protruding beyond said housing and a second position retracted within said housing, said bolt bearing a first drive member;

a cylinder plug perforated by a keyway, said cylinder plug being positionable within said housing with an axis transversely oriented relative to said longitudinal plane, said cylinder plug having a circumferential surface surrounding said keyway exposed through said housing;

a cam positioned within said housing along said axis between said cylinder plug and said bolt, to rotate with said cylinder plug, said cam bearing a second drive member spaced radially apart from said axis and engaging said first drive member and forcing said bolt to move within said longitudinal plane as a key conformingly corresponding to said cylinder plug applies a rotational force to said cylinder plug through an arc centered upon said axis;

an electronic circuit containing a memory, said electronic circuit being mounted within said housing and borne be said cam to rotate with said cam through sad arc, said electronic circuit operationally responding to digital data carried by the key conformingly corresponding to said cylinder plug; and a release mounted upon and borne by said cam and operationally activated by said electronic circuit to move between a deployed position preventing rotation of said cam relative to said housing, and a released position accommodating said rotation of said cam relative to said housing.

41. The lock of claim 40, further comprising:

a first electrical conductor mounted on said cam and extending from said electronic circuit and into said keyway to electrically engage a corresponding portion of a key inserted into said keyway; and a second electrical conductor forming an electrical path between said electronic circuit and said exposed circumferential surface.

42. The lock of claim 40, further comprising:

a cover perforated by opening exposing said keyway and a surrounding face of said lock cylinder while said cover mates with said housing and encases said cam; and a glide wall positioned by said cover to partially surround said cam, and retentively engage said release when said release is in said deployed position.

43. The lock of claim 40, further comprising:

an extension protruding from said housing; and said release comprising:

an actuator mounted upon said cam and engaging said extension and limiting said rotation of said cam while in a first orientation relative to said extension, and accommodating passage of said extension relative to said actuator during said rotation of said cam while in a second orientation relative to said extension; and a motor having a shaft mounting said actuator, rotating said actuator between said first orientation and said second orientation in dependence upon said occurrence of said functional correspondence.

* * * * *